US010399218B2

(12) United States Patent
Elen et al.

(10) Patent No.: US 10,399,218 B2
(45) Date of Patent: Sep. 3, 2019

(54) MOTORIZED SCRUBBING, BUFFING, AND POLISHING TOOL

(71) Applicant: Carine Elen, New Paltz, NY (US)

(72) Inventors: Carine Elen, New Paltz, NY (US); Mark Andre Colbert, West Hartford, CT (US); Barbara Ann Leon, New Paltz, NY (US)

(73) Assignee: Carine Elen, New Paltz, NY (US)

( * ) Notice: Subject to any disclaimer, the term of this patent is extended or adjusted under 35 U.S.C. 154(b) by 0 days.

(21) Appl. No.: 15/231,275

(22) Filed: Aug. 8, 2016

(65) Prior Publication Data

US 2017/0086633 A1 Mar. 30, 2017

Related U.S. Application Data

(63) Continuation-in-part of application No. 14/366,176, filed as application No. PCT/IB2012/002945 on Dec. 19, 2012, now Pat. No. 9,408,513.

(Continued)

(51) Int. Cl.
*B24B 23/00* (2006.01)
*B25F 5/00* (2006.01)

(Continued)

(52) U.S. Cl.
CPC ..... *B25F 5/006* (2013.01); *B24B 23/005* (2013.01); *B24B 23/04* (2013.01); *B24B 23/046* (2013.01); *B24B 29/00* (2013.01); *B24B 57/02* (2013.01)

(58) Field of Classification Search
CPC ..... B24B 23/04; B24B 29/00; A47L 11/00; A47L 11/02; A47L 11/03; A47L 11/10;

(Continued)

(56) References Cited

U.S. PATENT DOCUMENTS 2,540,032 A * 1/1951 Allen ..... H02G 3/14 33/197
2,722,790 A * 11/1955 Smith ..... A47L 11/12 451/356

(Continued)

FOREIGN PATENT DOCUMENTS

WO WO 2013093619 A2 6/2013

OTHER PUBLICATIONS

European Patent Office, International Search Report and Written Opinion, PCT/ISA/220, Application No. PCT/IB2012/002945, dated Oct. 25, 2013, European Patent Office, Rijswijk, Netherlands.

*Primary Examiner* — George B Nguyen
(74) *Attorney, Agent, or Firm* — O'Connell Law Firm; Thomas P. O'Connell

(57) ABSTRACT

A motorized tool for scrubbing, buffing, and polishing. The tool has a motor within a housing powered by an electrical power supply to move a base member. Surface treatment material is selectively retained by the base member, potentially by a latching system, a sleeved surface treatment system, or hook and loop material. A water-resistant battery pack can be selectively engaged with the housing, such as through a mating engagement between a tubular projection from the battery pack in combination with an annular socket in the housing, in a substantially watertight manner to provide electrical power. A liquid retaining volume can be disposed within the motorized tool, such as partially within a handle and partially contiguous with a motor compartment of the housing, for retaining a volume of liquid. Liquid can be selectively emitted into or through a surface treatment pad through an exhaust tube.

13 Claims, 42 Drawing Sheets

Related U.S. Application Data

(60) Provisional application No. 61/577,653, filed on Dec. 19, 2011.

(51) Int. Cl.
*B24B 29/00* (2006.01)
*B24B 23/04* (2006.01)
*B24B 57/02* (2006.01)

(58) Field of Classification Search
CPC ..... A47L 11/12; A47L 11/125; A47L 11/40; A46B 13/00; A46B 13/02; A46B 13/023; A46B 13/04
USPC ..... 451/344, 356–359
See application file for complete search history.

(56) References Cited

U.S. PATENT DOCUMENTS 2,775,076 A * 12/1956 Roods ..... A47L 11/12 451/356
3,176,436 A * 4/1965 Anton ..... A47L 11/10 451/311
3,579,915 A * 5/1971 Satterthwaite ..... B24B 23/03 451/271
4,158,246 A * 6/1979 Meadows ..... B24B 23/02 15/28
4,463,525 A * 8/1984 Sheber ..... B08B 1/04 15/1.7
5,038,523 A * 8/1991 Farber ..... B24B 23/026 15/1.7
5,150,492 A * 9/1992 Suroff ..... A61C 17/20 15/22.1
5,289,605 A * 3/1994 Armbruster ..... A47L 11/282 15/144.4
5,398,457 A * 3/1995 Updegrave ..... B24B 23/04 30/500
5,423,102 A 6/1995 Madison
5,701,625 A 12/1997 Siman
5,759,094 A * 6/1998 Bosten ..... B24B 23/04 451/164
5,960,503 A 10/1999 Del Pozo Y Mattei
6,022,267 A * 2/2000 Chyn ..... B24B 23/022 451/344
6,149,096 A * 11/2000 Hartley ..... B65H 75/40 191/12.2 A
6,292,971 B1 9/2001 Chaudray
6,306,024 B1 * 10/2001 Kai ..... B24B 23/03 451/357
6,676,499 B1 * 1/2004 Stewart, II ..... B24B 45/006 451/359
7,101,274 B1 * 9/2006 Etter ..... B24B 23/005 144/114.1
7,220,174 B2 * 5/2007 Phillips ..... B24B 7/184 451/354
7,261,623 B1 * 8/2007 Palushi ..... B24B 7/186 451/350
7,284,292 B2 10/2007 Jaffe
7,285,038 B1 * 10/2007 Jioia ..... B24B 23/005 451/28
D573,857 S 7/2008 Stratford et al.
7,571,517 B2 * 8/2009 Smith ..... B25G 1/005 16/422
7,596,872 B2 * 10/2009 Clarke ..... B23D 45/16 30/388
7,631,386 B1 12/2009 Santiago et al.
7,707,674 B2 5/2010 Schonewille et al.
8,122,554 B2 2/2012 Schemmel et al.
8,226,454 B2 * 7/2012 Chen ..... B23Q 11/0046 451/357
8,261,398 B2 * 9/2012 Haigh ..... A46B 5/0075 15/143.1
8,484,805 B2 * 7/2013 Munari ..... A47J 45/071 16/425
2003/0017796 A1 * 1/2003 Walker ..... B24B 23/04 451/357
2003/0171079 A1 * 9/2003 How ..... B08B 1/04 451/53
2004/0043704 A1 * 3/2004 Saberton ..... B23Q 1/621 451/38
2004/0074025 A1 4/2004 Blaustein et al.
2004/0103490 A1 6/2004 Long et al.
2004/0123410 A1 * 7/2004 Terry ..... A46B 5/02 15/23
2005/0090324 A1 * 4/2005 Cardosi ..... A63B 69/3641 473/257
2005/0183222 A1 * 8/2005 Grohe, Jr. ..... A47L 11/162 15/49.1
2006/0068689 A1 3/2006 Kiss et al.
2006/0172668 A1 * 8/2006 Hofmann ..... B24B 23/02 451/359
2007/0082590 A1 * 4/2007 Kraenzler ..... B21K 1/12 451/359
2008/0090504 A1 * 4/2008 Trautner ..... B24B 23/00 451/359
2008/0091326 A1 * 4/2008 Watanabe ..... B60T 13/741 701/70
2008/0254721 A1 * 10/2008 Wuensch ..... B24B 23/04 451/344
2009/0090763 A1 * 4/2009 Zemlok ..... A61B 17/07207 227/175.2
2009/0221222 A1 * 9/2009 Lo ..... B24B 23/02 451/359
2010/0009608 A1 * 1/2010 Lo ..... B24B 23/028 451/357
2010/0048101 A1 * 2/2010 King ..... B24B 23/03 451/28
2010/0105301 A1 * 4/2010 Whelan ..... B23D 45/16 451/359
2010/0115730 A1 * 5/2010 Holland ..... B25G 1/102 16/422
2010/0178856 A1 * 7/2010 Cruz ..... B08B 1/00 451/356
2012/0045976 A1 * 2/2012 Roser ..... B24B 1/04 451/358
2013/0084193 A1 * 4/2013 Beers ..... F04D 17/12 417/44.1
2014/0182872 A1 * 7/2014 Rubens ..... B27B 19/006 173/213

* cited by examiner

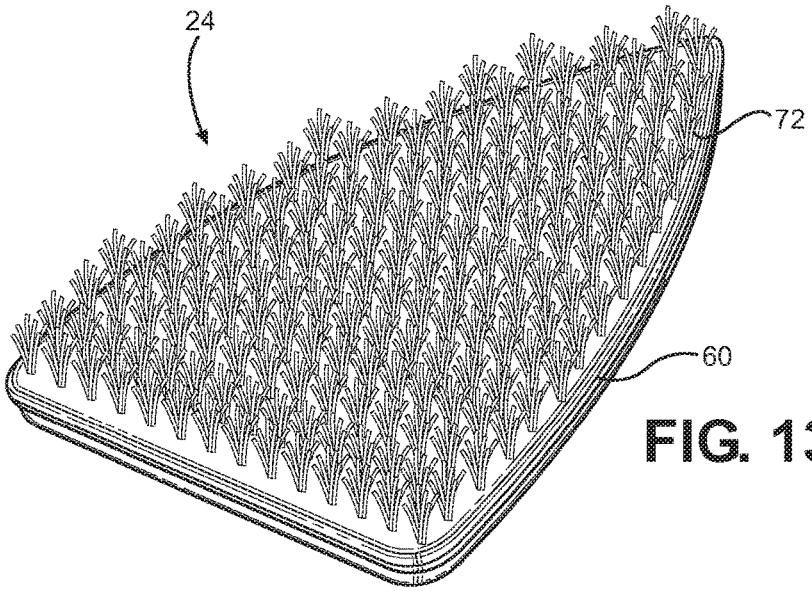
FIG. 13A
FIG. 13B
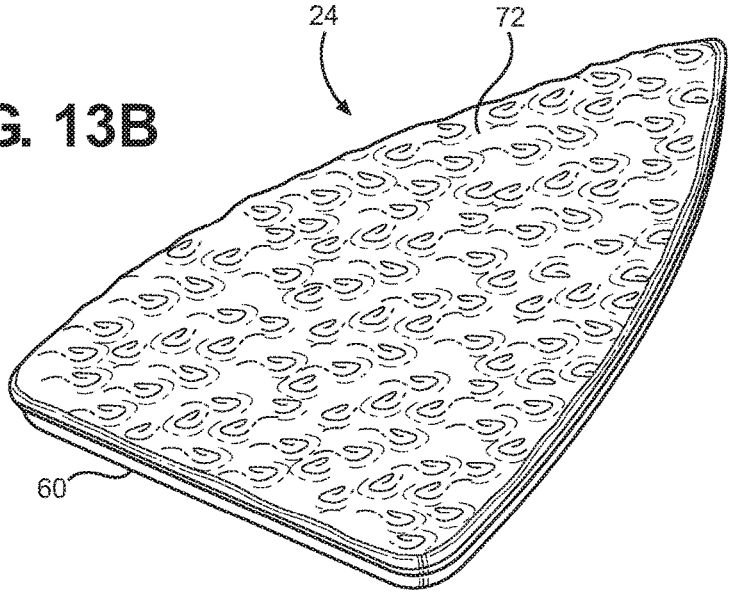

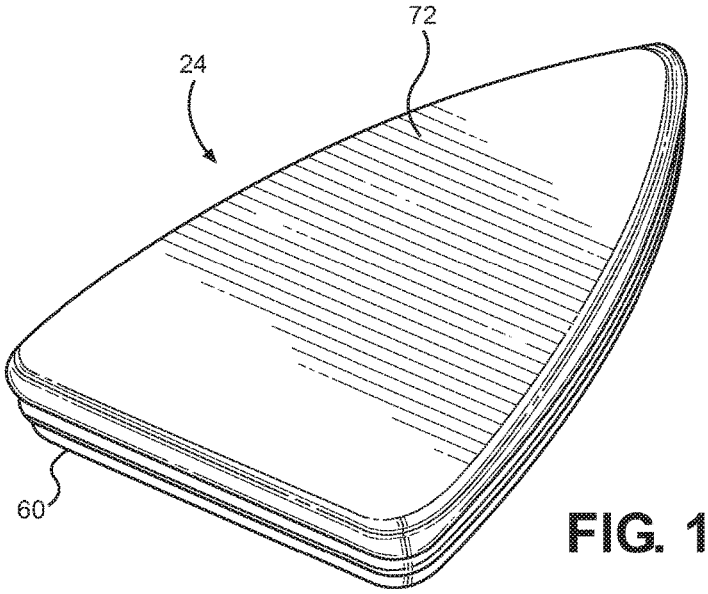
FIG. 13C
FIG. 13D
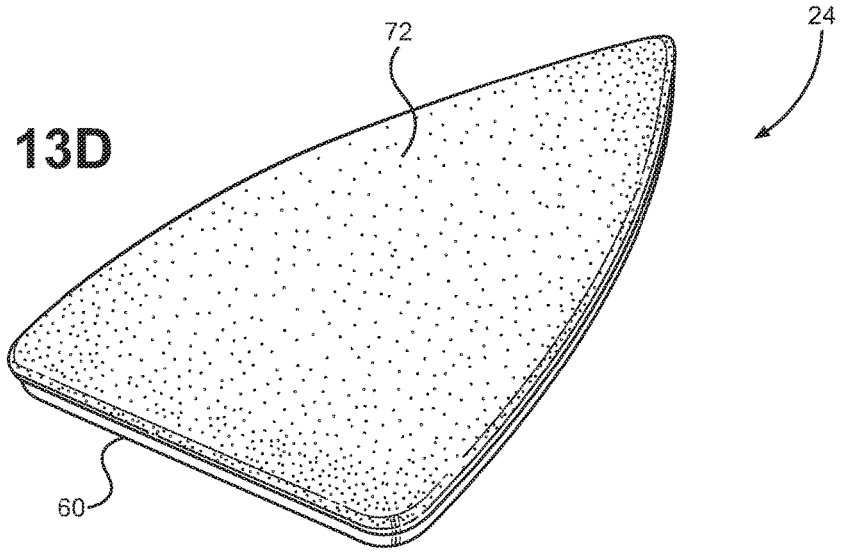

MOTORIZED SCRUBBING, BUFFING, AND POLISHING TOOL

RELATED APPLICATIONS

This application is a continuation-in-part of application Ser. No. 14/366,176, filed Jun. 17, 2014, which is a National Stage Entry of PCT/IB12/02945, filed Dec. 19, 2012, which claimed priority to Provisional Application No. 61/577,653, filed Dec. 19, 2011. The entirety of each disclosure is hereby incorporated by reference.

FIELD OF THE INVENTION

The present invention relates generally to motorized tools. More particularly, disclosed herein is a water resistant, motorized scrubbing, buffing, and polishing tool of ergonomic configuration with interchangeable surface treatment pads for permitting varied surface treatments.

BACKGROUND OF THE INVENTION

It will be recognized that the prior art has disclosed numerous hand tools and methods for cleaning, polishing, and buffing household and similar surfaces. Most basically, for example, sponges with smooth and abrasive surfaces have been taught where a user can clean, polish, and buff a surface with sheer elbow grease. However, such methods and devices are cumbersome and often of limited effectiveness.

Motorized handheld cleaning tools are also disclosed by the prior art. For example, U.S. Pat. No. 7,707,674 to Schonewille et al. discloses a motorized handheld scrubbing tool. There, the scrubbing tool has a housing with a battery-powered motor that drives an output shaft. The output shaft in turn propels a cleaning attachment. The Schonewille et al. patent further includes a liquid delivery system that is quite complicated in structure and function with piston and valve assemblies and a pressurized reservoir for dispensing liquid household cleaners. In a similar vein, U.S. Pat. No. 5,701,625 to Siman teaches a motorized scrubbing machine that seeks to reduce the effort required for cleaning by use of rotating pads or brushes. Under the Siman invention, water and detergent can be supplied from a pipe inlet to pass through the pads for cleaning and rinsing.

These and further inventions have contributed usefully to the state of the art. However, it will be recognized that they are complex in construction and function. Moreover, these and similar cleaning tools are limited in their functionality and adaptability.

In view of the shortcomings of the prior art, the present inventor has appreciated that there is a recognized need for an improved motorized tool that can permit scrubbing, buffing, and polishing to be carried out efficiently and effectively in varied applications and in relation to multiple different surfaces and difficult to reach locations through tool adaptability and improved functionality, all with reduced manual effort by the user.

SUMMARY OF THE INVENTION

Accordingly, the present invention was founded on the basic object of creating a motorized cleaning scrubbing, buffing, and polishing tool that permits such tasks to be carried out efficiently and effectively with reduced user effort. A further object of embodiments of the invention is to provide a motorized tool with an ergonomic configuration that can be gripped and manipulated comfortably and effectively and that can additionally or alternatively be retained and manipulated by an elongate handle for use as a floor model or otherwise for extended access. Still another object of embodiments of the invention is to provide a motorized tool with interchangeable surface treatment pads for permitting varied surface treatments, including scrubbing, buffing, and polishing. A further object of embodiments of the invention is to provide a motorized tool that is water resistant and, ideally, buoyant for use in wet applications, including bath, kitchen, outdoor, and marine applications.

These and further objects and advantages of embodiments of the invention will become obvious not only to one who reviews the present specification and drawings but also to those who have an opportunity to enjoy the use of an embodiment of the motorized tool disclosed herein. However, it will be appreciated that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the present invention.

In carrying forth one or more objects of the invention, a motorized tool for scrubbing, buffing, and polishing can be considered to be founded on a housing. A motor is retained within the housing, and an electrical power supply provides electrical power to the motor. A switch selectively permits electrical power to flow from the power supply to the motor. A base member is retained relative to the housing, and an actuation mechanism moves the base member in response to an operation of the motor. A material retention mechanism is capable of removably retaining surface treatment material in relation to the base member so that, during operation of the motor and movement of the base member, the surface treatment material can be employed to scrub, buff, polish, or otherwise treat a target surface.

In one such embodiment of the motorized tool, the material retention mechanism comprises a surface treatment pad that retains surface treatment material in combination with a latching system. The latching system has a first, latched condition wherein the surface treatment pad is retained by the base member and a second condition wherein the surface treatment pad is removable from the base member. For instance, the surface treatment pad can comprise a shoe with first and second ends and first and second faces. Surface treatment material is retained by the second face of the shoe, and the latching system comprises a latching lever and a latch operative to retain the shoe for movement with the base member when in the latched condition.

The shoe can have a first formation for engaging the base member at a first location and a second formation for being engaged by the latch of the latching system. For example, the first formation can comprise a hook formation for hooking over a portion of the base member, and the second formation can comprise a hook formation for being engaged by the latch of the latching system. More particularly, with the shoe being considered to have a dorsal side and a ventral side, the first formation can be a dorsally facing hook and the second formation can be a ventrally facing hook.

It is disclosed that the latching lever can be pivotally coupled to the base member. With that, the latching system will be wholly retained by the base member, and vibration of the base member and the latching lever will not tend to impart vibration directly to the housing. In such embodiments, the tool can have a handle coupled to the housing, and the latching lever can have a general U-shape about a longitudinal centerline of the motorized tool. A first leg of the U-shape can thus be disposed to a first side of the handle, a second leg disposed to a second side of the handle 95, and a base of the U-shape disposed below the handle thereby to permit the latching lever to remain clear of the handle.

It is additionally or alternatively possible for the material retention mechanism to comprise a sleeved surface treatment system. There, the system can have a sleeve with a first panel and a second panel, surface treatment material retained by the first panel, a base platform for being received between the first and second panels, and a mechanism for selectively securing the base platform so received between the first and second panels to the base member. The first and second panels can have edges with the first and second panels being joined along at least a portion of the edges. Furthermore, a mechanical fastening system, such as a zipper closure, hook and loop combination, or any other mechanical fastening system, can selectively join portions of the first and second panels, potentially to define an enclosed inner volume for receiving and retaining the base platform. The base platform and the retained sleeve can be secured to the base member in a number of ways, including by a plurality of projections from the base member or the base platform in combination with a plurality of apertures in the other of the base platform and the base member.

It is still further contemplated that the material retention mechanism can take the form of an area of hook or loop material retained by the base member in combination with a base platform that has a first surface that retains an area of loop or hook material and a second surface that retains surface treatment material. In such and potentially other constructions taught herein, guide marking can be disposed on the base platform for guiding application of the base platform to the base member.

Another embodiment of the motorized tool for scrubbing, buffing, and polishing can again have a housing, a motor retained within the housing, a water-resistant battery pack for providing electrical power to the motor, a switch for selectively permitting electrical power to flow from the power supply to the motor, a base member retained relative to the housing, an actuation mechanism that moves the base member in response to an operation of the motor, and a material retention mechanism capable of removably retaining surface treatment material in relation to the base member wherein the housing has a receiving opening for receiving the battery pack and wherein the battery pack and the housing are engageable in a substantially watertight manner.

For example, the battery pack can have a substantially watertight chamber and a projection from the chamber. The housing can have a formation for engaging the projection from the chamber in a substantially watertight relationship. Moreover, electrical contacts can be disposed on the projection from the chamber and on the formation of the housing to permit electrical engagement between the battery pack and the housing. In particular embodiments, the projection from the chamber can be tubular, and the formation of the housing can comprise an annular socket. At least one O-ring can then be disposed on the projection from the chamber for facilitating a watertight engagement between the battery pack and the housing. Even further, a latching system can be provided for selectively retaining the battery pack relative to the housing with the latching system comprising at least one leg that projects from the battery pack in combination with at least one aperture in the housing for receiving the at least one leg.

In still another manifestation, the motorized tool for scrubbing, buffing, and polishing can include a housing, a motor retained within the housing, an electrical power supply for providing electrical power to the motor, a switch for selectively permitting electrical power to flow from the power supply to the motor, a base member retained relative to the housing, an actuation mechanism that moves the base member in response to an operation of the motor, a material retention mechanism capable of removably retaining surface treatment material in relation to the base member, and a liquid retaining volume within the motorized tool for retaining a volume of liquid.

In such constructions, the motorized tool can further comprise a liquid emission mechanism for permitting a selective emission of liquid from the liquid retaining volume. The liquid emission mechanism could be selectively actuated, such as by an actuation button or trigger, which could be mechanically or electrically operable, such as by a pumping mechanism. The liquid emission mechanism can permit the emission of liquid through the base member. With that, liquid can be emitted into or through surface treatment material retained in relation to the base member. By way of example, the liquid emission mechanism can include an exhaust tube with a proximal portion in fluidic communication with the liquid retaining volume and a distal tip, and that distal tip of the tube could be disposed at least partially within the base member.

Certain embodiments of the tool can define the liquid retaining volume by a bladder. Furthermore, where the motorized tool has a handle, the bladder can have at least a portion disposed in the handle. The handle can have an anterior end fixed to an anterior portion of the housing, a posterior end fixed to a posterior portion of the housing, and a body portion between the anterior and posterior ends of the handle. Furthermore, where the housing has a motor compartment, it is contemplated that at least a portion of the liquid retaining volume can be disposed contiguous with the motor compartment. It is further contemplated that additional cooling of the motor and the motor compartment may be achieved by providing at least one passageway through the housing adjacent to the motor compartment.

In one embodiment, the motorized tool can again be considered to be founded on a housing with an upper portion, a base portion, a mid-portion disposed between the upper portion and the base portion, a bottom wall with a plurality of apertures therein, and an inner volume that is substantially water resistant whereby the tool can be used in wet and dry applications. A motor is retained within the housing, and an electrical power supply is provided for providing electrical power to the motor. A switch selectively permits electrical power to flow from the power supply to the motor. A base member is retained relative to the housing, and an actuation mechanism moves the base member in response to an operation of the motor. A retention mechanism is capable of retaining a surface treatment pad in relation to the base member.

Embodiments of the tool have a release mechanism that selectively releases a surface treatment pad from the base member. Moreover, a plurality of flexible rods, each with a first end retained by the housing, a second end retained by the base member, and a body portion can cooperate to provide vibration isolation between the base member and the housing. Still further, a water resistant barrier with at least one sealing membrane may be disposed in the plurality of apertures in the bottom wall of the housing between the inner volume and the base member with the body portions of the flexible rods passing from within the inner volume, through the apertures in the bottom wall of the housing, and, potentially, through the at least one sealing membrane between the inner volume and the base member.

The electrical power supply can comprise at least one rechargeable battery, and embodiments of the tool can provide a recharge warning regarding an imminent need for recharging the battery. That warning could, for example, alter an operation of the motor dependent on a charge status of the battery.

As disclosed herein, a surface treatment pad can be retained by the base member, and the upper portion of the housing could terminate anteriorly in a tip. The surface treatment pad can then project anteriorly to the tip when the tool is disposed with the surface treatment pad resting on a work surface.

The upper portion of the housing could comprise a bulbous knob, and the mid-portion could take the form of a recessed portion between the upper portion and the base portion. With that, the tool can be gripped by the upper portion. Moreover, a central textured gripping section and first and second lateral textured gripping sections can be retained relative to the housing with the central gripping section spanning from the top of the upper portion of the housing beyond a midpoint of the housing and anteriorly to overlie the anterior portion of the upper portion. The first and second lateral gripping sections can be disposed to opposite sides of the upper portion of the housing to span above and below a broadest localized portion of the upper portion. The textured gripping section can comprise a high friction material.

Embodiments of the motorized tool may have a release mechanism that selectively releases a surface treatment pad from the base member. For example, the release mechanism can comprise at least one release button disposed on the housing that permits a selective release of a surface treatment pads for cleaning or replacement, and the at least one release button could be disposed along the base portion of the housing. The at least one release button could be incorporated within a textured gripping section comprising a high friction material.

A retention mechanism for a surface treatment pad can take the form of at least one engaging tab that projects dorsally from either a base platform or the housing in combination with at least one correspondingly located locking slot retained by the other of the base platform and the housing. The at least one release button can selectively release the at least one engaging tab from the at least one locking slot.

Embodiments of the motorized tool can have a housing formed by first and second housing halves with a sealing gasket interposed therebetween to create a substantially watertight relationship between the first and second housing halves. Moreover, the first and second housing halves can have bottom walls with slots therein through which the flexible rods pass and in which the at least one sealing membrane is received. The motorized tool can be buoyant whereby the tool will tend to float in a body of water. Further, the tool may be balanced such that the tool floats in an upright position with the upper portion projecting above a surface of the body of water and the base portion disposed below the surface of the body of water.

In further embodiments, an extension handle can be provided, and a receptacle can be disposed in the housing for selectively receiving the extension handle. For example, the housing can be formed by first and second housing halves joined to form the housing, and first and second receptacle halves can be formed in the housing halves to form the receptacle. The housing can have a fluidtight inner compartment with the receptacle fluidically sealed in relation to the fluidtight inner compartment.

Further still, within the scope of the invention, the motorized tool can have a heat sink in thermal communication with the motor, and at least one heat sink arm can project from the heat sink with the heat sink arm terminating adjacent to an exterior of the housing. Even more particularly, the housing can have a heat sink aperture, and the at least one heat sink arm can be exposed to an exterior of the housing through the heat sink aperture. The at least one heat sink arm can, in particular manifestations, terminate in a heat sink flange that establishes a continuous, contoured surface with the housing.

The motorized tool can have a recharge warning system that provides a warning regarding an imminent need for recharging the battery. For example, the recharge warning system can alter operation of the motor dependent on a charge status of the battery. Furthermore, a thermal motor sensor switch in thermal communication with the motor can prevent motor operation during predetermined temperature-related conditions.

In a further refinement, the motorized tool can additionally include a reservoir with a body portion removably engaged with the body portion of the motorized tool. The reservoir can have an open inner volume for retaining a volume of material and a dispensing tip for dispensing material from the open inner volume. For instance, as disclosed herein, the reservoir could have first and second resiliently deflectable legs and a central aperture in the body portion. At least one button could be provided that can be pressed to pressurize the reservoir and to dispense material from the reservoir through the dispensing tip.

One will appreciate that the foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

BRIEF DESCRIPTION OF THE DRAWINGS

In the accompanying drawing figures:

FIGS. 13A, 13B, 13C, and 13D are perspective views of alternative surface treatment pads;

DETAILED DESCRIPTION OF PREFERRED EMBODIMENTS

The present invention for a motorized tool is subject to widely varied embodiments. However, to ensure that one skilled in the art will be able to understand and, in appropriate cases, practice the present invention, certain preferred embodiments of the broader invention revealed herein are described below and shown in the accompanying drawing figures.

Figure 1:
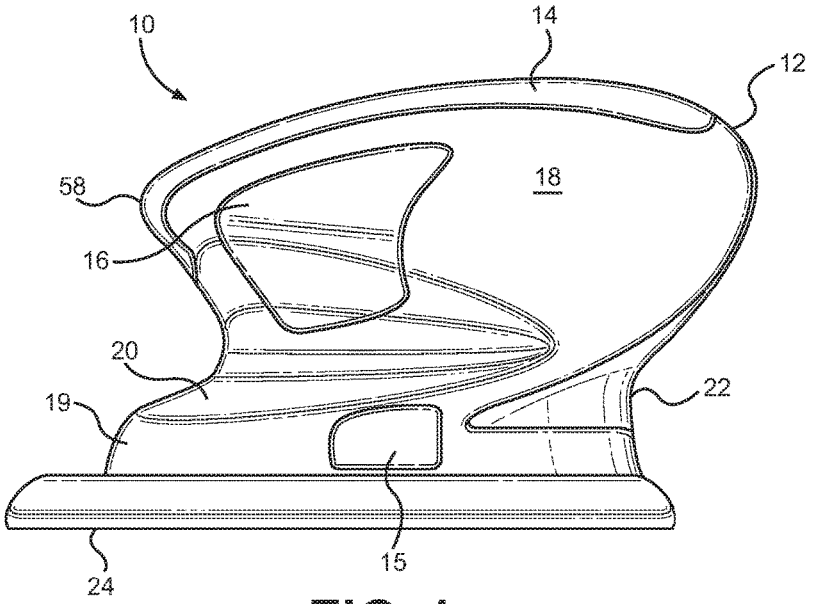
FIG. 1 is a view in side elevation of a motorized tool as disclosed herein.
Figure 2:
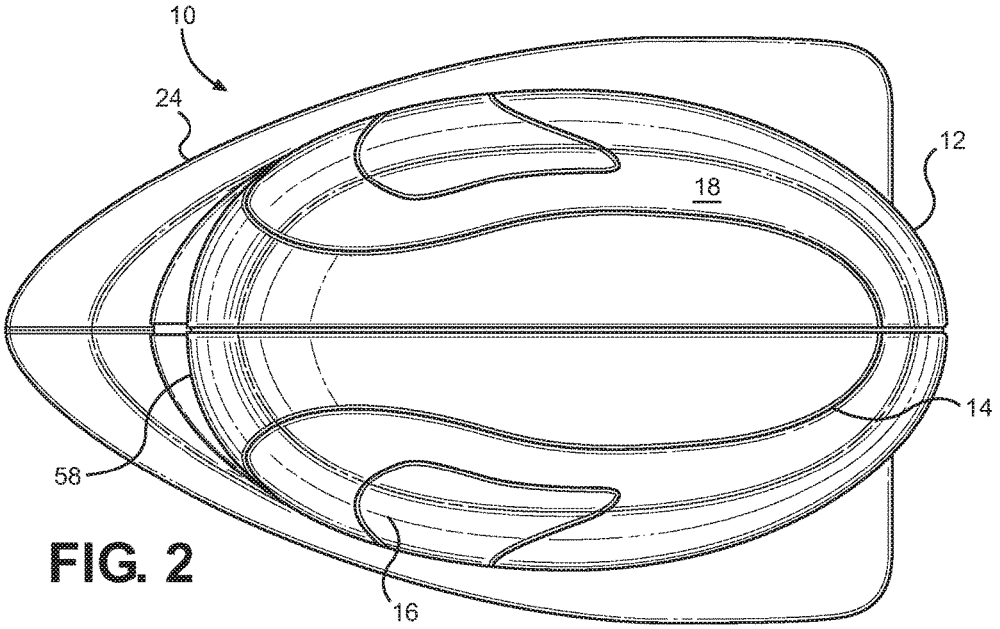
FIG. 2 is a top plan view of the motorized tool of FIG. 1.
Figure 3:
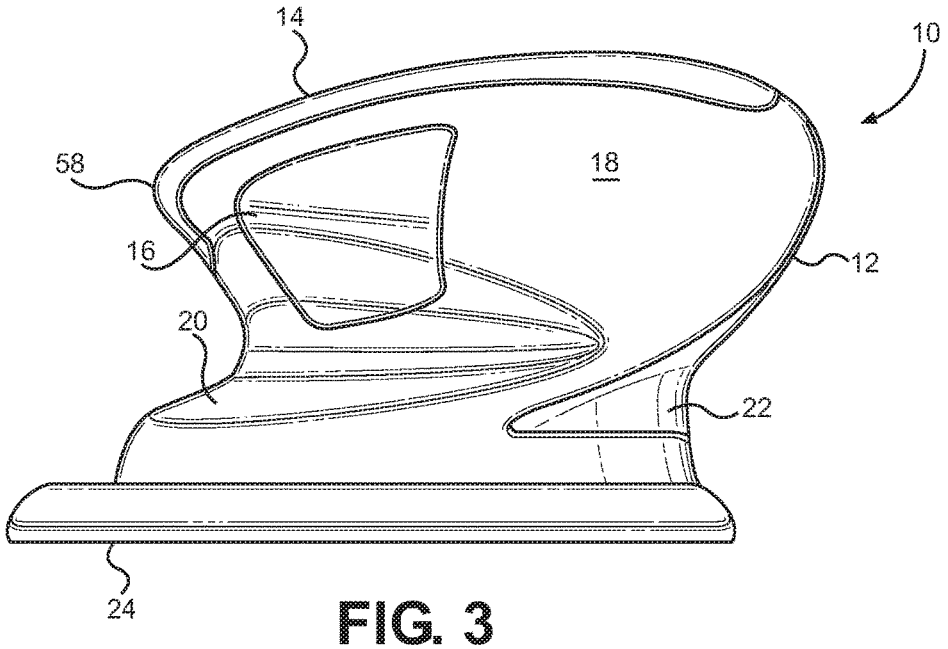
FIG. 3 is a view in side elevation of the motorized tool pursuant to the present invention.
Figure 4:
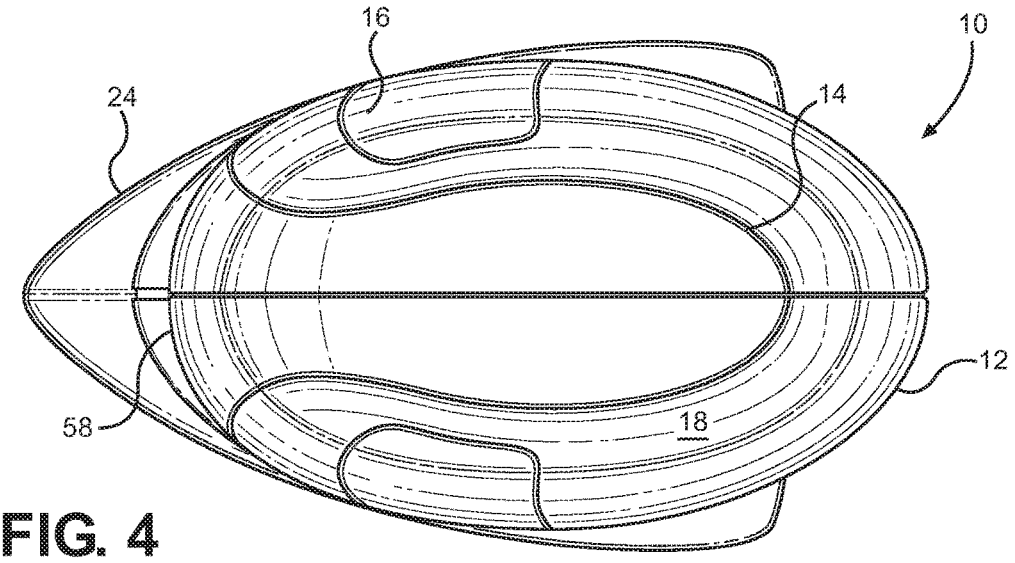
FIG. 4 is a top plan view of the motorized tool of FIG. 1.

Turning more particularly to the drawings, a first embodiment of the motorized tool disclosed herein is indicated generally at 10 in FIGS. 1 and 2. There, the motorized tool 10 is founded on a housing 12. As can be seen with additional reference to FIG. 8, the housing 12 in this embodiment is formed of first and second housing halves 12A and 12B. The housing can be formed, such as by molding or any other method, of a durable material, whether it be plastic, metal, or some other material or combination thereof. In one contemplated embodiment, the housing 12 is formed from injection-molded acrylonitrile butadiene styrene (ABS) plastic with a haircell texture.

As depicted in FIGS. 1 and 2, for example, the housing 12 has a knob-like, bulbous upper portion 18, a broadened base portion 19, and a contoured narrowed portion with a recessed mid-portion 20 therebetween. The upper portion 18 of the housing 12 can be considered to have an anterior portion, which terminates in a tip 58, and a posterior portion. When the tool 10 is disposed in a flat, upright disposition with a surface treatment pad 24 retained relative to the base portion 19 as in FIG. 1, the base portion 19 of the housing 12 projects beyond the tip 58, such as by approximately 1.3 inches in particular embodiments. With that, the tool 10 can be operated without the user's fingers being scraped or crushed against a work surface. Immediately below the tip 58, the housing 12 has the recessed mid-portion 20 to promote gripping by a user. Immediately below the posterior portion of the upper portion 18 of the housing 12 is a charging cradle slot 22, which will be described further hereinbelow. The charging cradle slot 22 is recessed in relation to the posterior portion of the upper portion 18 whereby the upper portion 28 presents a larger, bulbous member as the upper portion 18 in comparison to the narrowed portion presented by the recess 20 in combination with the recessed charging cradle slot 22.

Textured gripping sections 14, 15, and 16 of high friction, vibration absorbing material are retained relative to the housing 12 to permit the motorized tool 10 to be gripped and manipulated most effectively and comfortably. Moreover, the textured gripping sections 14, 15, and 16 ensure positive gripping even when the tool 10 is wet and/or slippery. In one embodiment, the gripping sections 14, 15, and 16 are of low durometer, high friction material, such as textured rubber. The gripping sections 14, 15, and 16 could be disposed and retained in any effective manner within the scope of the invention except as it might expressly be limited.

In the present embodiment, the gripping sections 14, 15, and 16 are overmolded in relation to the housing 12. The central gripping section 14 spans from the top of the upper portion of the housing 12 beyond a midpoint thereof and anteriorly to overlie the anterior portion of the housing 12, including the tip 58. First and second lateral gripping sections 16 are disposed to opposite sides of the bulbous upper portion 18 of the housing 12 and span above and below the broadest portion thereof at their longitudinal position on the housing 12. Finally, the base gripping portions 15 provide affirmative gripping surfaces along the base portion 19 of the housing 12 generally at a mid-portion thereof. Moreover, as described further hereinbelow, the base gripping portions 15 in this embodiment act as release/eject buttons that permit a user to eject or release surface treatment pads 24 automatically for cleaning or replacement.

Figure 5:
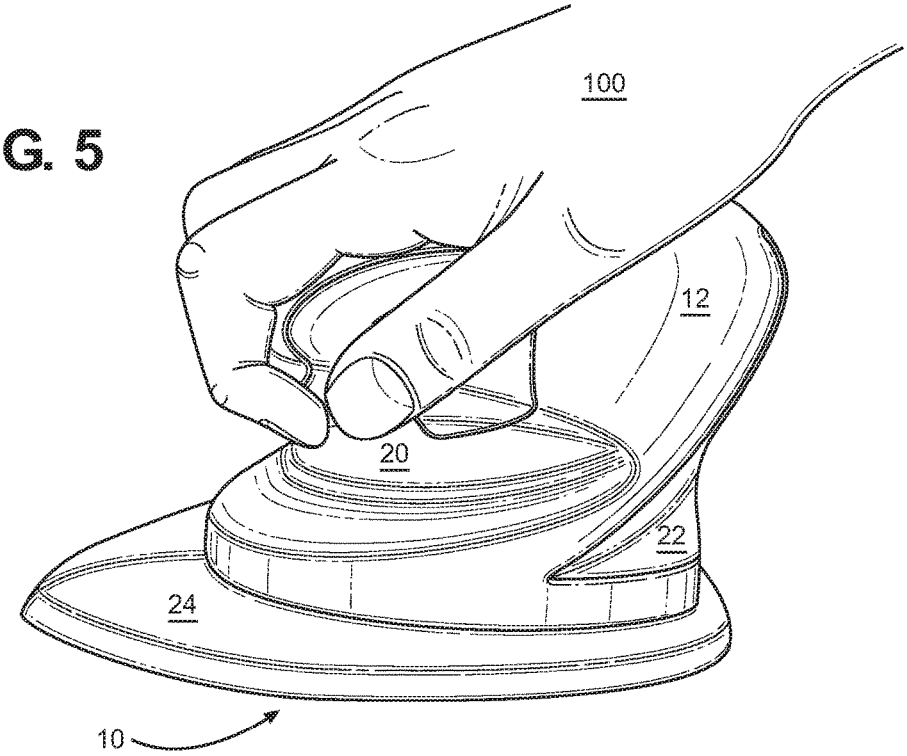
FIG. 5 is a perspective view of a model of the motorized tool disclosed herein being gripped by a user.
Figure 6:
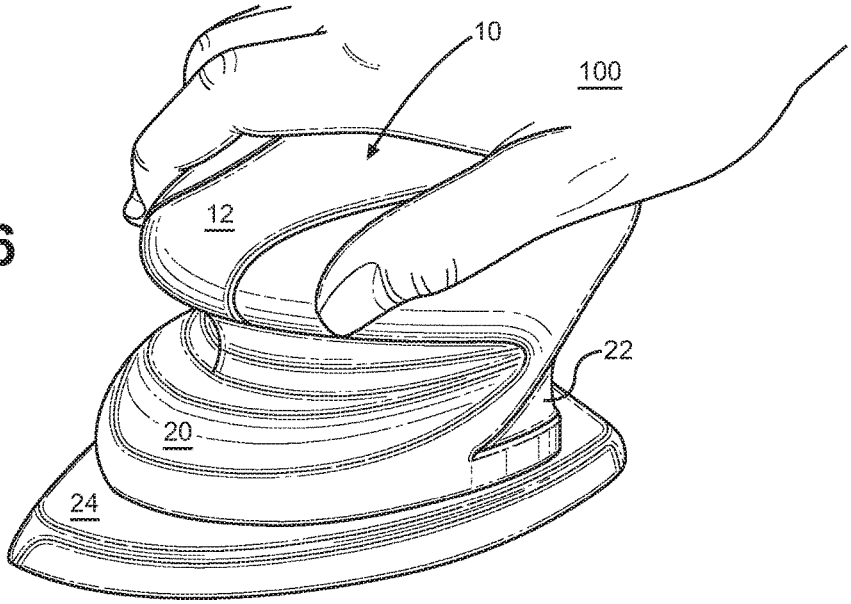
FIG. 6 is a perspective view of the model of the motorized tool disclosed herein being alternatively gripped by a user.

Under this arrangement, the motorized tool 10 can be effectively gripped in an over-handed fashion with the user's hand generally centered in relation to a longitudinal centerline of the tool 10 with the forefingers of the user's hand 100 overlying the tip 58 of the anterior portion of the housing 12 as in FIG. 5. The motorized tool 10 can also be gripped effectively as in FIG. 6 where the thumb of the user's hand 100 engages the left side gripping section 16 and the user's forefinger and potentially subsequent fingers would engage the right side gripping section 16. As constructed, the motorized tool 10 has at least a 15-25 degree zone over which gripping is particularly sound ergonomically.

Figure 7A:
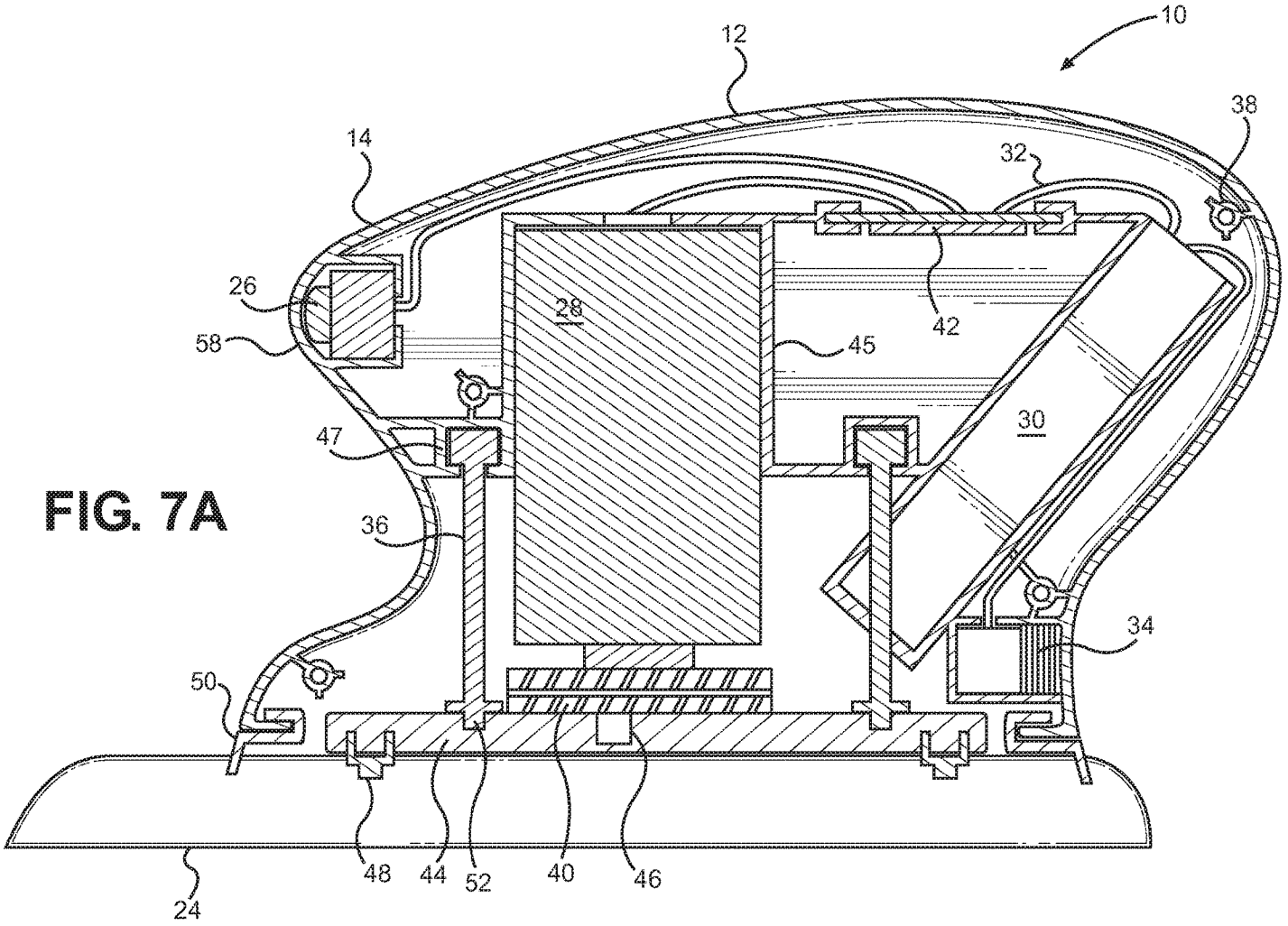
FIG. 7A is a sectioned view in side elevation of a motorized tool according to the invention.
Figure 8A:
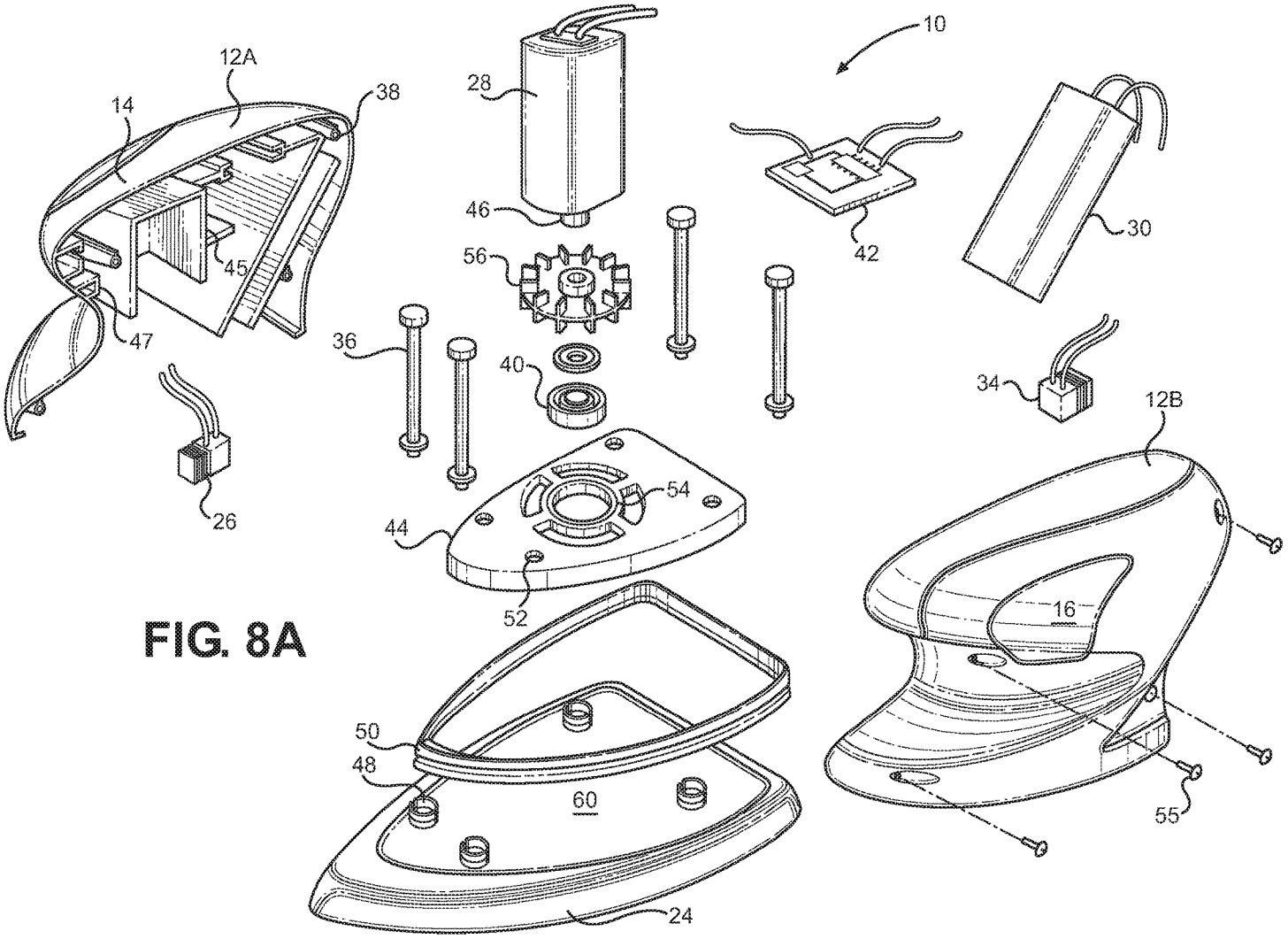
FIG. 8A is an exploded view of the motorized tool of FIG. 7A.

A more detailed understanding of the structure and operation of the motorized tool 10 can be had with further reference to FIGS. 7A and 8A where the tool 10 is shown in cross-sectional and exploded views. There, the tool 10 can be seen to have a motor 28 retained in place by an inner framework 45, which in this example is molded into the housing halves 12A and 12B. The framework 45 additionally retains several other components as described herein. The housing halves 12A and 12B are secured together by a plurality of fasteners 55 received through apertures in the housing half 12B and into threaded bosses 38 in housing half 12A. Of course, the type and power of the motor 28 can vary depending on, among other things, the application and manufacturing costs. In certain embodiments, for example, the motor 28 can be a 12 Volt, brushed DC motor. Alternatively embodiments of the tool 10 may instead employ a brushless motor 28.

The motor 28 is powered by one or more power supplies comprising batteries 30, which again can vary in type and size, through electrical wiring 32. The battery 30, which could be fixed in place or removable and replaceable, is retained in a battery housing 35. The battery 30 could take the form of a lithium polymer battery and will preferably be rechargeable with the inclusion of a recharge induction coil 34. The battery 30 could have a range of power depending on, for instance, the application and cost considerations. Without limitation, batteries 30 of 7.4 to 11.1, 14.8, 15.6-18, and 18.5, or other voltages or voltage ranges may be employed. An overcharge cutoff circuit can be included in the circuit board 42, which can be interposed within the electrical system for preventing damage due to overcharging and overloads. Embodiments of the invention could alternatively or additionally be powered by alternating current, such as through an electrical cord plugged into a power source.

Operation of the motor 28 can be actuated by a switch 26, which in the present embodiment is embedded in the tip 58 of the central gripping section 14. As seen in FIGS. 7A and 8A, the switch 26 can be a depression switch. Alternatively, the switch 26 could be a toggle switch or any other effective type of switch. The motor 28 has an eccentric output rod 46 that is received through a cast alloy flywheel 56 and into a sealed roller bearing 40. The roller bearing 40 in turn is received into a correspondingly shaped aperture 54 in a base plate 44.

Figure 10A:
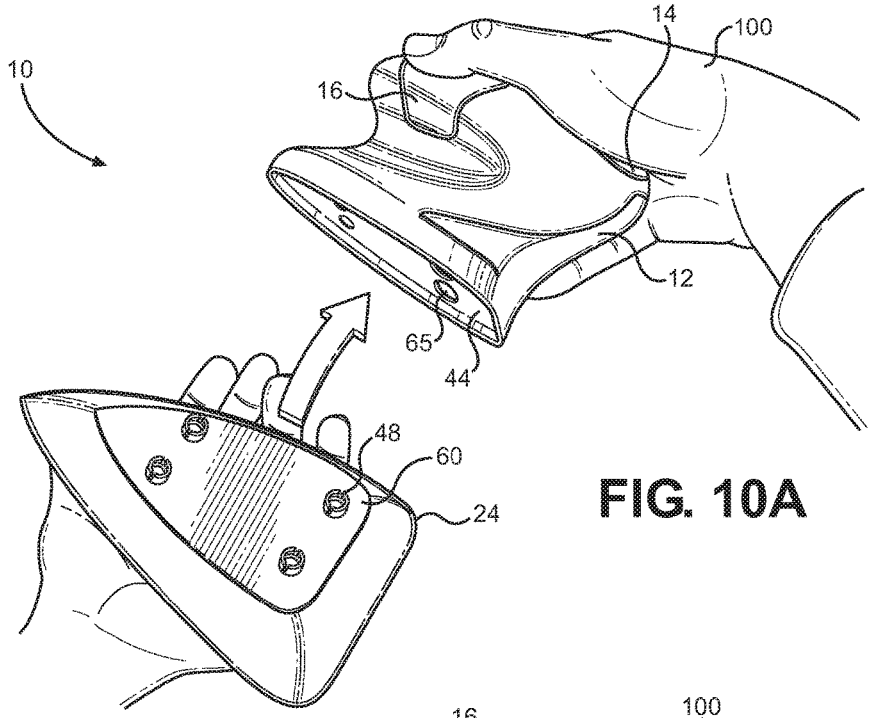
FIG. 10A is a perspective view of a motorized tool with the surface treatment pad about to be snapped into place relative to the housing.

As will be described further hereinbelow, surface treatment material in the form of a surface treatment pad 24 is removably and replaceably coupled to the base plate 44. A wide variety of coupling mechanisms are possible and within the scope of the invention. In the embodiment of FIG. 10A, the coupling is by a snap-fit engagement between four resilient, annular engaging protuberances or buttons 48 on the dorsal surface of a base platform 60 of the surface treatment pad 24 in combination with four correspondingly sized and located apertures 65 or indentations in the base plate 44.

Surface treatment pads 24 can thus be selectively removed and replaced, such as when the surface treatment material is worn or when a different application is desired. In the present embodiment, removal and replacement of the surface treatment pad 24 can be carried out by a simple snapping or unsnapping of the pad 24 into or out of engagement with the base plate 44 as suggested by FIG. 10A. It should be noted that the base platforms 60 and the surface treatment pads 24 could be disengaged from the base plate 44 either manually, automatically, or by some combination thereof.

Figure 10B:
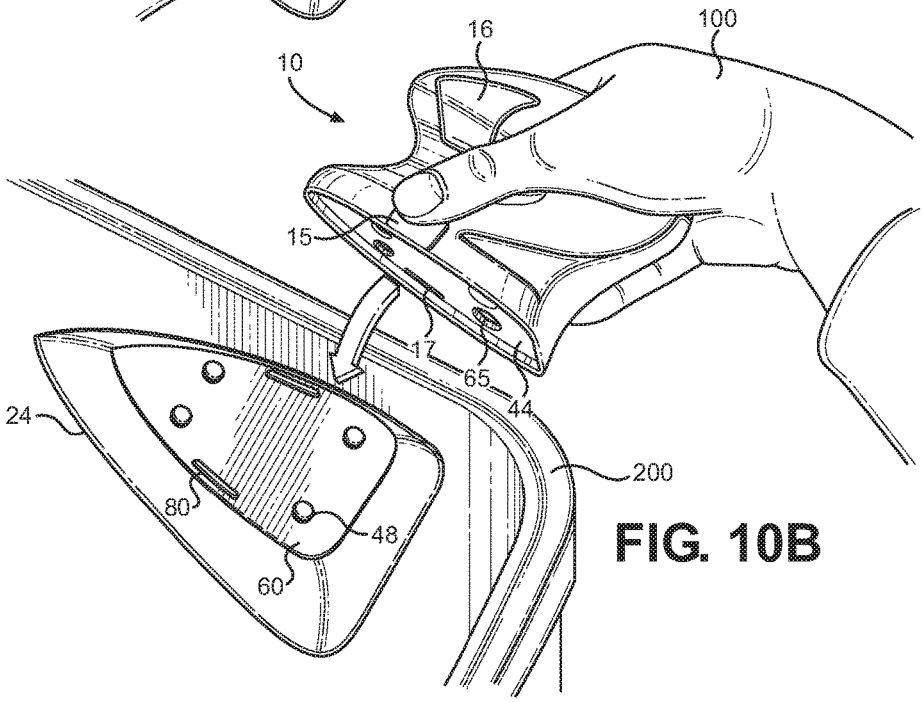
FIG. 10B is a perspective view of the motorized tool ejecting the surface treatment pad into a waste receptacle.

In the embodiment of FIG. 10B, the motorized tool 10 permits selective ejection of surface treatment pads 24. There, the base platform 60 of the surface treatment pad 24 again has four protuberances 48 that act to stabilize the surface treatment pads 24 and that project dorsally therefrom for being received into correspondingly spaced apertures or indentations 65 in the base plate 44. Here, however, the protuberances 48 are merely received into the indentations 65 for registering the location and orientation of the surface treatment pad 24 relative to the base plate 44. The surface treatment pad 24 is selectively fixed relative to the base plate 44 by a mating engagement between engaging tabs 80 that project dorsally from the lateral edges of the base platform 60 with locking slots 17 disposed in or outboard of the base plate 44. Each locking slot 17 includes a ridge or other locking mechanism for selectively fixing the engaging tabs 80 and thus the surface treatment pad 24 in place. The engaging tabs 80 and the surface treatment pad 24 can be released by a pressing of the release buttons of the gripping portions 15.

Figure 17A:
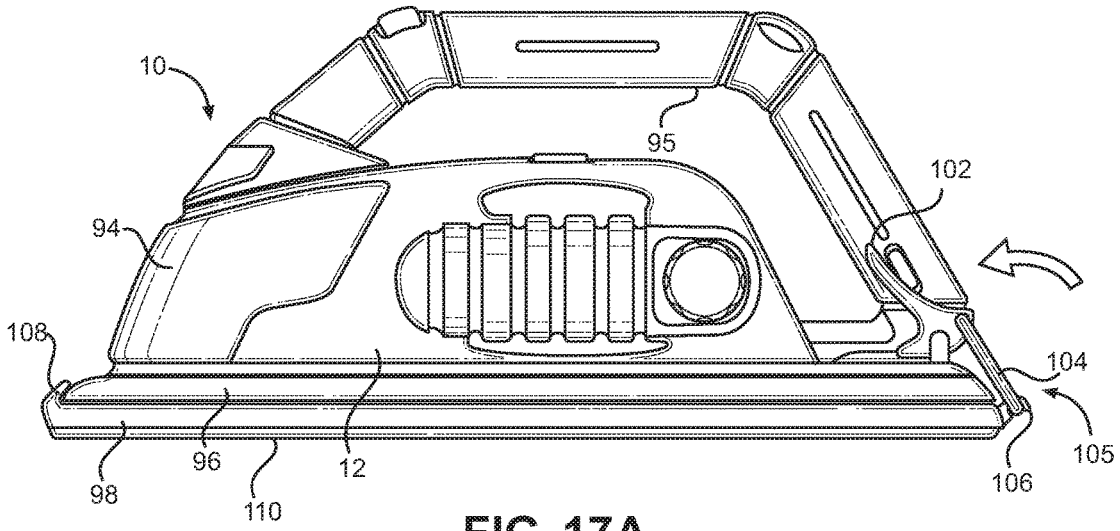
FIG. 17A is a view in side elevation of an alternative motorized tool with a pad latching system with the pad latched.
Figure 17B:
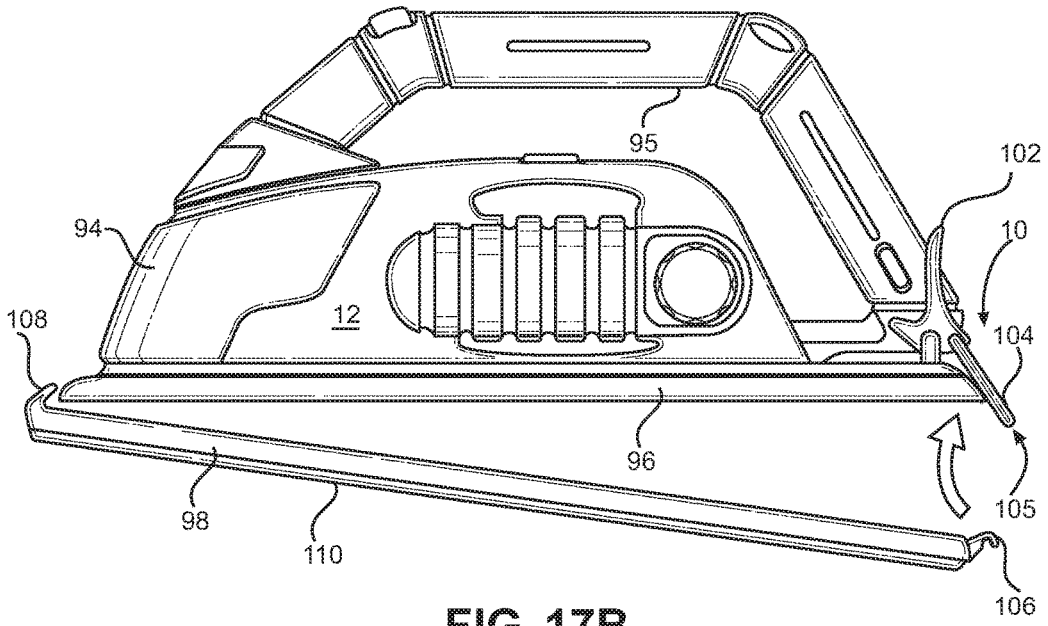
FIG. 17B is a view in side elevation of the motorized tool of FIG. 17A with the pad in the process of being latched.
Figure 17C:
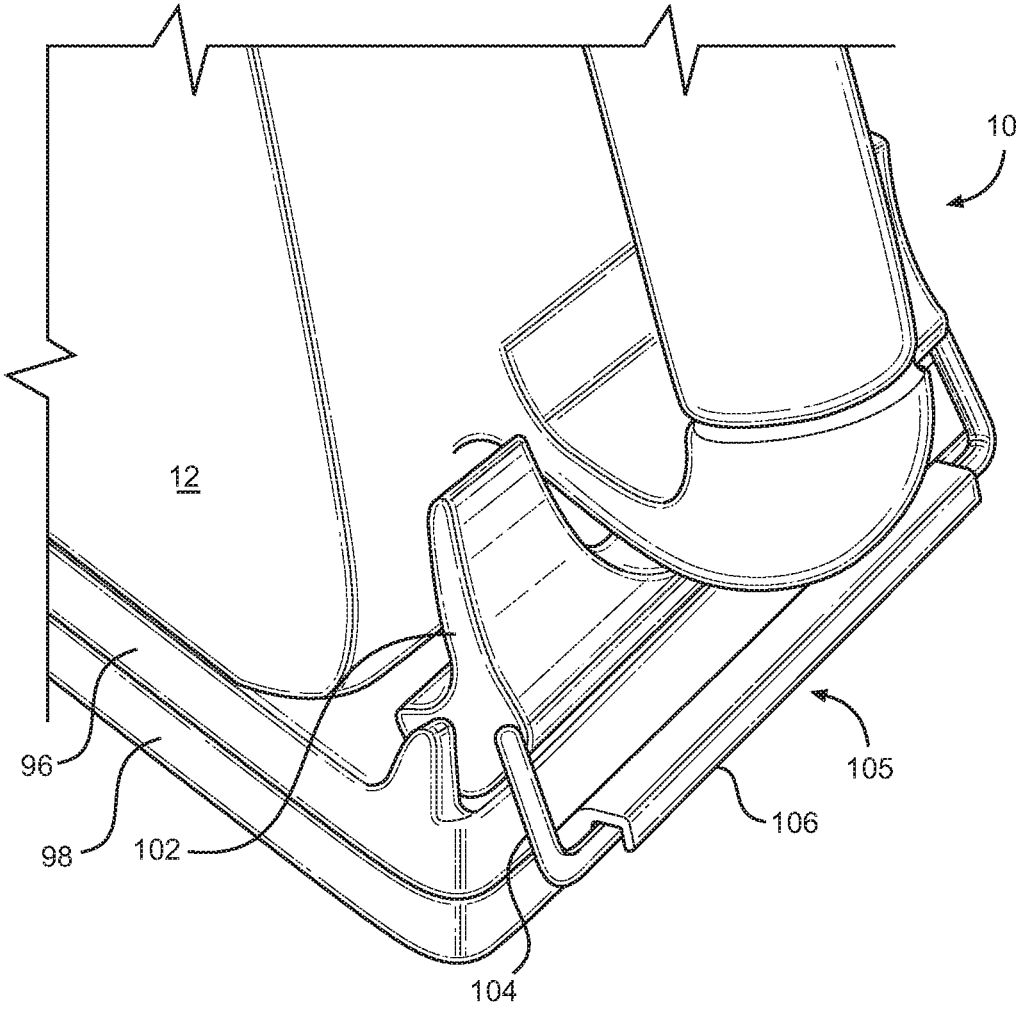
FIG. 17C is a perspective view a portion of the motorized tool of FIG. 17A with the pad fully latched.

A further mechanism for retaining removably retaining surface treatment pads is illustrated in FIGS. 17A through 17C. There, the motorized tool 10 is again founded on a housing 12. Here, the housing 12 removably and replaceably receives a water resistant battery pack 94 in relation to a receiving opening as is shown and described further hereinbelow. In the depicted embodiment, the depicted receiving opening is disposed in an anterior portion of the housing 12, but it will be understood that it could alternatively be disposed in a lateral, posterior, or other portion of the housing 12. Moreover, the motorized tool 10 has a handle structure 95 with an anterior end fixed to an anterior portion of the housing 12, a posterior end fixed to a posterior portion of the housing 12, and a body portion that traverses from the anterior end to the posterior end spaced from the housing 12. In the illustrated embodiment, the posterior end of the handle structure 95 is fixed to a posterior portion of the housing 12. A base plate 96, which can be rigid, is retained to vibrate, oscillate, or otherwise move in relation to the housing 12 when the motorized tool 10 is actuated.

The base plate 96 has end tips, which can be formed by the anterior and posterior ends of the base plate 96. The tips taper to achieve wedge shapes. A latching system 105 is retained by the posterior portion of the base plate 96. The latching system 105 has a latching lever 102 that is pivotally retained by the base plate 96 to pivot about a pivot axis. An over-center draw latch or link 104 is pivotally retained by the latching lever 102 at a position posteriorly displaced from the pivot axis. With this, an anterior pivoting of the latching lever 102 will tend to pull the link 104 anteriorly and toward the base plate 96.

As FIG. 17C illustrates perhaps most clearly, the lever 102 in the depicted embodiment is U-shaped about the centerline of the tool 10 so that a first leg is disposed to a first side of the posterior end of the handle 95, a second leg is disposed to a second side of the posterior end of the handle 95, and the base of the U-shape is disposed below the posterior end of the handle 95. With that, the lever 102 is protected against inadvertent catching and pivoting.

A shoe 98, which can generally mirror the plate 96 in shape and which can be rigid, has a first, anterior end with an upturned hook structure 108 and a second, posterior end with a downwardly facing hook structure 106. In each instance, the hook structure 106 and 108 can vary in shape, width, and other characteristics depending on, for instance, the shape of the latch 104 and the shape of the tip of the plate 96. The shoe 98 has a first face for being disposed facing the plate 96 and a second face for facing outwardly. Surface treatment material 110, which can be of any type depending on the surface to be treated, the goals of the user, and other factors, is fixed to the second face of the shoe 98. By way of example and not limitation, the surface treatment material 110 could be a soft material for buffing and polishing, an abrasive material for scrubbing, or substantially any other material for any purpose that may be sought to be accomplished by the tool 10. The surface treatment material 110 could be secured to the shoe 98 in any effective manner, including by adhesive, hook and loop material, or any other material or combination thereof.

Under this construction, the shoe 98 and surface treatment material 110 retained relative thereto can be readily removed and replaced relative to the plate 96 and the remainder of the tool 10 in general. More particularly, with further reference to FIGS. 17A through 17C, a shoe 98 as disclosed herein could be applied to the plate 96 simply by hooking the hook 108 over the anterior end of the plate 96, hooking the latch 104 over the hook 106 at the posterior end of the shoe 98, and pivoting the lever 102 anteriorly. With that, the shoe 98 will be drawn into close contact with the plate 96, and the surface treatment material 110 can be used for its intended purpose.

When desired, such as when a given surface treatment material 110 is spent or when a different surface treatment material 110 is to be used, the lever 102 can be pivoted posteriorly thereby to release the hook 106 and the shoe 98 in general. With that, new surface treatment material 110 can be readily applied, and different surface treatment material 110 can be quickly substituted. Notably, with the entire latching system 105 and the shoe 98 retained by the base plate 96, no vibrating portion of the latching system 105 or the shoe 98 makes contact with the main housing 12 except through actuation mechanism of the base plate 96, which can be as shown and described herein.

Within the scope of the invention, surface treatment material could be retained relative to the motorized tool 10 by other methods, which might be used alone or in combination with one or more of the other structures disclosed herein, including the base plate 96 and shoe 98 system described hereinabove or any other structure. Looking to FIGS. 18A through 18D, for example, a sleeved surface treatment system is illustrated. There, a sleeve 112 is disclosed with a first side or panel 114 for facing outwardly and a second side or panel 116 for facing the main housing 12. The first and second sides 114 and 116 have arcuate lateral edges and are joined along the lateral edges thereof, such as by integral formation, adhesive, sewing, or any other method, to define a boat shape with an inner volume. The sleeve 112 in the depicted embodiment additionally includes a closure 118 for selectively joining the posterior portions of the first and second panels 114 and 116 generally to close the inner volume. The closure 118 could be of any effective type, including, by way of example, adhesive or a mechanical fastening system, such as a zipper closure as is common to storage bags, a hook and loop combination, or any other operable mechanical fastening system. The first side 114 can comprise or retain surface treatment material of any type, such as polishing, abrading, or other surface treatment material. Embodiments are contemplated wherein the first side 114 is formed by a fabric or other durable material with surface treatment material retained relative thereto. The second side 116 could comprise a thin, flexible material, such as a plastic film or other material. For instance, the second side 116 could be formed from a thin polyethylene material or any other suitable material.

Figure 18A:
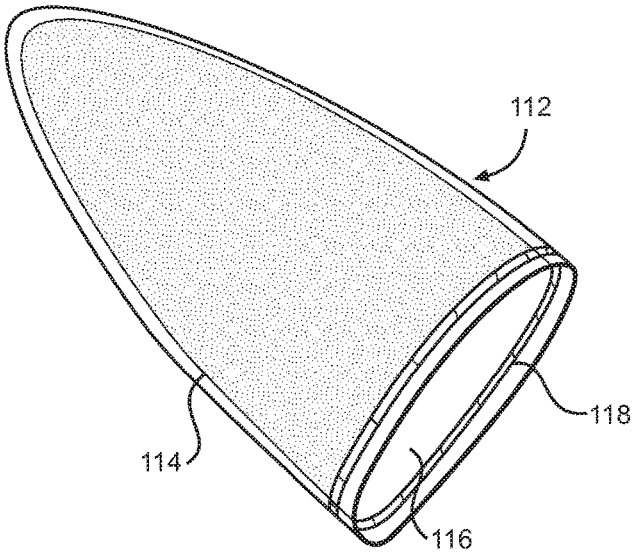
FIG. 18A is a perspective view of a sleeve of a sleeved surface treatment system according to the invention.
Figure 18B:
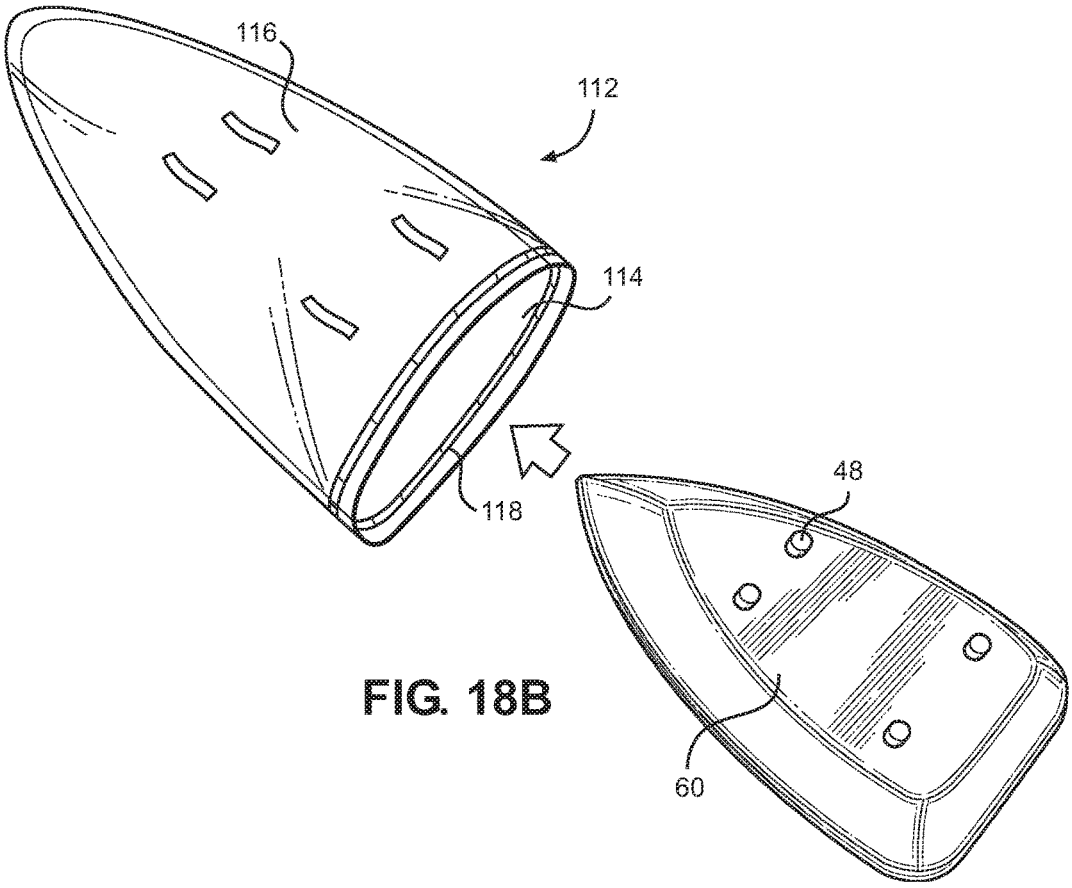
FIG. 18B is a perspective view of the sleeved surface treatment system of FIG. 18A with the sleeve prepared for receiving a base platform.
Figure 18C:
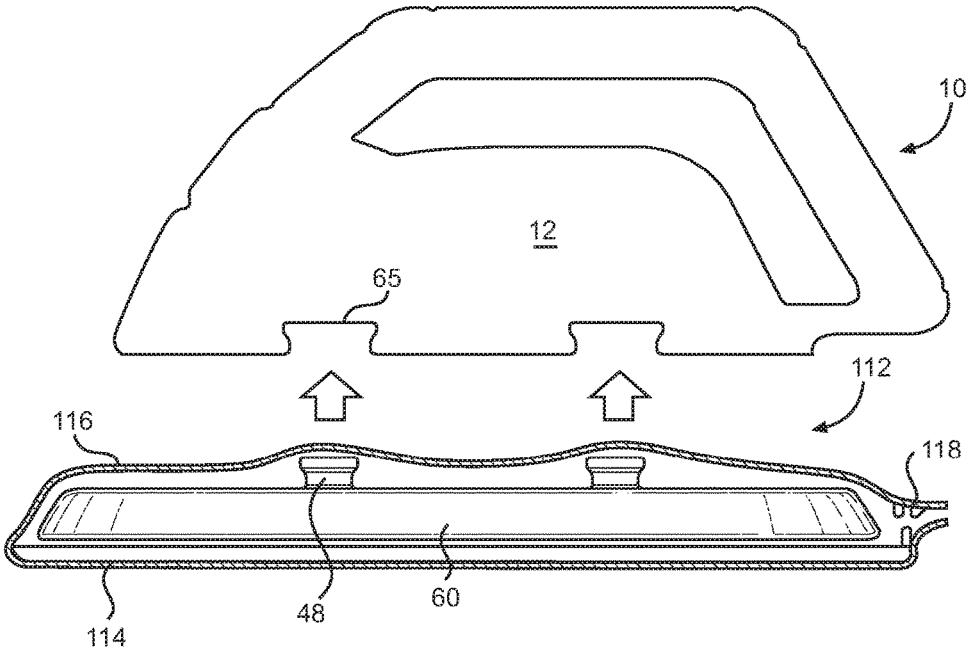
FIG. 18C is a view in side elevation of the sleeved surface treatment system with the platform received by the sleeve and the sleeve and platform prepared for engaging the housing of the tool.
Figure 18D:
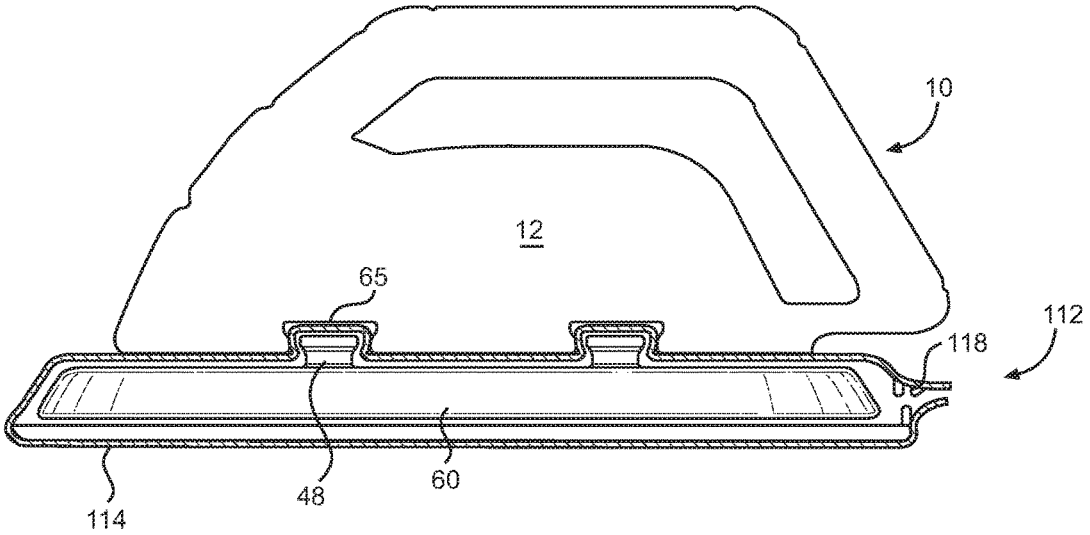
FIG. 18D is a view in side elevation of the sleeved surface treatment system with the platform received by the sleeve and the sleeve and platform engaged with the housing of the tool.

As is illustrated in FIGS. 18B through 18D, the sleeve 112 can in practice selectively receive a base platform 60. The base platform 60 can be removably and replaceably engaged directly or indirectly with the main housing 12 in any effective manner. In the present embodiment, for example, the base platform 60 can have a plurality of snap bosses 48 that project therefrom for being engaged, such as in a snap-fit engagement with a plurality of correspondingly disposed and shaped apertures 65 in the base platform 12. As FIG. 18B illustrates, the second side 116 of the sleeve 112 could have a plurality of openings therein through which the snap bosses 48 could be caused to project partially or completely.

Under this construction, surface treatment material retained by the sleeve 112 can be readily applied to the main housing 12, such as by an insertion of the base platform 60 into the inner volume of the sleeve 112 and then an application of the base platform 60 and the sleeve 112 to the main housing 12, such as by a pressing of the snap bosses 48 into the apertures 65. Again, other retention mechanisms for such sleeves 112 are readily possible and within the scope of the invention except as it might be expressly limited by the claims. When surface treatment material is worn or otherwise to be replaced, the base platform 60 can be separated from the main housing 12, the sleeve 112 can be removed from the base platform 60, and a new or different sleeve 112 can be applied.

Figure 19A:
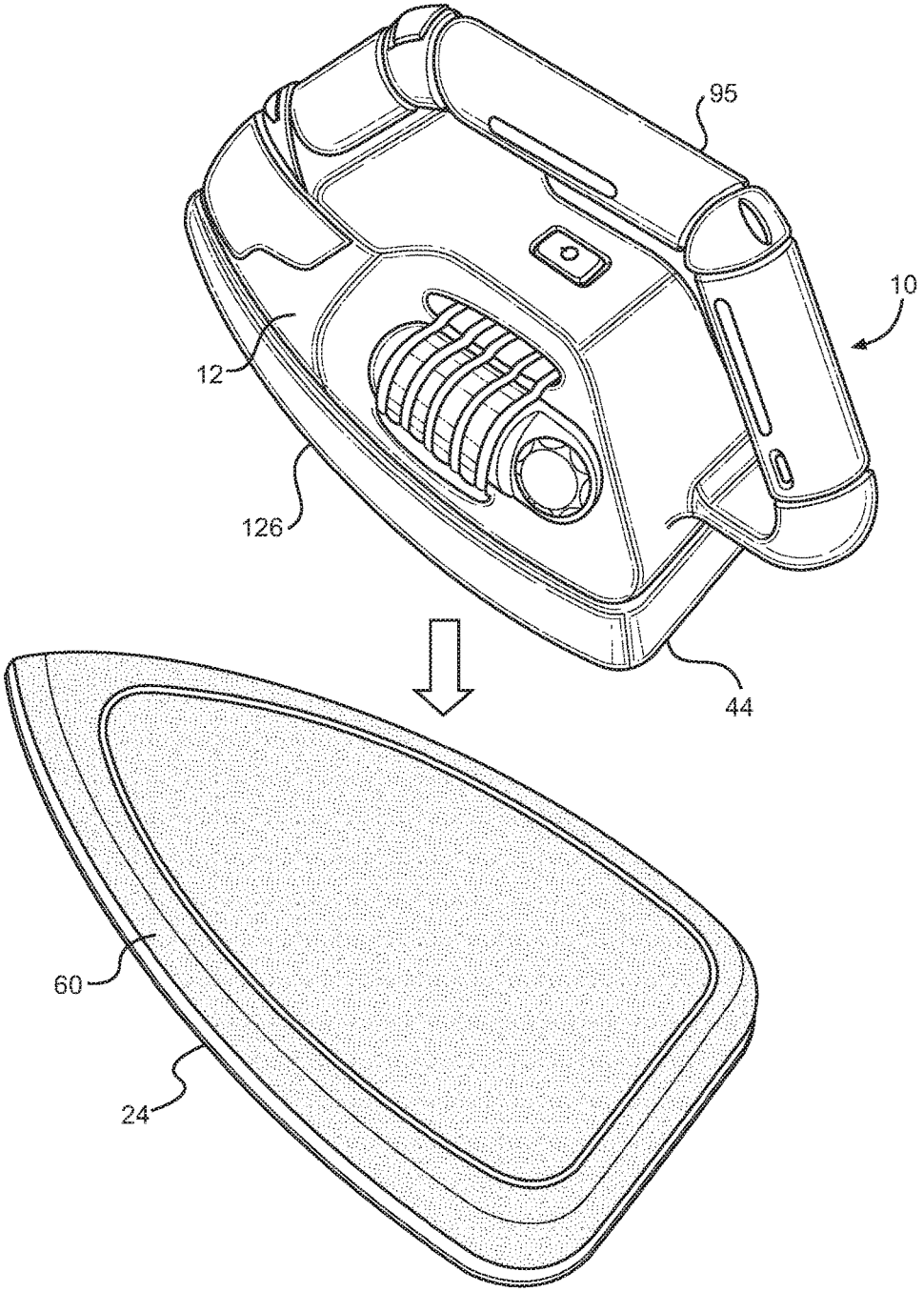
FIG. 19A is a perspective view of a hook and loop retention system for a surface treatment pad with the pad and base platform prepared for engaging the housing of the tool.
Figure 19B:
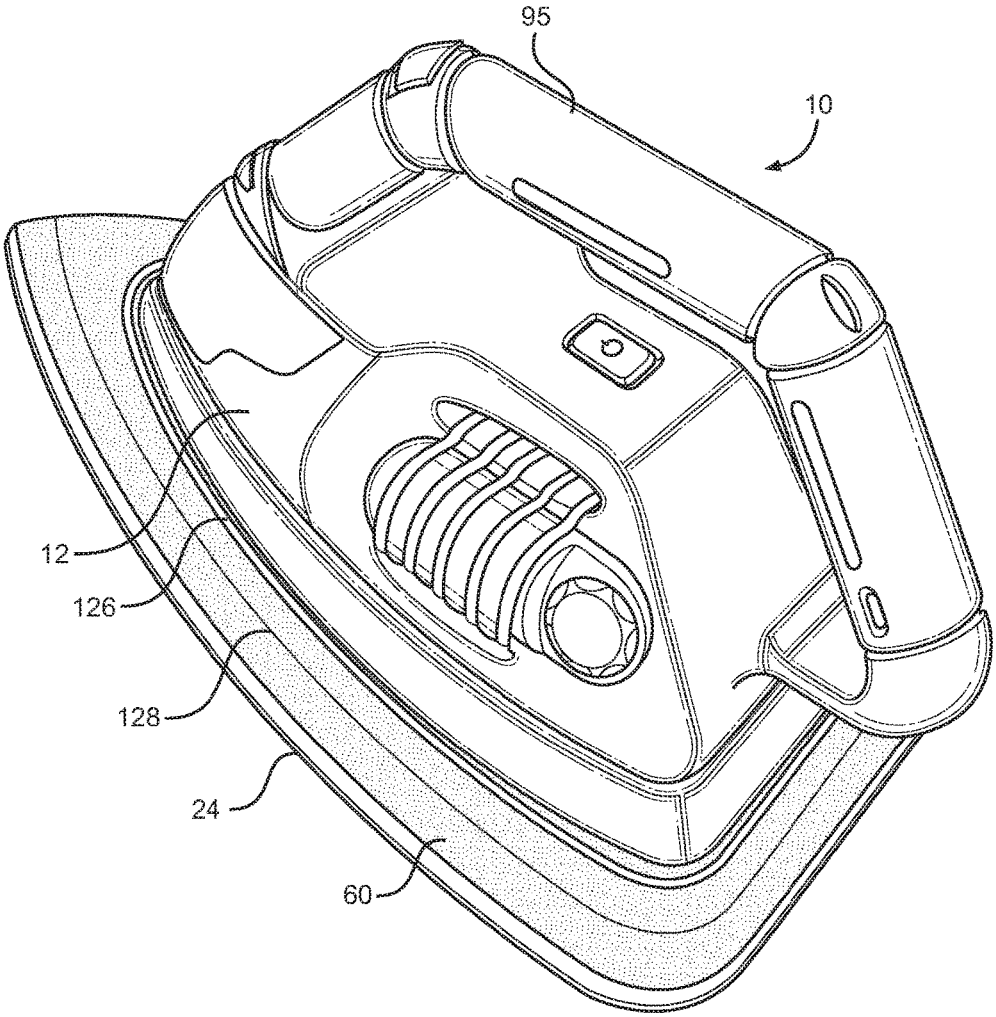
FIG. 19B is a perspective view of the hook and loop retention system with the pad and base platform engaged with the housing of the tool.

In still other embodiments, as FIGS. 19A and 19B depict, surface treatment material, such as surface treatment material in the form of a surface treatment pad 24 with a base platform 60, can be selectively retained relative to the motorized tool 10 by a releasable fastening mechanism, such as hook and loop material. In FIGS. 19A and 19B, for instance, the base platform 60 can be removably and replaceably coupled to the base plate 44 by hook or loop material 128 applied to a proximal surface of the base platform 60 in combination with loop or hook material 126 retained relative to a distal surface of the base plate 44. Manifestations of the invention are contemplated, for instance, wherein hook material 126 is retained relative to the base plate 44 and loop material 128 is retained relative to the base platform 60. The hook material 126 could, for example, be formed from a polypropylene or other plastic material to give water resistance and an ability to be washed. With that, surface treatment material can be readily removed and replaced relative to the motorized tool 10 by a selective application or removal of the base platform 60 relative to the base plate 44.

As FIG. 19A illustrates, a guide marking, such as a partial or complete outline of the peripheral shape of the base plate 44, can be applied to the proximal surface of the base platform 60. When applied to the base plate 44, the base platform 60 can, for instance, extend peripherally beyond the edge of the base plate 44, such as by approximately one-quarter inch over the entire edge except over the anterior portion of the base platform 60 over which the base platform 60 may extend further, such as by approximately one-half to three-quarters of an inch. Where the base platform 60 is of a pliable or semi-pliable material, such as foam, sponge, or the like, the greater extension of the anterior portion of the base platform 60 can permit greater adaption to corners and other contoured locations while minimizing or eliminating direct contact between components of the motorized tool 10 other than the vibrating base platform 60 and a targeted surface.

Figure 25:
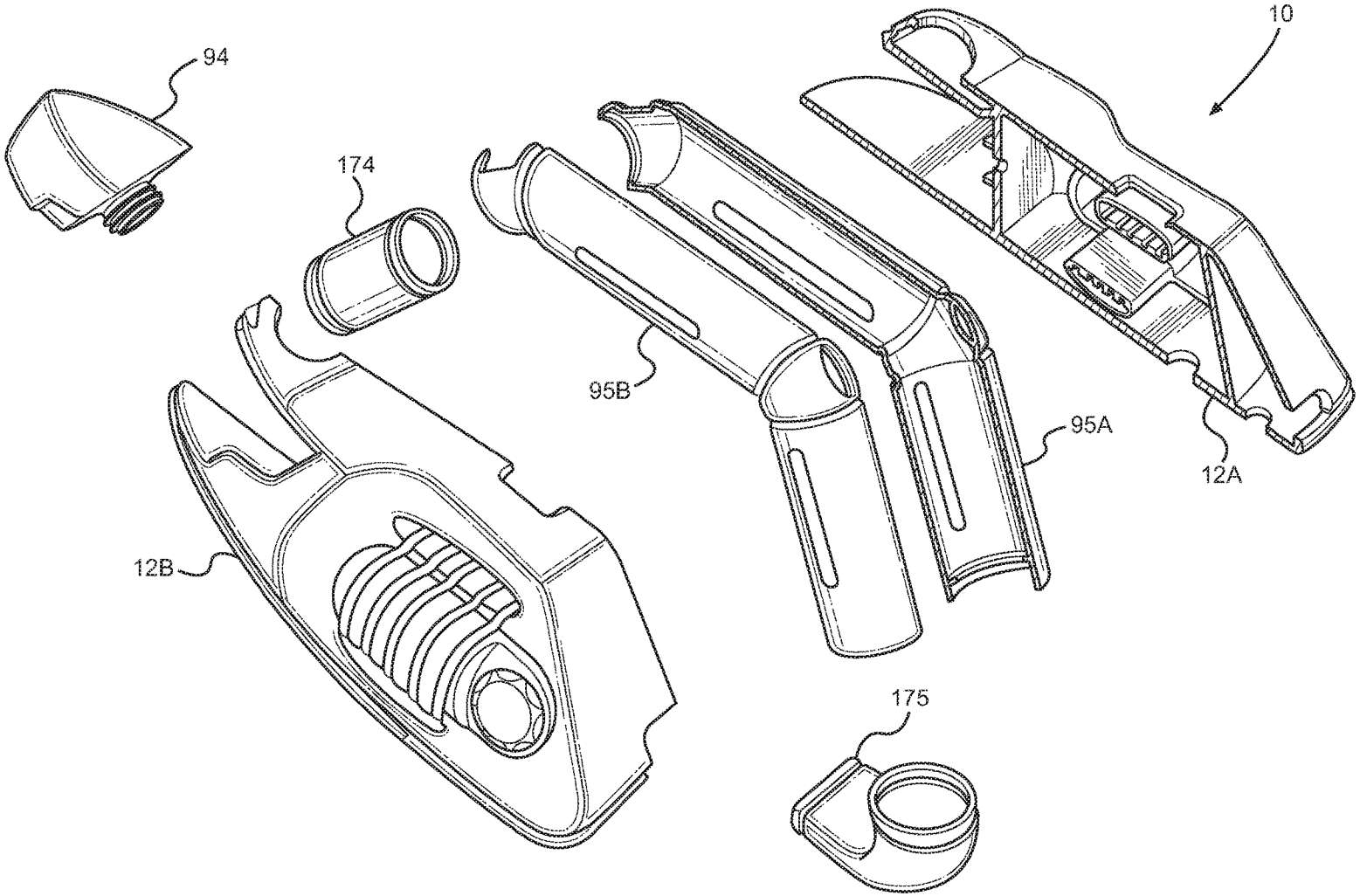
FIG. 25 is an exploded perspective view of a motorized tool according to the invention with vibration absorbing handle sections.

With reference to FIG. 25, for instance, the motorized tool 10 can incorporate vibration damping characteristics external to the housing 12. There, the handle structure 95 has an anterior end fixed to an anterior portion of the housing 12, a posterior end fixed to a posterior portion of the housing 12, and a body portion that traverses from the anterior end to the posterior end spaced from the housing 12. Vibration imparted to the body portion of the handle 95 is absorbed by an anterior vibration absorbing section 174 interposed between an anterior portion of the handle 95 and the housing 12 and a posterior vibration absorbing section 175 interposed between a posterior portion of the handle 95 and the housing 12. The handle mounting sections 174 and 175 could be formed of any effective vibration damping material. In one contemplated embodiment, the handle mounting sections 174 and 175 can incorporate or be formed from a neoprene or other rubber material. For example, the sections 174 and 175 could be founded on injection molded polypropylene, potentially with glass filled hollow shapes, with an overmolded neoprene or other rubber material in a thickness of, for example, ⅛ inch or greater. With that, a strong inner core can be provided without brittleness while the rubber casing will provide vibration absorption during operation of the motorized tool 10.

Figure 24A:
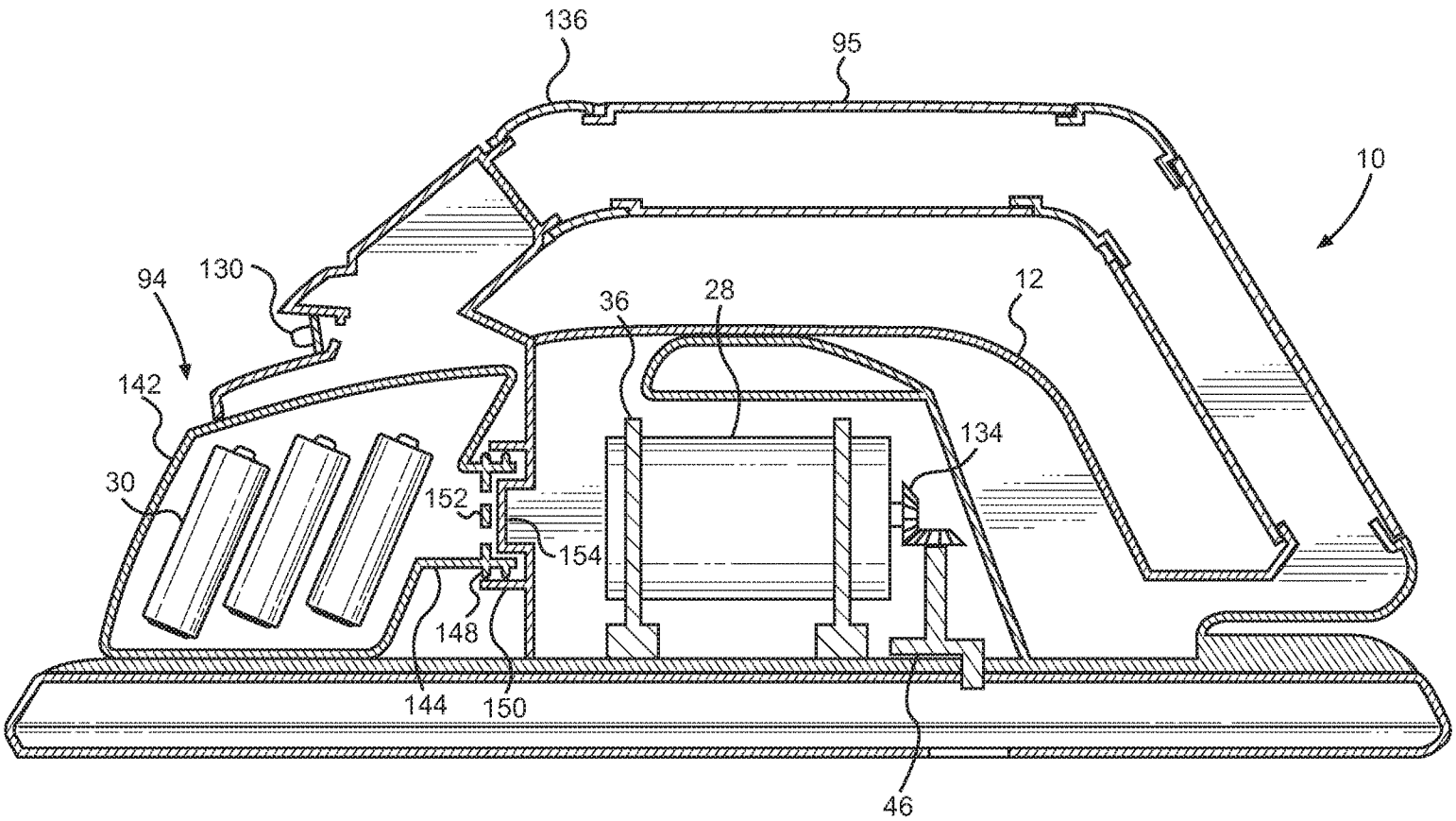
FIG. 24A is a cross-sectional view of an embodiment of the motorized tool with a water resistant battery system and a lighting system.
Figure 24B:
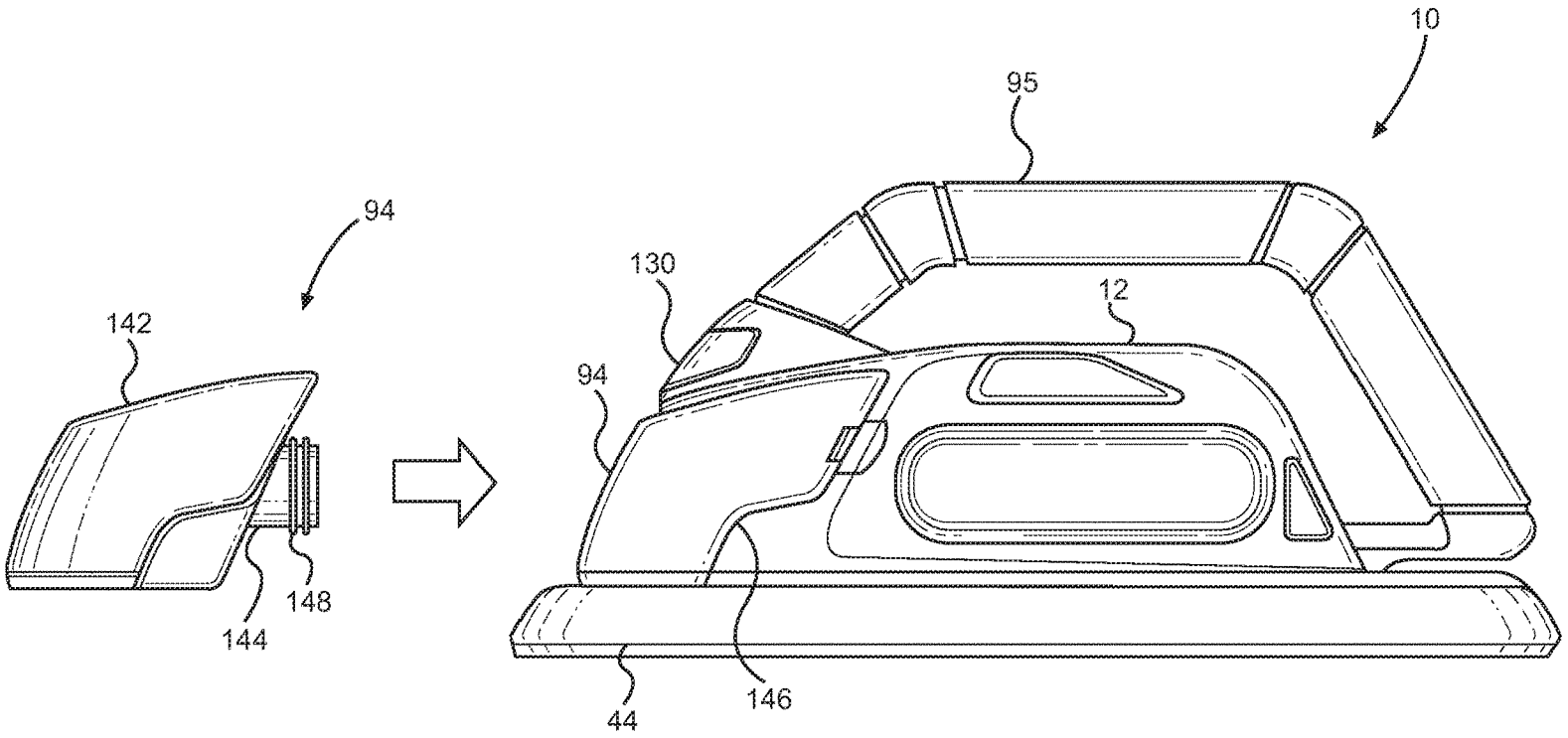
FIG. 24B is a view in side elevation of the motorized tool of FIG. 24A with the water resistant battery compartment detached and in situ.
Figure 24C:
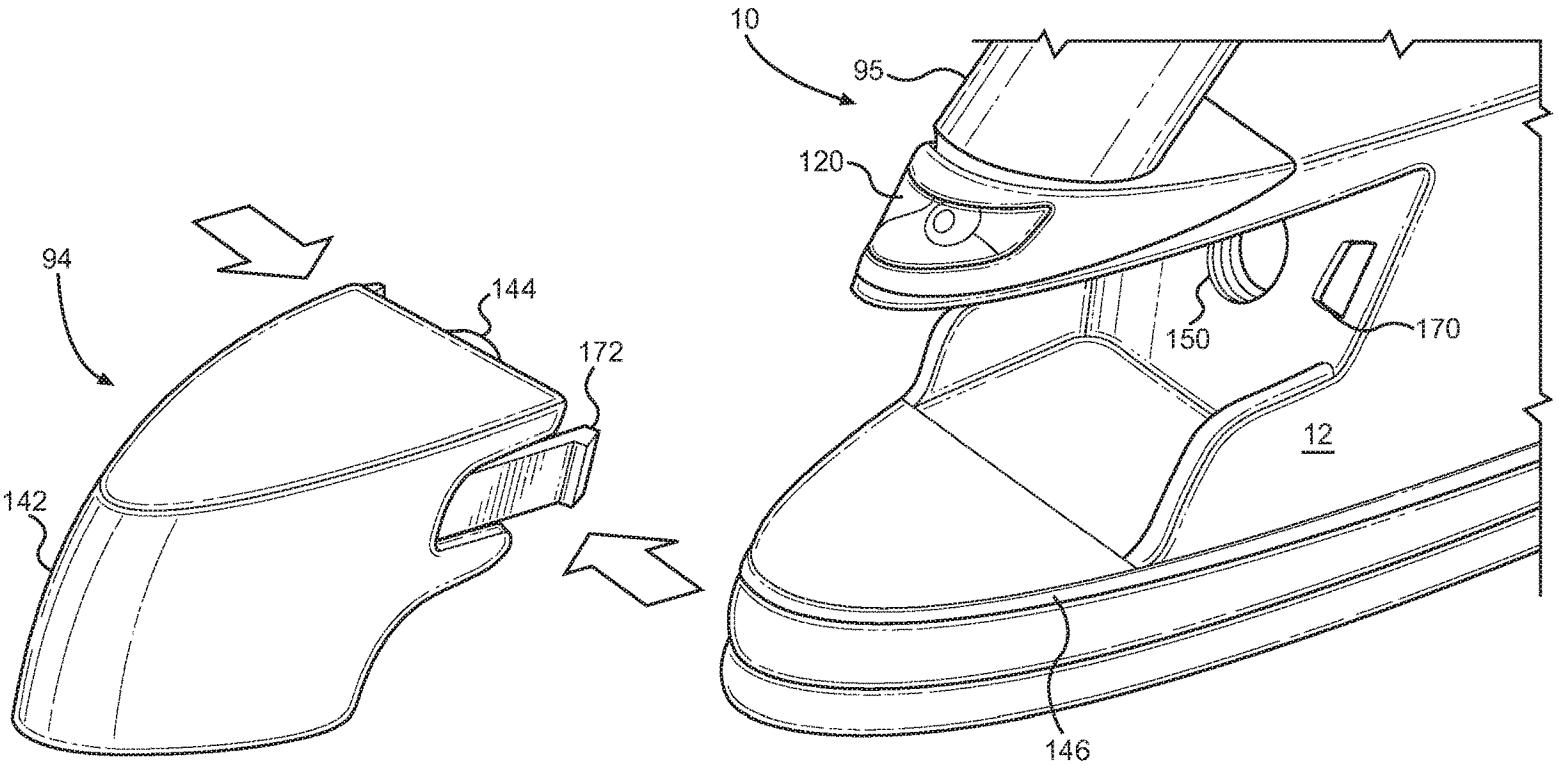
FIG. 24C is a perspective view of a motorized tool according to the invention with a water resistant battery compartment detached from the housing.
Figure 24D:
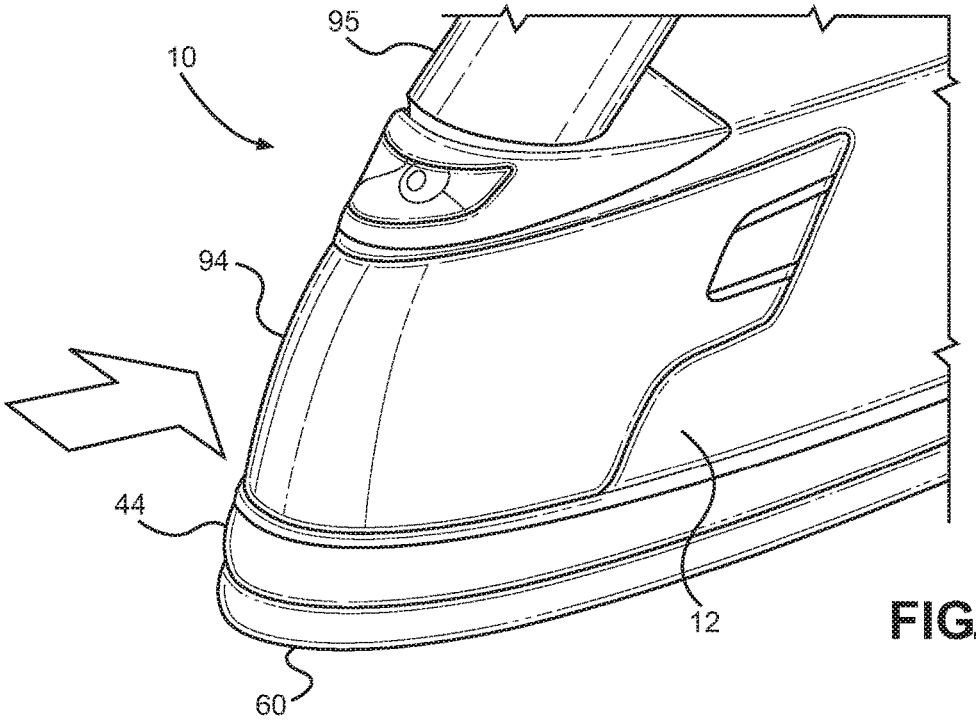
FIG. 24D is a perspective view of the motorized tool of FIG. 24C with the water resistant battery compartment attached to the housing.
Figure 24E:
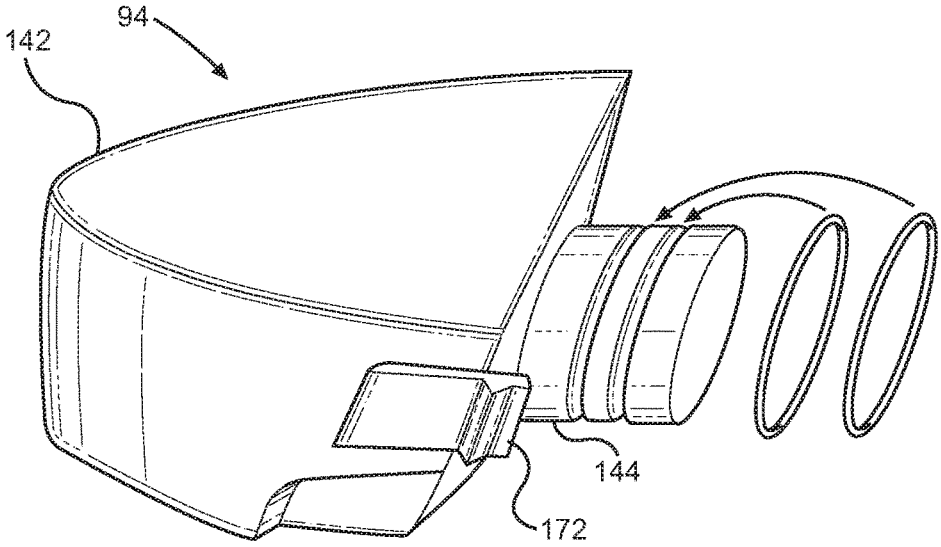
FIG. 24E is a partially exploded perspective view of the water resistant battery compartment.

As noted above and with additional reference to FIGS. 24A through 24D, the housing 12 can removably and replaceably receive a water resistant battery pack 94, such as in relation to an receiving opening 146. Again, in the depicted motorized tool 10, the receiving opening 146 is disposed in an anterior portion of the housing 12, but it will be understood that it could alternatively be disposed in a lateral, posterior, or other portion of the housing 12 within the scope of the invention except as the claims may be expressly limited. When the battery pack 94 is inserted into the housing 12, the housing 12 and the battery pack 94 define a substantially continuous surface with the battery pack 94 effectively forming a portion of the anterior end of the housing 12. The battery pack 94 is founded on a watertight chamber 142 that is complimentarily shaped and sized to fit snugly within the receiving opening 146. A tubular projection 144 extends along a longitudinal centerline from the watertight chamber 142, and the receiving opening 146 has a correspondingly sized and located annular socket 150 for receiving the tubular projection 144 in a mating engagement. A plurality of battery cells 30 are disposed within the battery back 94, and electrical contacts 154 concentrically disposed on the tip of the tubular projection 144 are in electrical communication with the battery cells 30. Electrical contacts 154 are correspondingly disposed within the socket 150, and those electrical contacts 154 are in electrical communication with the motor 28 and the remaining electrical components of the motorized tool 10. One or a plurality of seals 144, in this case a plurality of O-rings 144, are sized to engage the tubular socket 150 in a tight frictional engagement. The seals 144 in this embodiment are disposed to encircle the projection 144 in a longitudinally spaced array. So constructed, the battery back 94 can be selectively engaged with the housing 12 and the motorized tool 10 in general with a watertight connection being established by the watertight engagement between the tubular projection 144 and the socket 150.

Where necessary or desirable, a latching system can be provided for securing the battery pack 94 in place relative to the housing 12. For instance, looking to FIGS. 24C through 24E, first and second resilient legs 172 could project generally longitudinally from the chamber 142, and receiving apertures 170 could be correspondingly located within the receiving opening 146 of the housing 12. The legs 172 have teeth for locking the legs 172 and the battery pack 94 in place relative to the receiving apertures 170 and the housing 12. When the battery pack 94 is to be removed, such as for recharging, the legs 172 can be readily depressed to permit disengagement from the receiving apertures 170.

Embodiments of the motorized tool 10 can additionally incorporate a light 130, which could be selectively activated by the user or automatically activated during operation of the motorized tool 10. The light 130 is shown in an exploded view and in place relative to the remainder of the motorized tool 10 in FIG. 23. There, one can perceive that the light 130 is seated anteriorly and centered longitudinally relative to the motorized tool 10. More particularly, the light 130 is incorporated into the housing 12 disposed between the anterior end of the handle 95 and the receiving opening 146 for the battery pack 94.

Figure 23:
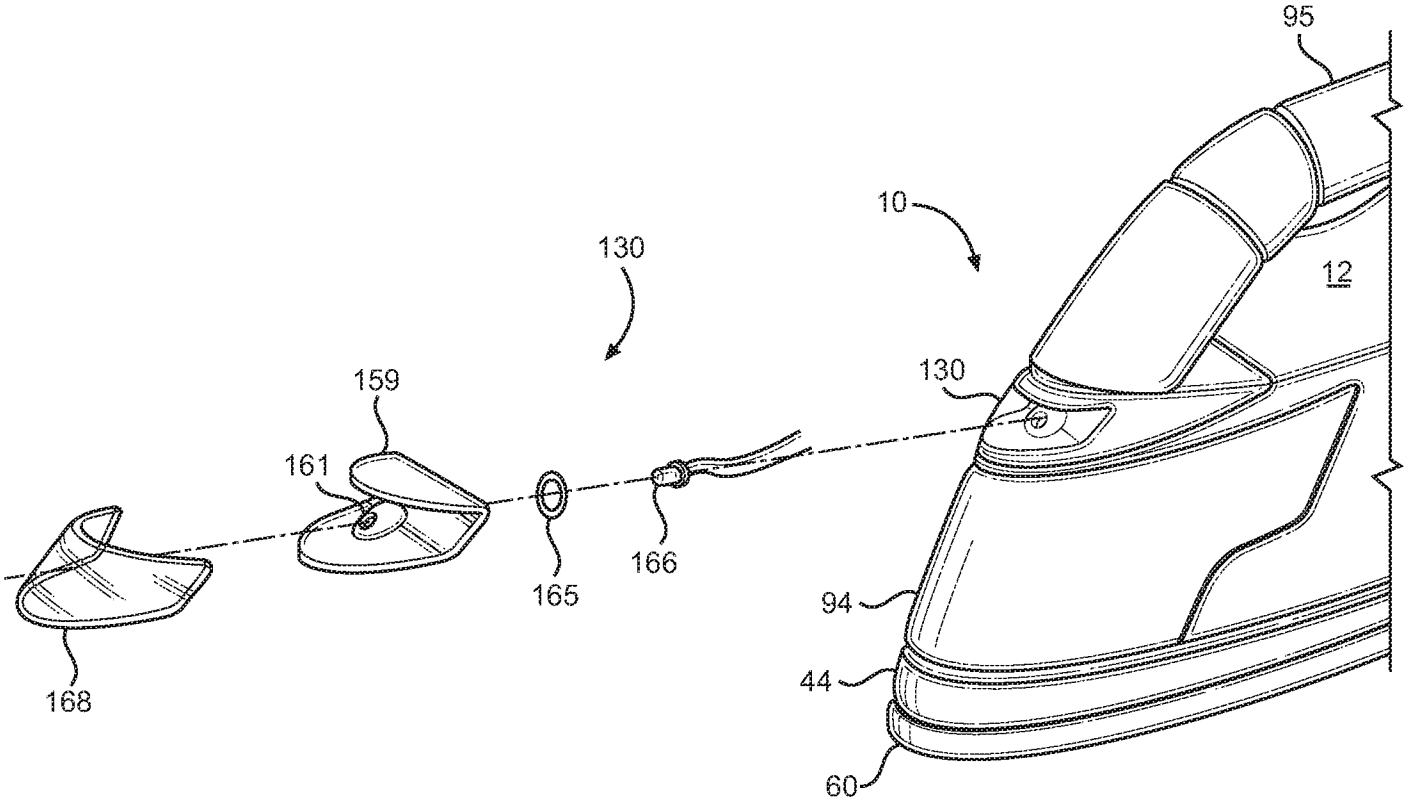
FIG. 23 is a perspective view of another embodiment of the motorized tool with a lighting system in situ and in an exploded configuration.

With further reference to FIG. 23, the light 130 has a housing 159 that is essentially wedge shaped, and a receiving aperture 161 is disposed in a rearward wall of the housing 159. A light source 166, such as but not limited to one or more LED bulbs in electrical communication with the battery pack 94, is received partially through the aperture 161 to project forward of the rearward wall and into the inner volume of the housing 159. One or more O-rings 165 or other water sealing structure or material can be disposed to surround or shield the light source 166 to prevent entry of water into the main housing 12. A shield 168, which can be fluidically sealed relative to the housing 159, can enclose the inner volume of the housing 159.

Looking again to FIGS. 7A and 8A in combination with FIGS. 1 through 6, operation of an embodiment of the motorized tool 10 can be more fully understood. During use of the motorized tool 10, actuation of the motor 28 by use of the switch 26 will induce an eccentric rotation of the output rod 46. The eccentric movement of the output rod 46 in turn produces an eccentric movement of the roller bearing 40, and the eccentric movement of the roller bearing 40 produces a movement or vibration of the base plate 44, such as an oscillation, a reciprocation, or some other movement. With a surface treatment pad 24 retained relative to the base plate 44, motorized cleaning scrubbing, buffing, and polishing can be carried out with the motorized tool 10 efficiently and effectively with reduced user effort as compared to manual efforts.

As best seen in FIG. 8A, a plurality of flexible rods 36, in this case four rods 36 potentially with rubber end bushings, connect the base plate 44 to the framework 45 by having proximal ends received and retained by housings 47 in the framework 45 and distal ends received into apertures 52 in the base plate 44. The flexible rods 36 thus provide vibration isolation between the vibrating base plate 44 and the remainder of the tool 10.

The housing 12 is preferably water resistant to permit use of the motorized tool 10 in wet applications, such as the scrubbing of showers and sinks, in outdoor applications, in marine applications, and in similarly wet environments. In the embodiment of FIG. 8A, for instance, a water resistant, ideally watertight, construction is achieved through a sealed engagement between the housing halves 12A and 12B and through a water resistant boot 50 that engages a rim 51 on the bottom portions of the housing halves 12A and 12B and matingly engages a correspondingly shaped and sized channel in the surface treatment pad 24. Moreover, the motor 28 itself can be encased in a water resistant housing formed by the framework 45.

Figure 9:
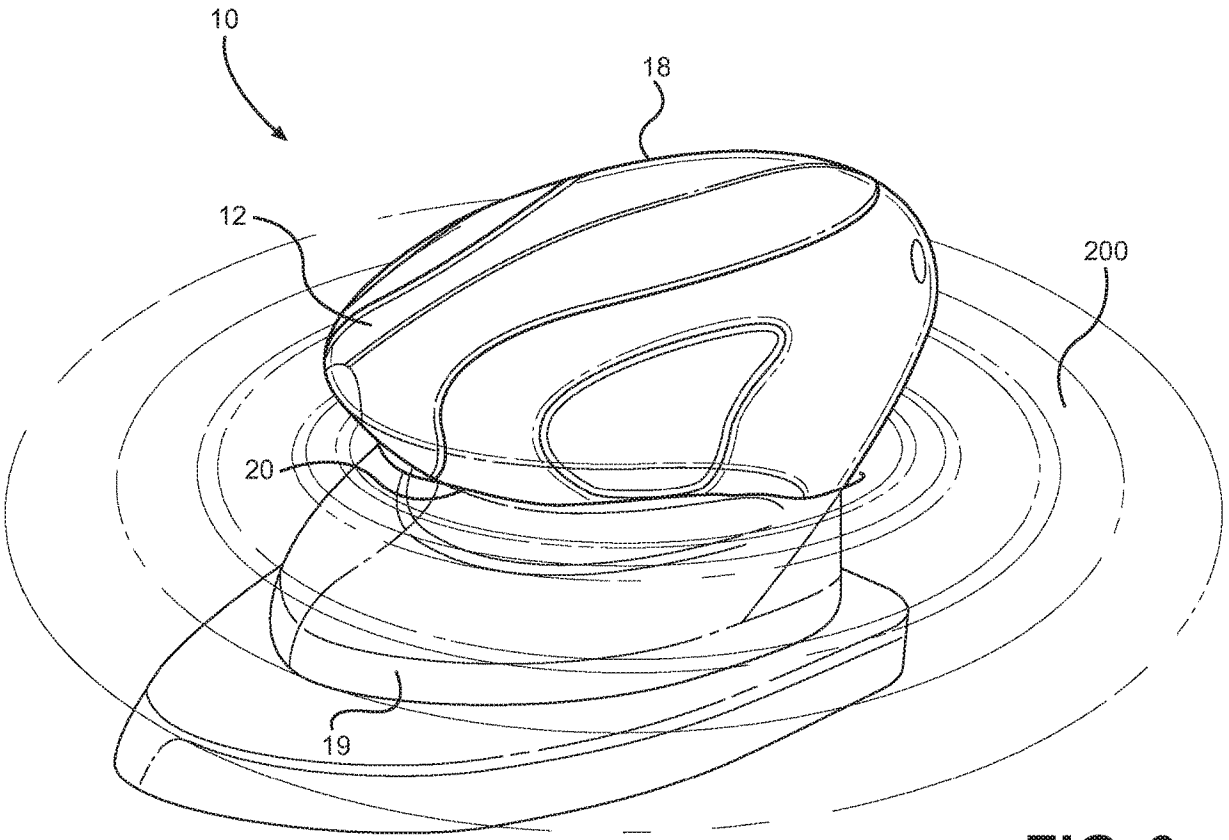
FIG. 9 is a perspective view of a motorized tool as disclosed herein floating in a body of water.

When fully assembled, the motorized tool 10 can have an ingress protection (IP) rating of at least 6-7 with the number 6 indicating that the tool 10 will lock out all dust particles and the 7 representing that the tool 10 can be submersed in one meter of water for thirty minutes. In preferred embodiments, the motorized tool 10 will be buoyant such that the tool 10 will tend to float in a body of water 200 as shown in FIG. 9. Moreover, embodiments of the tool 10 are contemplated wherein the distribution of mass within the tool 10 is balanced with one or more air pockets formed in the bulbous upper portion 18 such that the tool 10 will float in an upright position with the bulbous upper portion 18 projecting above the surface of the body of water 200 and the base portion 19 disposed therebelow. Other mechanisms for inducing sufficient buoyancy can be used in addition or alternatively to the air pocket. For instance, buoyant foam padding can be retained inside or outside of the housing 12. In any event, the cumulative buoyancy established by the means for inducing buoyancy will overcome the weight of the tool 10 to permit the tool 10 to float as described.

Figure 7B:
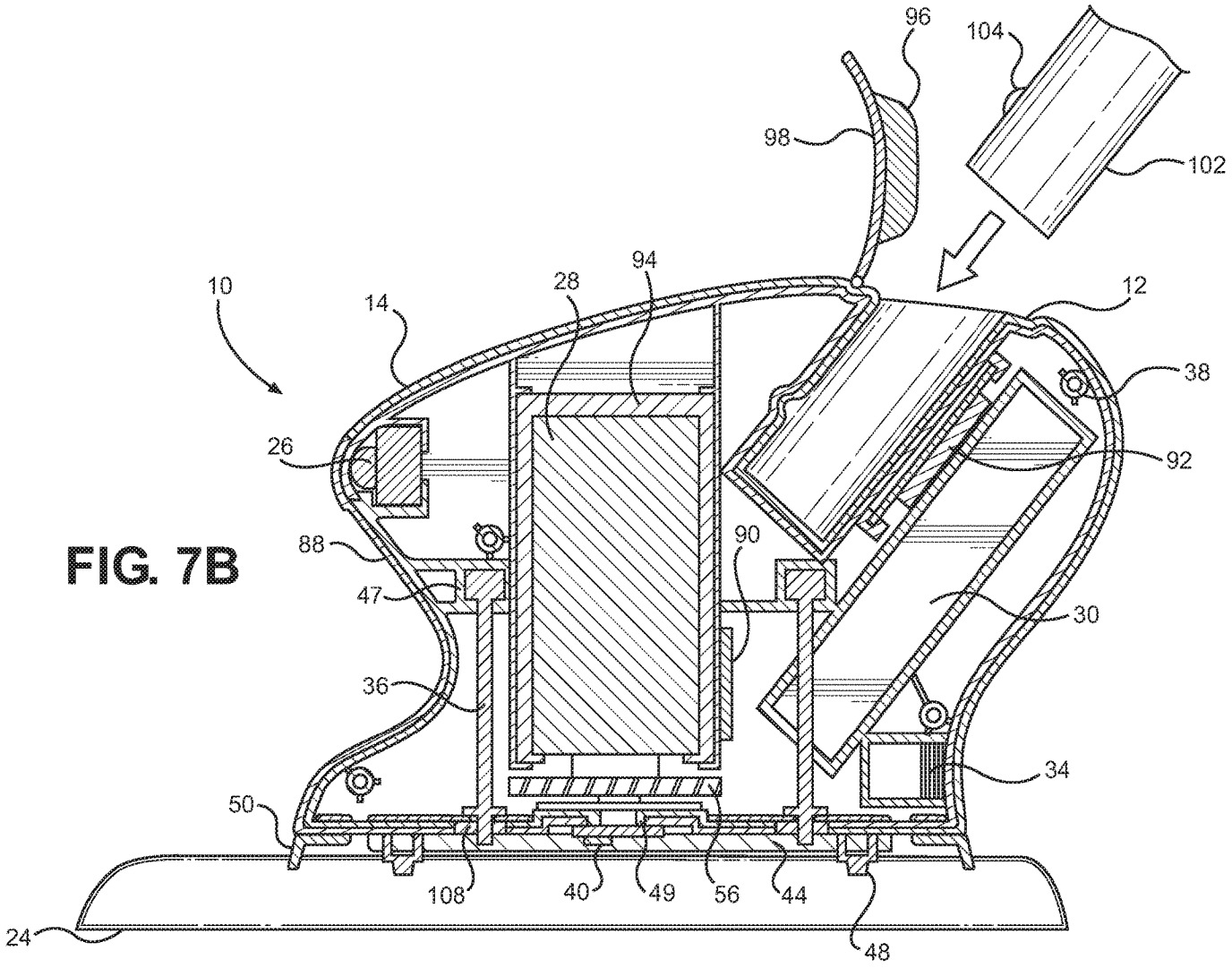
FIG. 7B is a sectioned view in side elevation of an alternative motorized tool as disclosed herein.
Figure 8B:
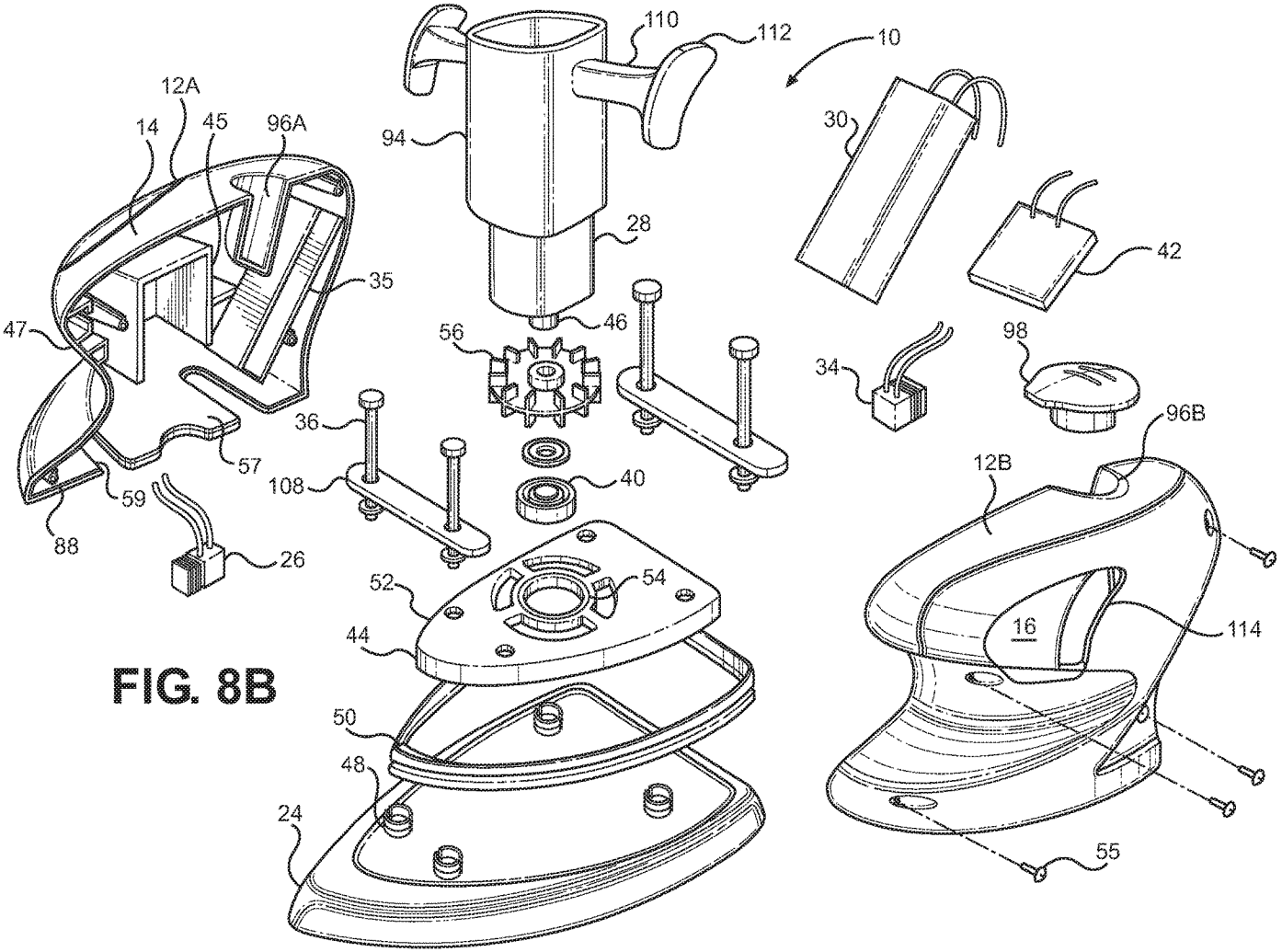
FIG. 8B is an exploded view of the motorized tool of FIG. 7B.

An alternative embodiment of the motorized tool 10 is depicted in FIGS. 7B and 8B. There, the tool 10 again has a motor 28 retained in place by an inner framework 45 that is again molded into the housing halves 12A and 12B. The housing halves 12A and 12B are secured together by a plurality of fasteners 55 received through apertures in the housing half 12B and into threaded bosses 38 in housing half 12A. The motor 28 is powered by one or more batteries 30 that can be rechargeable through a recharge induction coil 34. Overcharging can be prevented by an overcharge cutoff circuit 42. The motor 28 can be actuated by a switch 26, which is again embedded in the tip 58 of the central gripping section 14. The motor 28 has an eccentric output rod 46 that is received through a cast alloy flywheel 56 and into a sealed roller bearing 40. The roller bearing 40 in turn is received into a correspondingly shaped aperture 54 in a base plate 44. A surface treatment pad 24 can again be selectively retained relative to the base plate 44.

Four flexible rods 36 with rubber end bushings connect the base plate 44 to the framework 45 by having proximal ends received and retained by housings 47 in the framework 45 and distal ends received into apertures 52 in the base plate 44. Again, the flexible rods 36 provide vibration isolation between the vibrating base plate 44 and the remainder of the tool 10. Here, however, the housing halves 12A and 12B have bottom walls 57 with lateral slots 59 therein through which the flexible rods 36 pass. Elongate sealing membranes 108 comprising flat polymeric members occupy the lateral slots 59 and receive the flexible rods 36 therethrough, a polymeric sealing gasket 88 is interposed between the housing halves 12A and 12B, and a water resistant boot 50 engages the bottom of the housing 12. With this, the sealing gasket 88, the sealing membranes 108, and the water resistant boot 50 cooperate to form a water resistant barrier between the inner volume of the housing 12 and the exterior of the housing 12, including in relation to the base plate 44. A water resistant, preferably watertight, inner compartment is thus established within the housing 12. Accordingly, the base plate 44 can be driven by the motor 28 while remaining fluidically segregated from the water resistant inner compartment.

The illustrated motorized tool 10 again will preferably have an ingress protection (IP) rating of 6-7 with the number 6 indicating that the tool 10 will lock out all dust particles and the 7 representing that the tool 10 can be submersed in one meter of water for thirty minutes. The motorized tool 10 will preferably be buoyant such that the tool 10 will tend to float in a body of water 200 as shown in FIG. 9 and as described previously.

It will be appreciated that, while the motorized tool 10 has primarily been depicted as being handheld, it is possible and within the scope of the invention for a handle 102 to be additionally or alternatively employed, such as through a threaded connection, a snap-fit connection, or a ball and detent 104 and 106 combination as in FIGS. 7B and 8B. With the provision of such a handle 102, the tool 10 could enjoy still further application in hard to reach or remote locations, such as the upper reaches of a shower, behind a toilet, the underside of a boat, or a higher portion of a wall.

As shown in FIG. 8B, the housing halves 12A and 12B have first and second receptacle halves 96A and 96B that are molded into the housing halves 12A and 12B and that together form a receptacle 96 as in FIG. 7A. The receptacle 96 is fluidically sealed in relation to the fluidtight inner compartment of the housing 12. A wand handle 102 with a resiliently deflectable ball 104 adjacent to a distal end thereof can be selectively received into the receptacle 96 with the ball 104 engaging with the detent 106. When not in use, the receptacle 96 can be covered by a cap 98, which can be a polymeric cap that is hingedly or otherwise connected to the housing 12 as shown most clearly in FIG. 7B. The wand handle 102 can vary depending on, among other things, the expected application of the motorized tool 10. In one contemplated embodiment, the wand handle 102 comprises a telescoping construction of steel, aluminum, plastic, or some other material or combination thereof.

Looking further to FIGS. 26A through 26F, it will be seen that embodiments of the motorized tool 10 can additionally incorporate an extension pole receptacle 176. Where the handle 95 has a body portion spaced from the main housing 12, a clamping pole receptacle 176 can be employed to provide a pole retaining location at varied locations along the body portion of the handle 95. In this particular embodiment, the receptacle 176 has a semi-cylindrical sleeve 178 that can be engaged, such as in a snap-fit engagement, with the handle 95. A reception sleeve 182 projects orthogonally from the sleeve 178 for selectively receiving a section 186 of an extension handle 184. A locking strap 180 has a first end fixed to the sleeve 178 and a second end selectively retained to form a clamping loop by an adjustable locking mechanism 184.

Figure 26A:
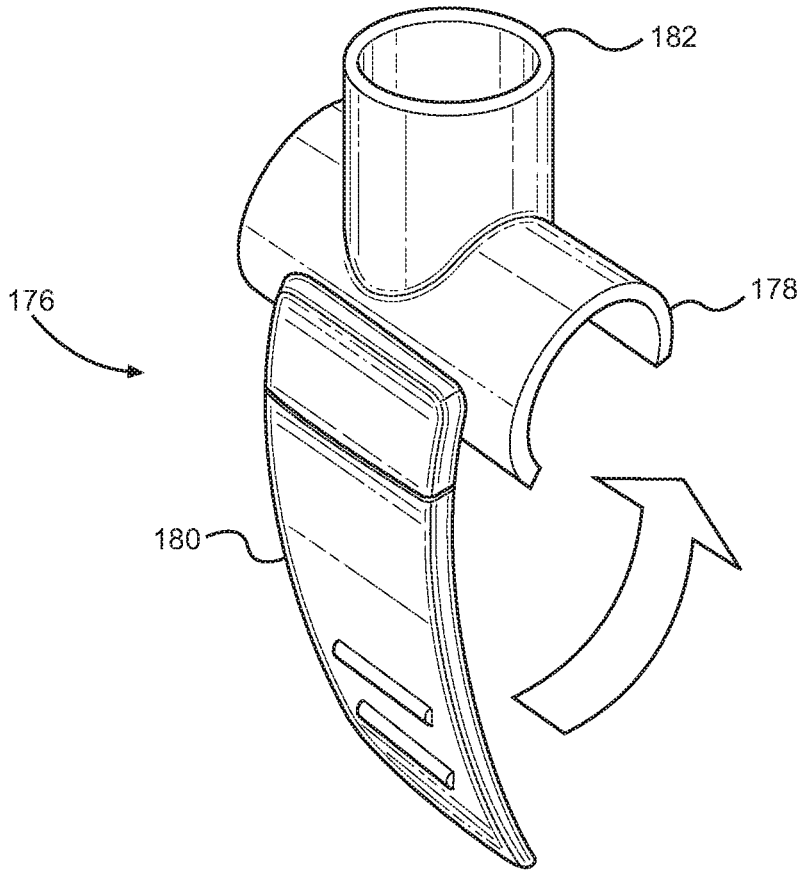
FIGS. 26A through 26C are perspective views of an extension handle retaining mechanism in progressive stages of closure.
Figure 26B:
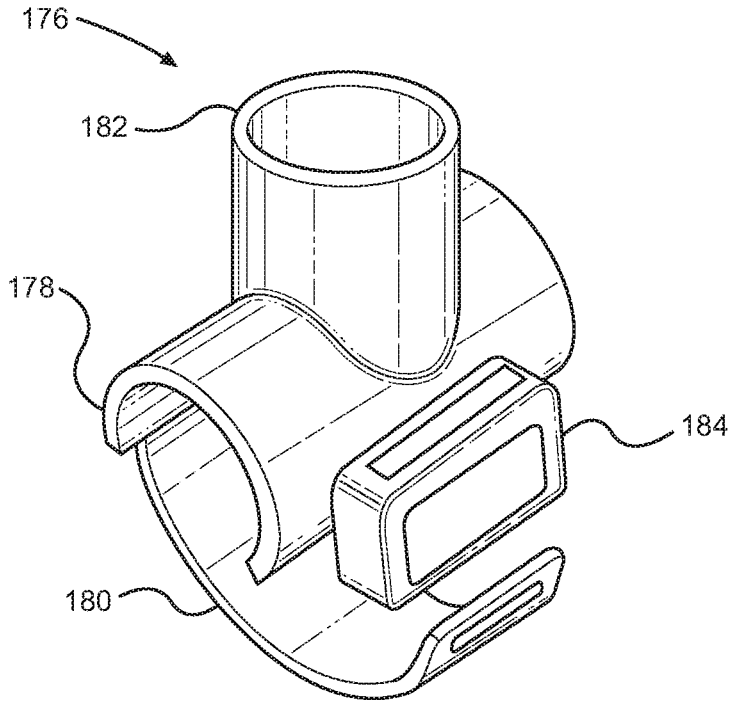
Figure 26C:
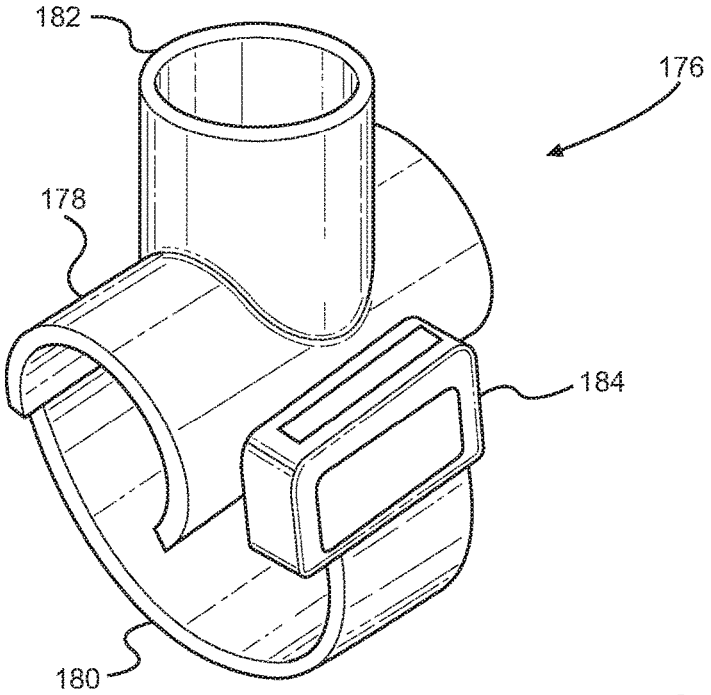
Figure 26D:
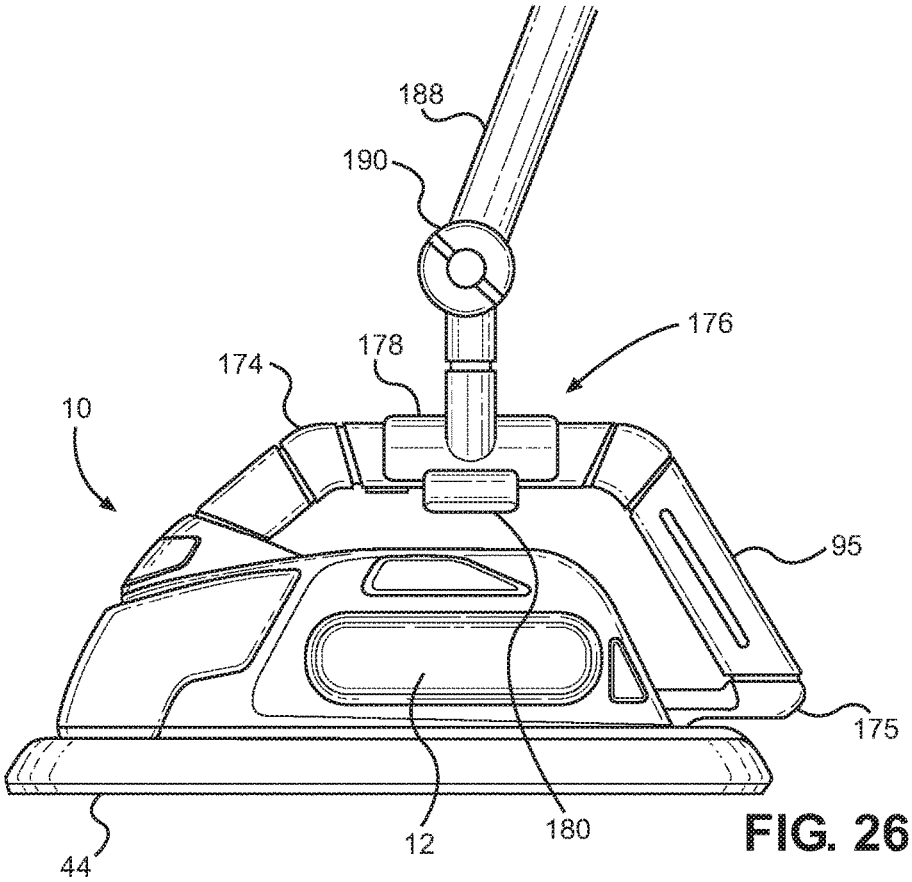
FIGS. 26D and 26E are views in side elevation of the extension handle retaining mechanism retained relative to a motorized tool with an extension handle engaged therewith.
Figure 26E:
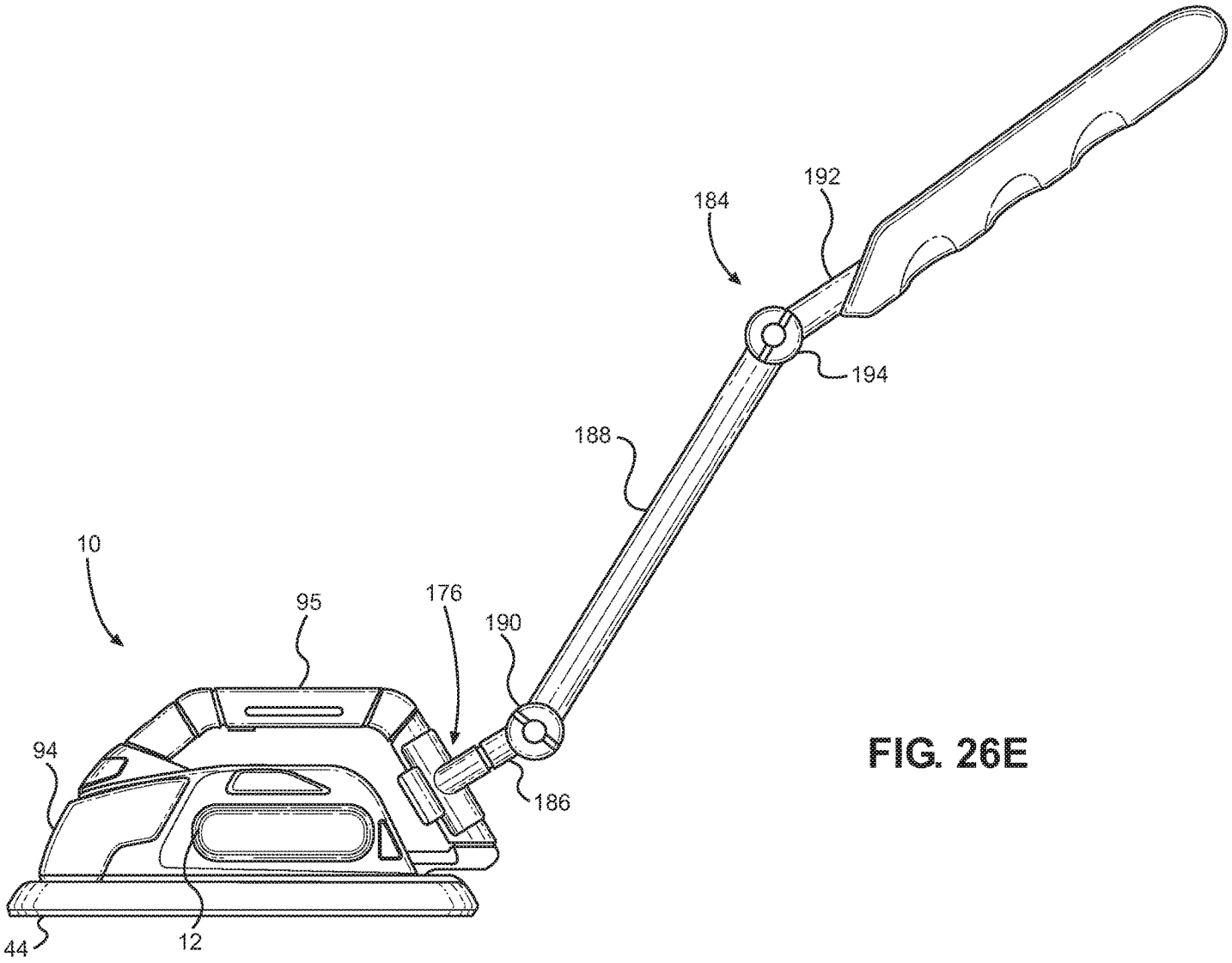

Under this construction, an extension pole 184 can be selectively and adjustably retained relative to the motorized tool 10 through the extension pole receptacle 176 as shown, for instance, in FIGS. 26D and 26E. For example, where the body portion of the handle 95 has a central portion traversing generally parallel to the surface of the base plate 44 and a posterior portion traversing generally diagonally to the base plate 44, an extension pole 184 can be retained with a proximal end coupled to either portion to give varied retention and surface treatment characteristics. As is illustrated, the handle 95 can have grooves and, additionally or alternatively, protuberating sections interposed between the central, posterior, and perhaps other portions of the handle 95 thereby to prevent inadvertent displacement of the extension pole receptacle 176 and an extension pole 184 retained thereby along to the handle 95 and in relation to the motorized tool 10 in general.

Figure 26F:
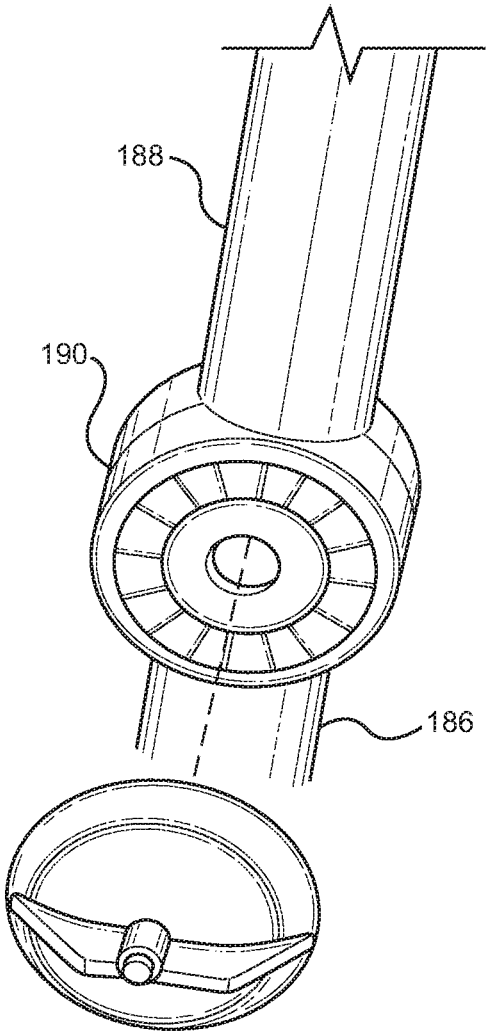
FIG. 26F is a partially exploded perspective view of a joint for the extension handle.

Further versatility can be accomplished where the extension pole 184 is articulated as in FIGS. 26D through 26F. There, the extension pole 184 has a proximal section 192 connected to a central section 188 by an adjustable joint 194 and a distal section 186 coupled to the central section 188 by an adjustable joint 190. The adjustable joints 190 and 194 can, by way of example, be crafted as in FIG. 26F where corresponding radial locking formations within the joints 190 and 194 in conjunction with selective securing mechanisms, such as springs or mechanical fasteners, can permit ready adjustability and locking of the angular relationships between the respective sections 186, 188, and 192. Moreover, embodiments of the extension pole 184 can provide a swiveling capability, such as between sections 186, 188, and/or 192 and, additionally or alternatively, between the distal end of the pole 184 and the extension pole receptacle 176.

Figure 27A:
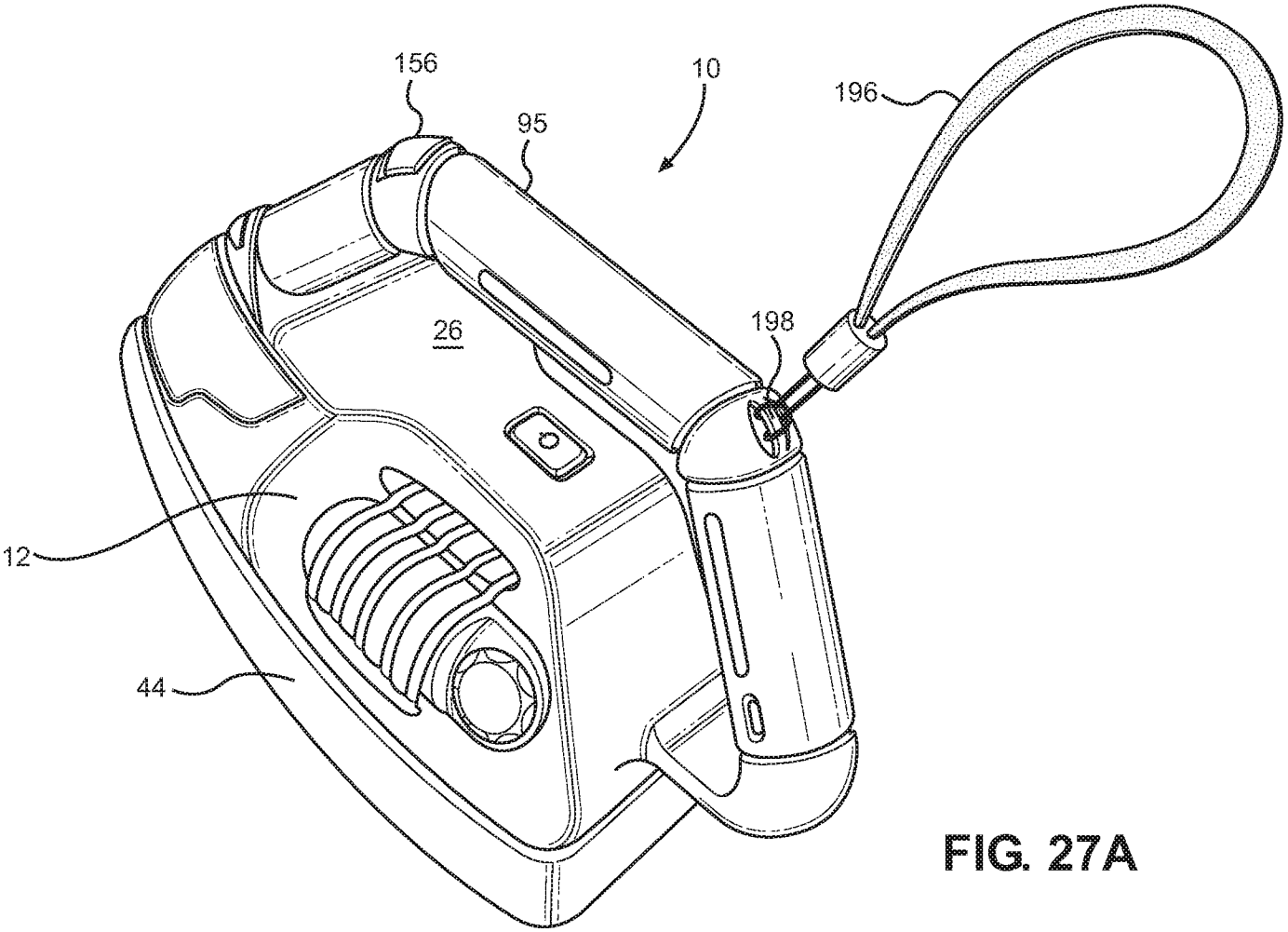
FIGS. 27A and 27B are perspective views of a wrist strap retention mechanism with the wrist strap fully engaged and in the process of engagement respectively.
Figure 27B:
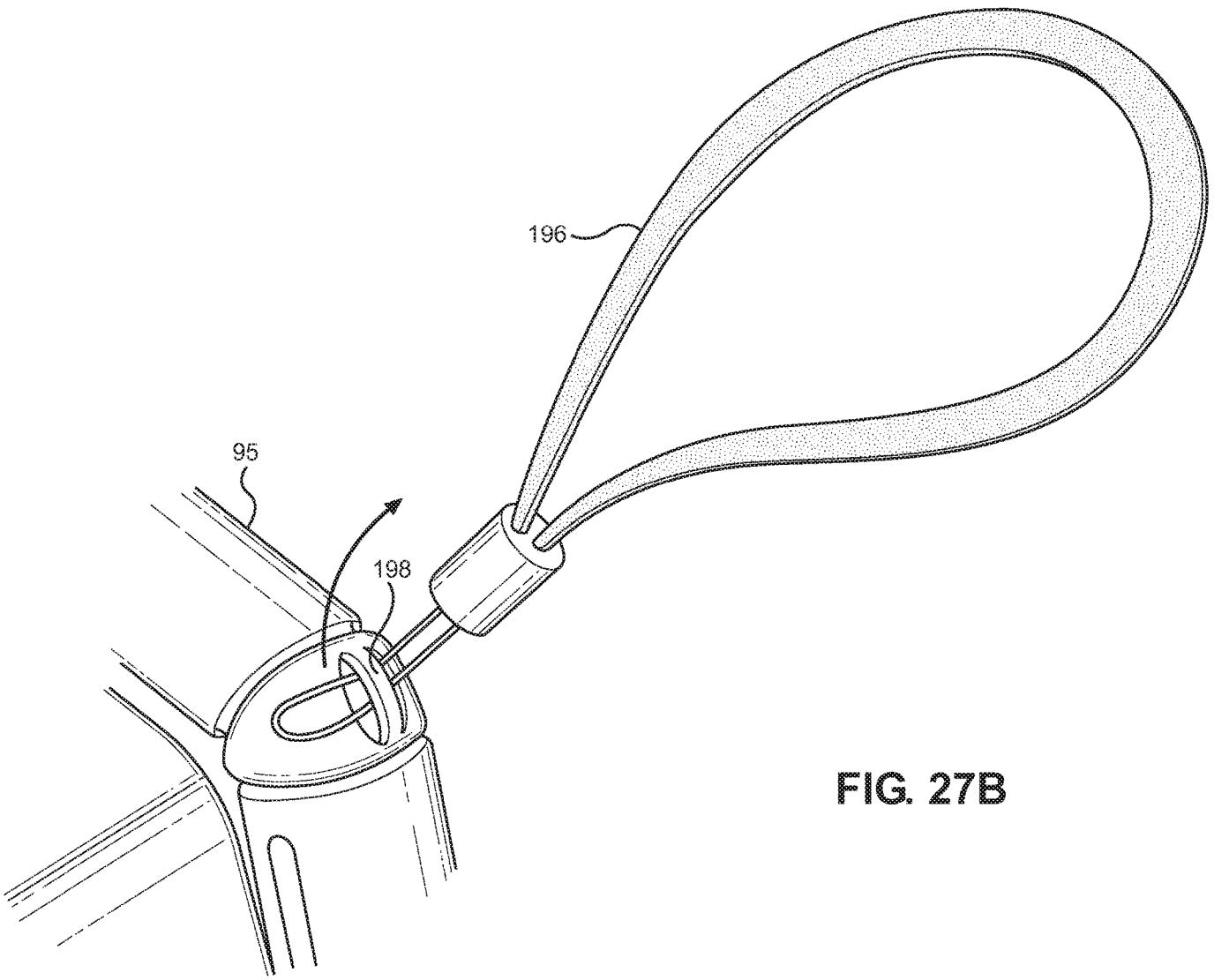

Secure retention of the motorized tool 10 can be further ensured by the inclusion of a selectively retained wrist strap 196 as in FIGS. 27A and 27B. There, an embodiment of the tool 10 is illustrated wherein a retaining bar 198 is disposed along the handle 95, and a wrist strap 196 has a proximal loop and a distal loop that extend from a central retaining member. The proximal loop can be of suitable size and material for comfortably and securely being disposed about a wrist or hand of a user while the distal loop can be a thinner strand of, for instance, nylon or other strong and tough material. With that, the distal loop can be fastened about the retaining bar 198 as suggested by FIG. 27B to achieve the configuration of FIG. 27A thereby to provide a useful retaining strap 196 for the motorized tool 10.

Looking again to FIGS. 7B and 8B, one can perceive a further refinement of the invention in the form of a heat sink housing 94 that envelops all or a portion of the motor 28. The heat sink housing 94 can be formed from a material with a high heat transfer coefficient, such as by being formed of a tightly toleranced, aluminum or similar alloy. The heat sink housing 94 draws heat away from the motor 28. To improve heat removal, heat sink arms 110 project laterally from the heat sink housing 94 and terminate in heat sink surface flanges 112. The flanges 112 can in certain embodiments be in direct contact with or immediately adjacent to the exterior wall surface of the housing 12. In the depicted embodiment, however, the housing 12 has heat sink flange apertures 114 therein that allow the flanges 112 to be exposed to the exterior of the housing 12. The flanges 112 can be formed to establish a continuous, contoured surface with the housing halves 12A and 12B. While two heat sink arms 110 and flanges 112 are shown, it will be understood that more or fewer heat sink arms 110 and flanges 112 could be employed.

Figure 8C:
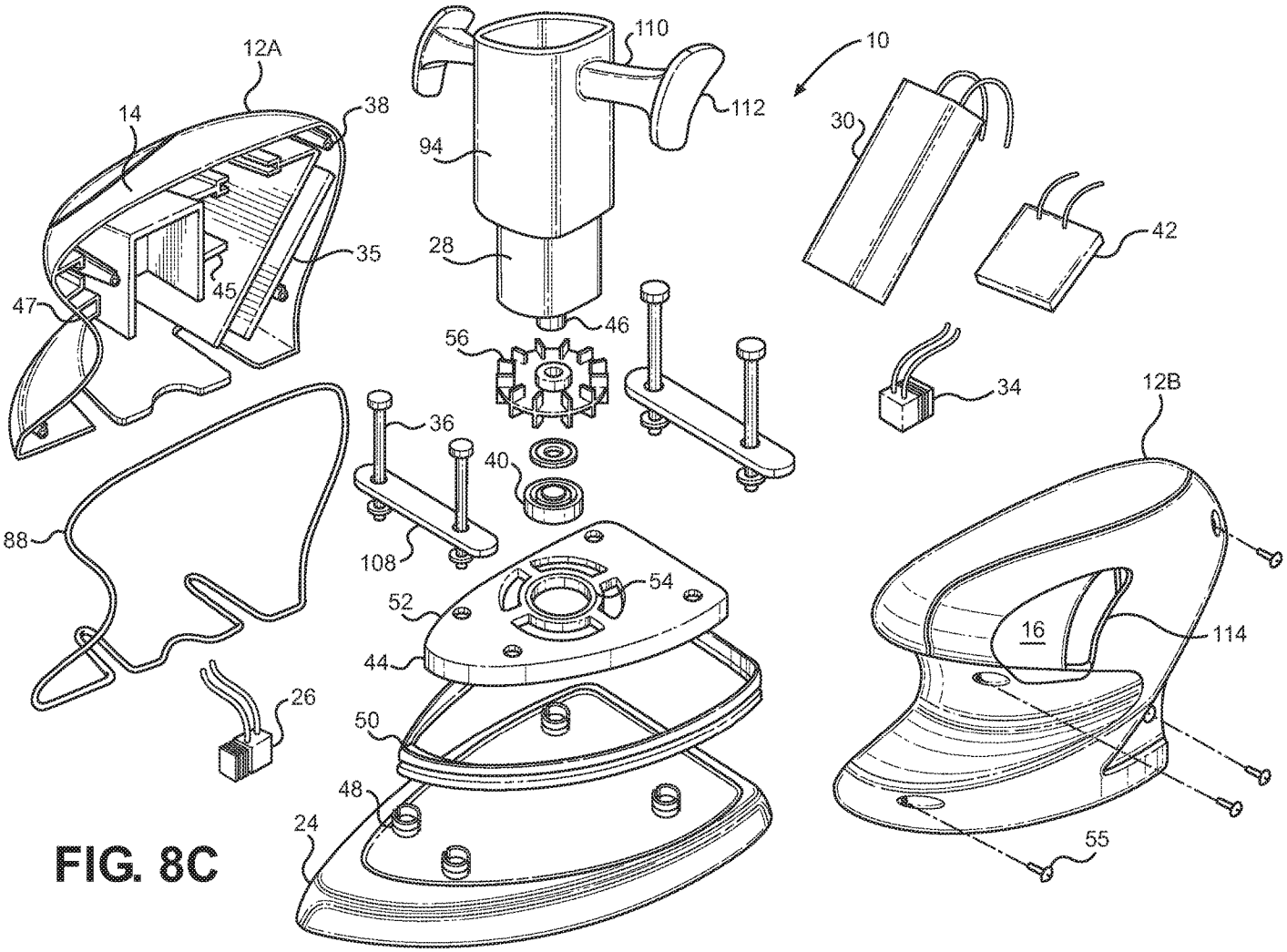
FIG. 8C is an exploded view of another motorized tool pursuant to the invention.

Of course, the heat sink arms 110 and flanges 112 can be readily incorporated into alternative embodiments of the invention. For example, as shown in FIG. 8C, the heat sink housing 94, arms 110, and flanges 112 are again employed in an embodiment where no receptacle 96 is provided. The motorized tool 10 of FIG. 8C again seeks to achieve many of the advantages and functions described previously.

To address the possibility of excessive heat buildup even with the presence of the heat sink arms 110 and flanges 112, the motorized tool 10 of FIG. 7B additionally could incorporate a thermal motor sensor switch 90, which is attached to or near the motor housing 94. The thermal motor sensor switch 90 can be operative to open the electrical motor circuit to shut down the motor 28 to permit a cooling thereof. The thermal motor sensor switch 90 can in certain embodiments incorporate or be in communication with a timer to prevent motor operation for a predetermined period or until a predetermined temperature is reached. An overcharge cut-off circuit 92 can additionally be interposed in the electrical system to prevent excessive charging of the battery 30.

Still further, the motorized tool 10 can incorporate a recharge warning to advise a user of an imminent need for recharging the tool 10. For example, the circuit board 42 can include circuitry to induce a warning when complete battery depletion is approaching within a predetermined time period, such as two minutes. The warning could, for example, comprise a pulsation of the motorized tool 10 a given number of times by an automated powering on and off of the tool 10 during operation. Alternatively, the motor 28 could progressively reduce operational speed in stages in anticipation of a loss in batter power. By way of example, the motor 28 can begin a slowdown with three minutes of power remaining, a further slowdown with two minutes of power remaining, and then a final slowdown to total cessation of operation with one minute of power remaining.

Figure 11A:
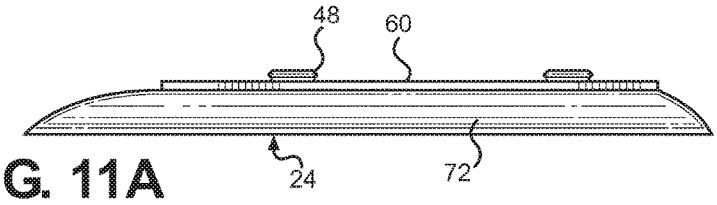
FIGS. 11A and 11B are views in side elevation of surface treatment pads as disclosed herein.
Figure 11B:
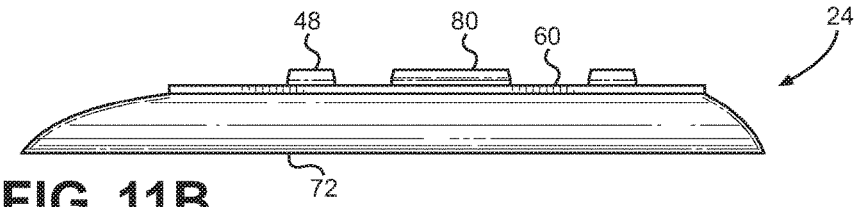
Figure 12A:
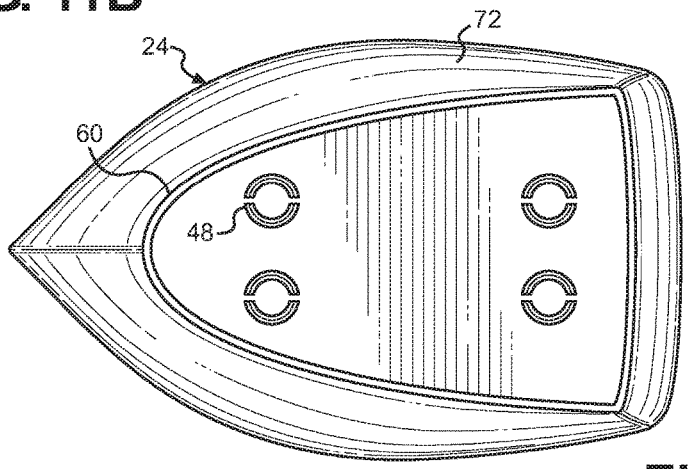
FIGS. 12A and 12B are top plan views of the surface treatment pad of FIGS. 11A and 11B respectively.
Figure 12B:
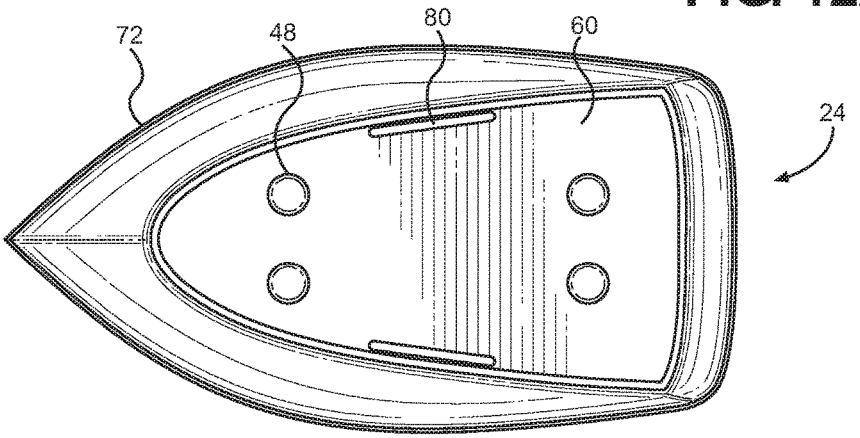

First and second embodiments of surface treatment pads 24 are shown alone in FIGS. 11A and 12A and 11B and 12B respectively. In FIG. 11A, it can be perceived that the surface treatment pad 24 again has a base platform 60, which is preferably a rigid member that can but need not be crafted of, for example, plastic, metal, or some combination or variation thereof. Multiple engaging protuberances 48 again project form the dorsal surface of the base platform 60 and surface engaging material 72, which may alternatively be referred to as a surface engaging member 72, is fixed to or comprises the ventral surface of the base platform 60. In FIGS. 11A and 12A, the protuberances 48 are designed for snap-fit engagement. In FIGS. 11B and 12B, the protuberances 48 comprise mere projections, and engaging tabs 80 project from the outboard lateral edges of the base platform 60. In each example, the surface engaging member 72 has a generally boat-shaped periphery with a pointed anterior end, curved sides, and a rounded posterior end. While details could vary depending on a number of factors, including the application, the sides meet at a substantially 90-degree angle to form the anterior end in this embodiment. The surface engaging material 72 in FIGS. 11A, 11B, 12A, and 12B tapers from its most distal surface toward the base platform 60.

By reference to FIGS. 13A, 13B, 13C, and 13D, one will appreciate that the character of the surface engaging member 72 can vary widely within the scope of the invention depending on the task at hand. By way of example and not limitation, a surface engaging member 72 with plastic bristles forming all or part of the surface engaging material 72 as in FIG. 13A could be employed to scrub and otherwise clean pots and pans, stoves, ovens, car wheels, and other surfaces to remove baked-on or caked-on food, road grime, mud, or other debris. A similar surface engaging member 72 could have metal bristles, which could be useful for cleaning barbecue grills, stovetops, oven grills, and similarly tough surfaces. In other embodiments, as in FIG. 13B, the surface engaging member 72 can be formed by a sponge, whether natural or synthetic and of varied coarseness, to clean, for example, tile, stone, pebble, glass, porcelain, stainless steel, or vinyl of kitchens, baths, toilets, showers, sinks, backsplashes, and any other appropriate surface. Suitably chosen sponges or scrunges can easily remove soap-scum, mold and mildew, dirt, grime, grease, water stains, calcium build-up, and other undesirable surface remnants with markedly reduced manual effort by the user as compared to traditional methods. Still further, as seen in FIG. 13C, it is contemplated to provide surface engaging materials or members 72 comprising a fabric, such as a chamois cloth or faux lambskin, stretched over a base member and with rounded and/or flexible edges for polishing or buffing anything from stainless steel appliances, chrome parts on cars and motorcycles, tile, marble, quarts, granite, wood surfaces, including furniture, or any other surface that might be so treated. Additionally, as in FIG. 13D, the surface engaging member 72 comprises a scrungy, abrasive pad, such as might be particularly useful for removing soap scum, mold, mildew, dirt, calcium buildup, and other undesirable material from substantially any surface, wet or dry.

In any event, the preferred surface treatment pads 24 will be dishwasher safe to permit convenient reuse. Moreover, the peripheral edges of the pads 24, including the tip of the pads 24, will preferably be soft and pliable to permit a flexible application and reaching in relation to, for example, corners, sinks, pots, pans, crevices, and innumerable other applications. In practice, replacement surface treatment pads 24 can be sold in variety packs, individually, or with multiple pads 24 of similar design. Surface treatment pads 24 can potentially be manufactured with impregnated detergent, polishing crime, and other surface treatment materials.

Figure 15:
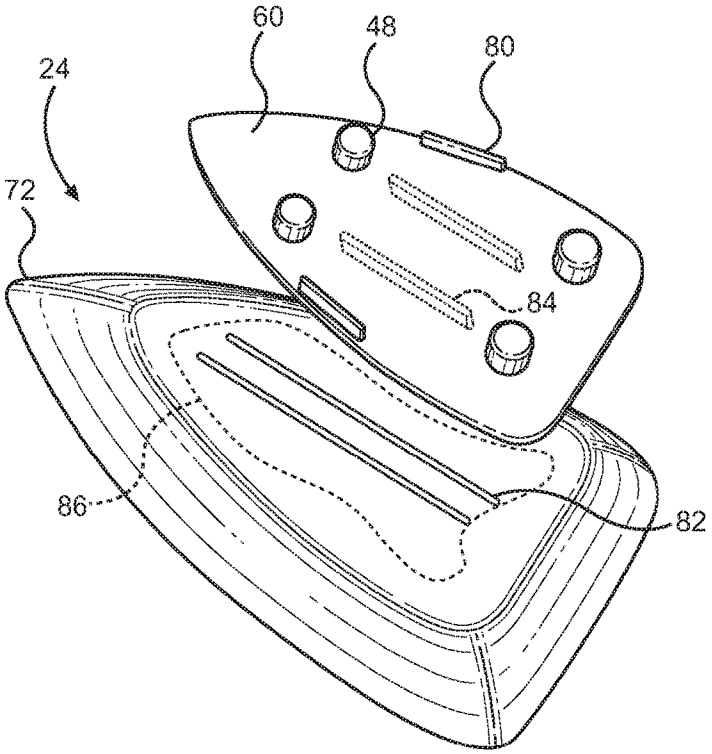
FIG. 15 is a perspective view of an alternative surface treatment pad as disclosed herein.

As noted previously, the surface treatment pads 24 can be manually or automatically discharged from the base plate 44 and the main housing 12 of the tool 10. Further details of the surface treatment pad 24 can be seen in FIG. 15. There, the surface treatment pad 24 again can be seen to have a surface engaging member or material 72 retained relative to a base platform 60. The base platform 60 can be rigid or not, and the surface treatment material 72 can be integral to the base platform 60 or affixed thereto. Here, however, the surface engaging member 72 can additionally have longitudinal channels 82 therein for receiving correspondingly shaped and located rails 84 that project from the ventral surface of the base platform 60. The rails 84 could be barbed or otherwise formed to positively engage the surface engaging member 72. Moreover, adhesive 86 can be employed to provide a still more durable connection between the material 72 and the platform 60. Also depicted in FIG. 15 are the connection and ejection tabs 80 that are fixed at the outboard edges of the base platform 60. The tabs 80 can be engaged with retention and ejection mechanisms on the housing 12 for permitting secure retention and automatic ejection of the surface treatment pad 24 in a substantially hands-free manner for disposal or cleaning. As noted previously, in such an embodiment, the engaging rings 48 need not necessarily provide a snap-fit and can merely ensure proper orientation and movement.

Figure 14B:
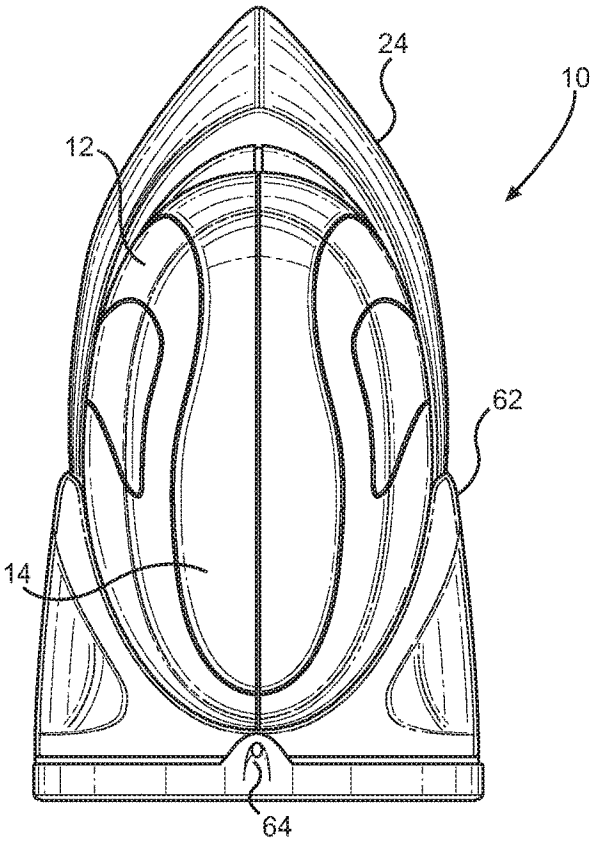
FIGS. 14A, 14B, and 14C are views in side elevation, front elevation, and perspective of the motorized tool and a charging stand therefor.
Figure 14A:
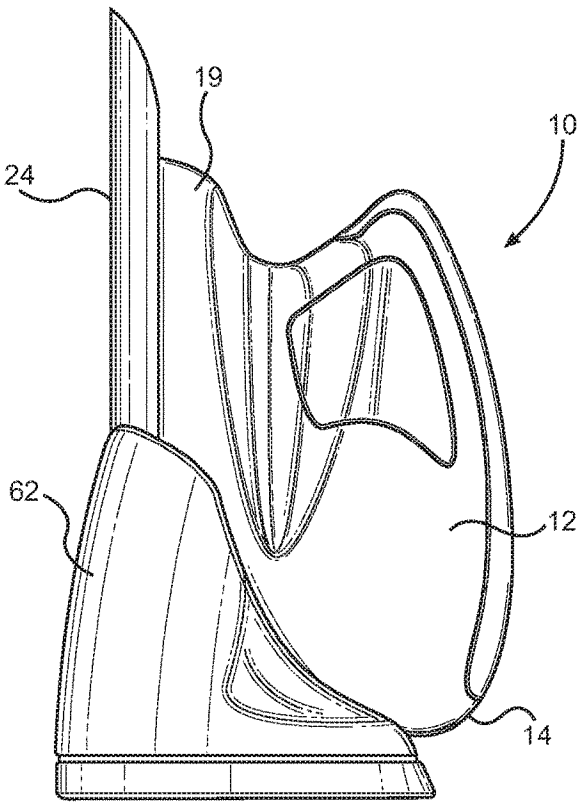
Figure 14C:
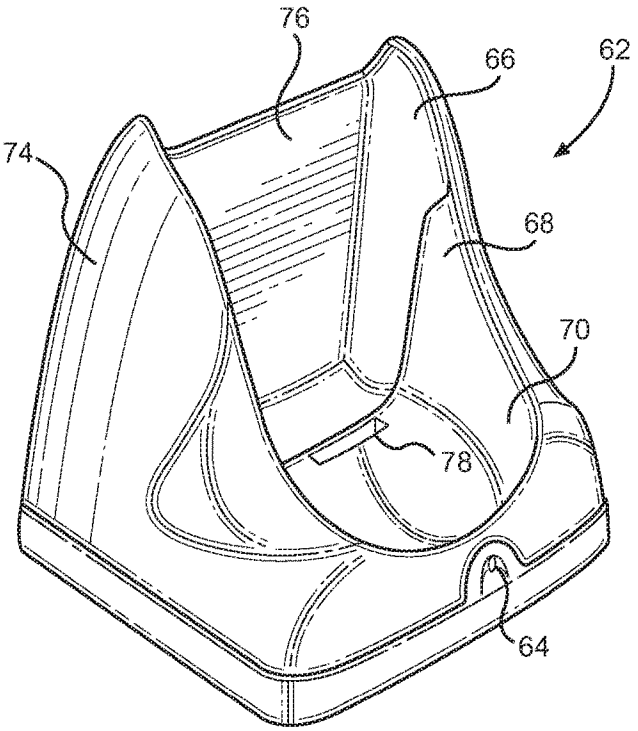

The motorized tool 10 could be corded, battery powered, or selectively used in corded or battery-powered applications. Where included, batteries 30 as disclosed herein can be fixed in place or removable. The battery 30 or batteries 30 for the tool 10 will preferably be rechargeable. To that end, a correspondingly contoured charging cradle 62 could be provided for receiving, retaining, and recharging the motorized tool 10 as depicted in FIGS. 14A, 14B, and 14C, but it will be understood that, rather than a charging cradle 62, a cord could be used to power the motorized tool 10 directly or to charge a retained battery 30 or batteries 30. In any case, the illustrated charging cradle 62 can be seen to have a base housing 74 that has an upstanding base plate 76 for engaging the surface treatment pad 24 or the base plate 44 where the pad 24 is removed. Opposed, ramped lateral slots 66 slidably receive the surface treatment pad 24 when it is attached to the housing 12, but it will be appreciated that the tool 10 can be engaged with the charging cradle 62 with the pad 24 removed therefrom. Opposed lateral retaining ridges 68 matingly engage the opposed charging cradle slots 22 in the housing 12. Electrical contacts 78 transmit recharging power to the battery 30, or the recharging could be done using wireless technology. A status LED light 64 can provide an indication of the charging status of the battery 30. The base of the charging cradle 62 can have a drip basin and/or slot therein, such as at the back thereof, for permitting any residual liquid to drain from the tool pad 24.

Based on the foregoing, it will be clear that the motorized tool 10 can permit cleaning, scrubbing, buffing, polishing and other tasks in wet and dry environments with significantly less effort than under traditional methods while potentially reducing the need for detergents and chemicals. Most household, vehicle, marine, and other cleaning jobs are rendered easier and more convenient with less demand on the body of the user. The user's fingertips, effort, and time are all conserved, and users can save time through added efficiency. The motorized scrubbing, buffing, and polishing tool 10 is multi-functional and subject to innumerable applications without a need for power cords. The vibrating and pulsating household tool 10 can scrub, buff, polish, and clean through electrically charged friction. The tool 10 can clean without scratching and abrade without leaving unsightly marks. The water resistant housing 12 permits use in wet or dry applications, and the preferred construction materials render the housing 12, the gripping surfaces 14 and 16, and the pads 24 impervious to chemicals, such as bleach, acid, and the like.

Of the innumerable possibilities, exemplary applications of the motorized tool 10 might include, for example, use of the tool 10 to mix and blend paints or to apply large swaths of color or other material to a canvas or other substrate expeditiously. The surface treatment pad or material 24 might be specially crafted to that end, such as by comprising closely spaced rubber fingers. Similar or different surface treatment materials 24 may be used by the motorized tool 10 for cleaning and polishing jewelry by direct contact therewith. Still further, embodiments of the motorized tool 10 might be used for indirect cleaning, such as of jewelry, by retaining the motorized tool 10 relative to a liquid reservoir for jewelry and other articles and actuating a vibration of the tool 10. Still further, the tool 10 could be used for waxing and polishing articles, such as skis and snowboards. To facilitate the same, the surface treatment material 24 might comprise or include a wax insert, and a second surface treatment pad 24 comprising a polishing material might be employed to polish a waxed surface. Still further, it would be readily possible to use the motorized tool 10 for cleaning and removing rust from machinery and tools, such as with the use of abrasive surface treatment material 24, possibly in combination with a cleaning liquid. Even further, the motorized tool 10 could be used for polishing footwear and other articles, possibly through a kit of cleaning, polishing, and buffing surface treatment materials 24.

A further potential refinement of the motorized tool 10 can be understood with additional reference to FIGS. 16A through 16D. There, the motorized tool 10 further includes a reservoir 116 that can be removably engaged with the body portion 12 of the motorized tool 10. The reservoir 116 has a body portion 118 that defines an open inner volume for retaining a volume of material, such as a cleaning liquid, water, or some other volume of liquid, gel, powder, or a combination or variation thereof. The body portion 118 can be formed, such as by blow molding, of a clear, preferably flexible material, such as polyethylene.

The body portion 118 of the reservoir 116 can be considered to have an anterior portion, which retains a dispensing tip 126, and a posterior portion, which retains a filling aperture/cap 128. Material can be added through the filling aperture/cap 128 and dispensed through the dispensing tip 126. The filling aperture/cap 128 and, potentially, the dispensing tip 126 can be threadedly retained such that filling and dispensing can be selectively permitted. The body portion 118 has a central aperture 120 that substantially corresponds in shape to the shape of the recessed portion 20 of the housing 12 and that is defined at its posterior portion by first and second resiliently deflectable legs 122 and 124. With this, the reservoir 116 can be selectively engaged with the body portion 12 by deflecting the legs 122 and 124.

Figure 16B:
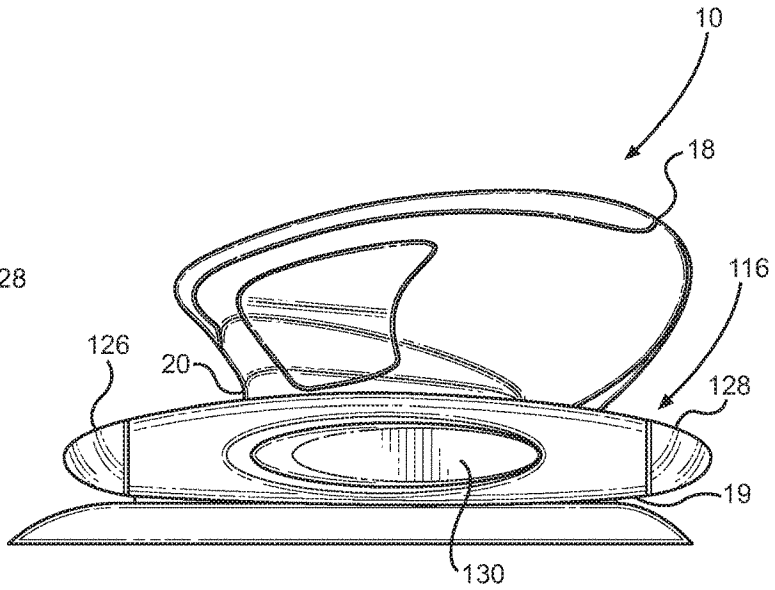
FIG. 16B is a view in side elevation of the motorized tool with a liquid reservoir of FIG. 16A.
Figure 16A:
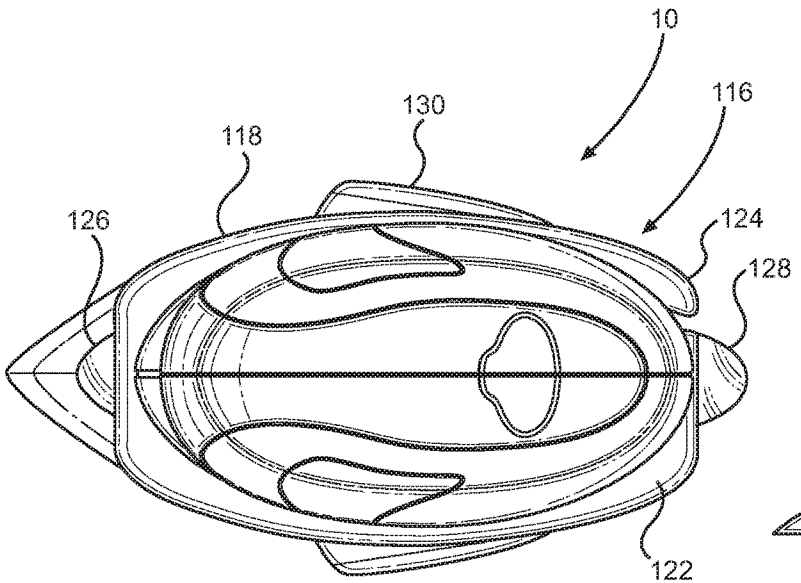
FIG. 16A is a top plan view of a motorized tool with a liquid reservoir.
Figure 16D:
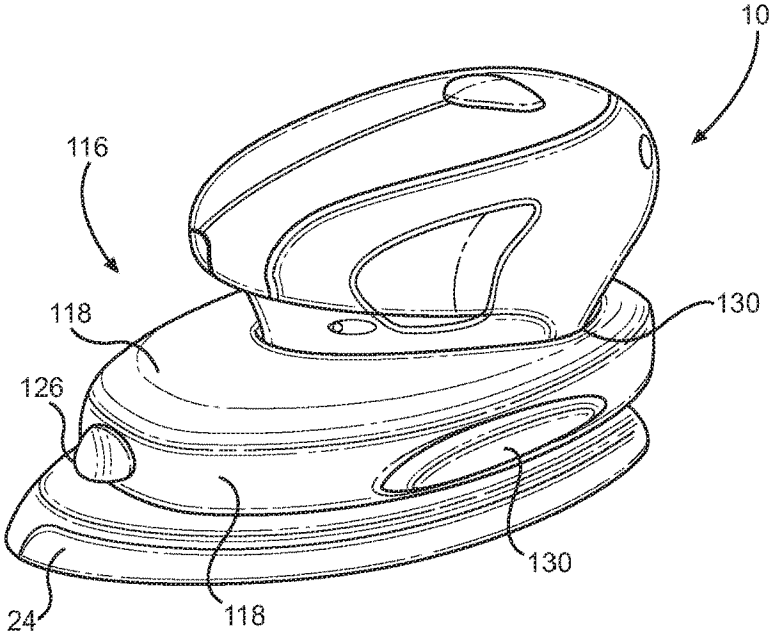
FIG. 16D is a perspective view of the motorized tool with a liquid reservoir.
Figure 16C:
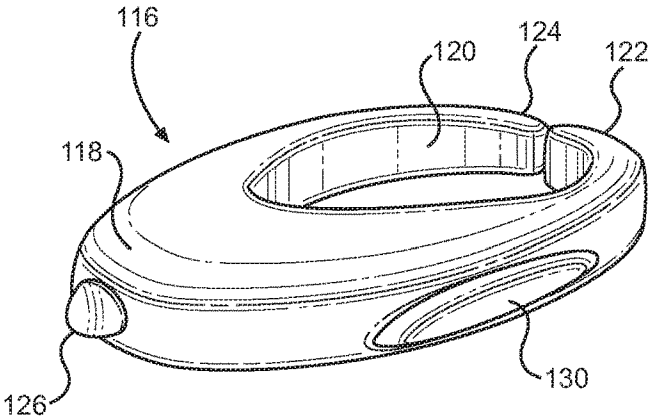
FIG. 16C is a perspective view of the liquid reservoir apart from the motorized tool.

When the reservoir 116 is engaged as in FIGS. 16A, 16B, and 16D, the dispensing tip 126 is angled to squirt retained liquid or other material toward a work surface. In certain embodiments, the dispensing tip 126 can be angled and constructed to squirt material at a predetermined angle anterior to the tip of the pad 24, such as between at least two inches and as much as five inches. Where the body portion 118 is flexible, dispensing of retained material can be actuated simply by squeezing or otherwise compressing the body portion. In the depicted embodiment, first and second resilient squeeze buttons 130 with bellows-type sidewalls are disposed along the outboard surfaces of the body portion 118. With that, the buttons 130 can be selectively depressed to pressurize the open inner volume of the body portion 118 and thereby to squirt material from the body portion 118 onto a work surface. A one-way valve, such as a soft durometer rubber valve incorporated into the filling aperture/cap 128, can be included to permit the introduction of air when necessary.

Figure 20A:
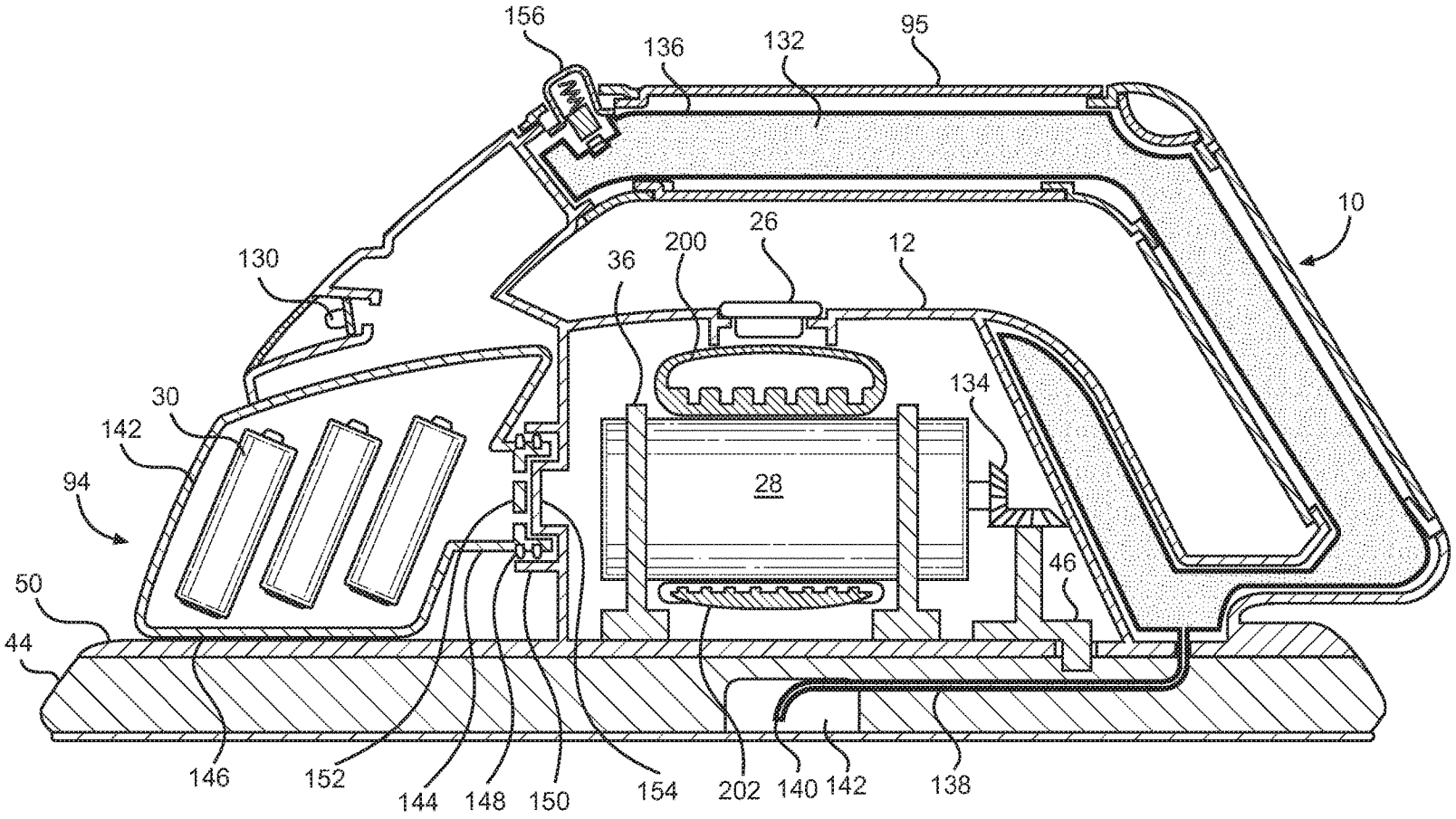
FIG. 20A is a cross-sectional view of an embodiment of the motorized tool with a lighting system, a water resistant battery system, and integrated cooling and liquid dispensing.
Figure 20B:
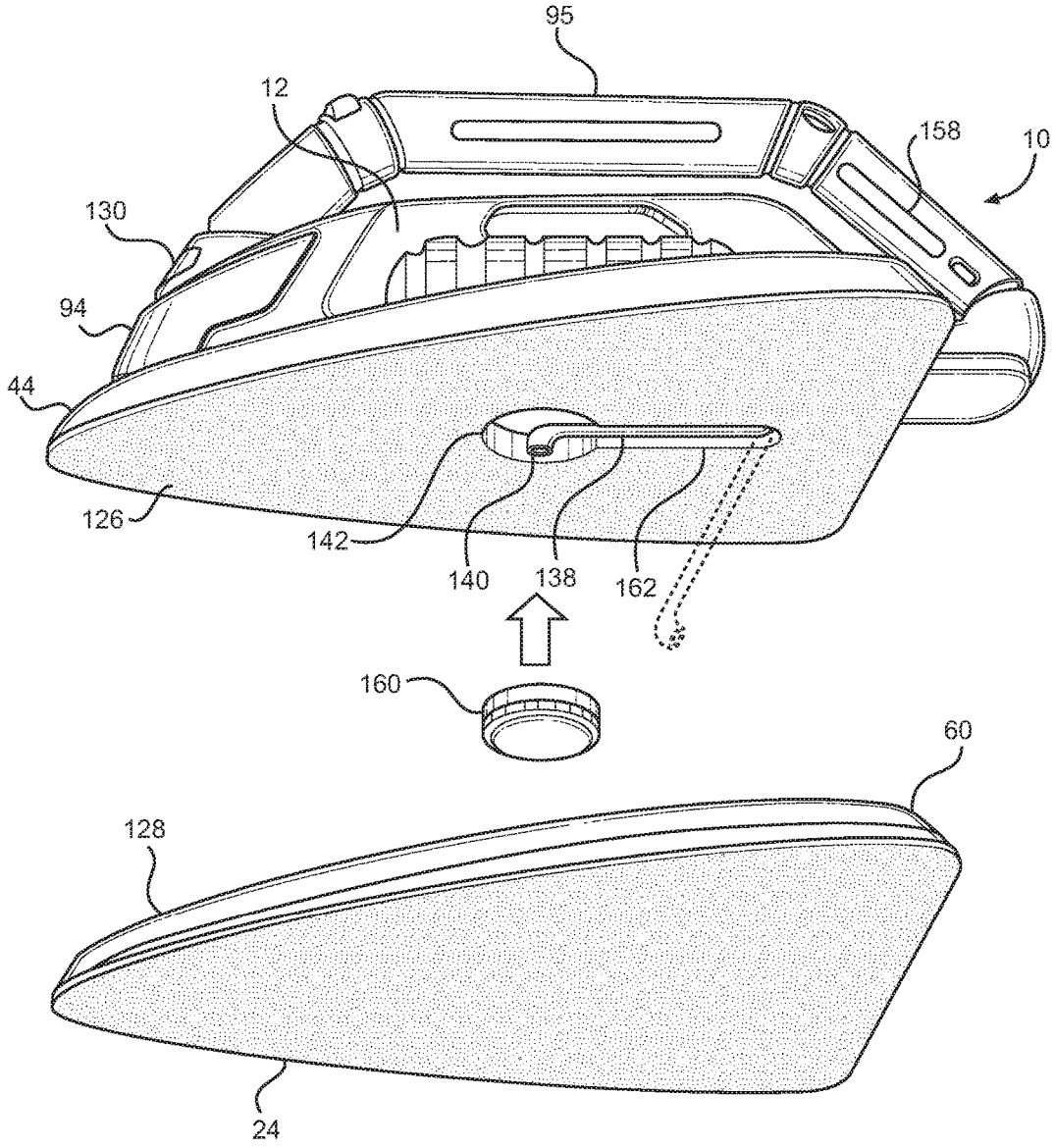
FIG. 20B is a perspective view of the motorized tool of FIG. 20A with the base platform and surface treatment pad detached from the housing.
Figure 20C:
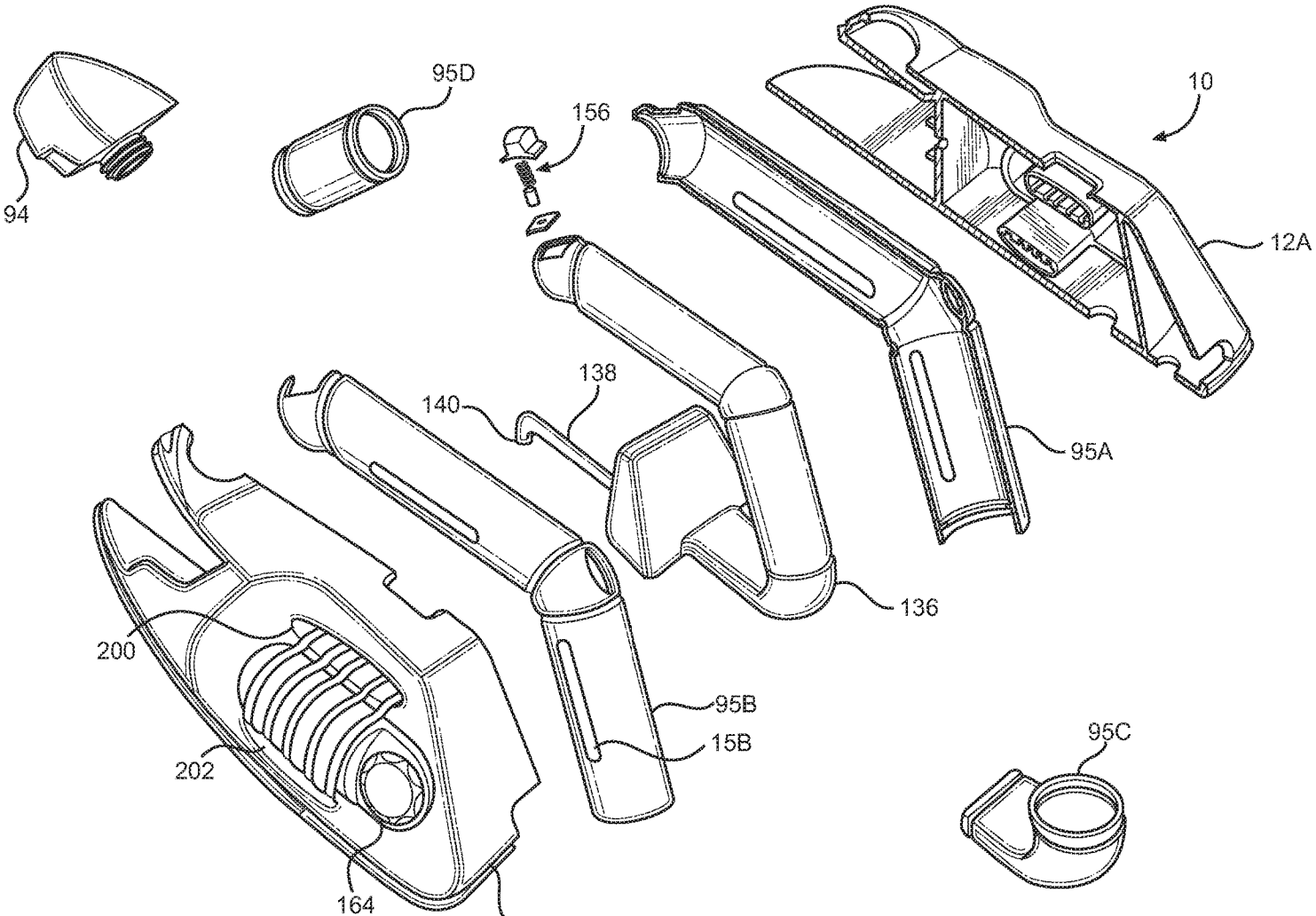
FIG. 20C is an exploded perspective view of the motorized tool of FIG. 20A.

An alternative system for retaining and dispensing liquid, such as water, a cleaning solution, or any other liquid, is illustrated in FIGS. 20A through 20C. There, the motorized tool 10 again has a main housing 12 with an inner volume, and a tool handle 95 again has an anterior portion retained by an anterior portion of the housing 12, a posterior portion retained by a posterior portion of the housing, and a body portion that traverses longitudinally from the anterior to the posterior portions of the handle 95 spaced from the main housing 12. Here, however, a liquid retaining volume is provided within the motorized tool 10 in combination with a mechanism for permitting the automatic or selective emission of a portion of retained liquid from the tool 10, such as into, through, or from the base plate 44 and, additionally or alternatively, a base platform 60 of a retained surface treatment pad 24.

In the present embodiment, the liquid dispensing system has an inner volume within the motorized tool 10 for retaining a volume of liquid 132. The inner volume is lined by a bladder 136. The bladder 136 traverses within the handle 95 from adjacent to the anterior end thereof, along the body portion, through the posterior end of the handle 95, and into a portion of the main housing 12. With that, when the bladder 136 is full of liquid, a continuous liquid volume is established with a portion within the main housing 12 and a portion traversing along the handle 95.

An exhaust tube 138 has a first end in fluidic communication with the inner volume of the bladder 136, a body portion that enters the base plate 44, traverses longitudinally toward a mid-portion of the base plate 44, and a dispensing tip 140 that faces outwardly from the base plate 44. To that end, the base plate 44 can have a channel 162 therein for receiving the body portion of the tube 138 and an open portion 142 for permitting communication between the tip 140 of the tube 138 and external to the base plate 44. A cap 160 could be selectively applied to the open portion 142 to cover and seal the tip 140, such as during uses of the motorized tool 10 not requiring liquid. The tube 138 can in certain embodiments be removable, such as by being clicked into place, to permit cleaning, flushing, or replacement. An actuation button 156, which is spring-loaded and disposed to apply mechanical force to the bladder 136, can be selectively depressed to cause liquid to be emitted from the tip 140 of the tube 138. The actuation button 156 could additionally or alternatively be operably associated with a pumping or other system for enabling powered dispensing of liquid. One or more windows 158 in the handle 95 or elsewhere can be aligned with the bladder 136 to permit a perception of the level of liquid disposed within the bladder 136. An opening and sealing mechanism, such as a screw cap 164 as seen in FIG. 20C, can be provided to permit selective refilling of liquid within the bladder 136.

In practice, a surface treatment pad 24 or surface treatment material 24 can be applied to the motorized tool 10 in any effective manner, including those expressly described herein, and liquid can be dispensed into or through the surface treatment pad 24 onto a target surface. By way of example and not limitation, a porous base platform 60 with or comprising surface treatment material 24 could be removably and replaceably coupled to the base plate 44. With that, liquid ejected from the tip 140 of the tube 138 will tend to saturate or otherwise pass through the base platform 60 thereby to reach the target surface. Alternatively or additionally, the base platform 60 could have one or more apertures therein for permitting passage of liquid therethrough.

Figure 21A:
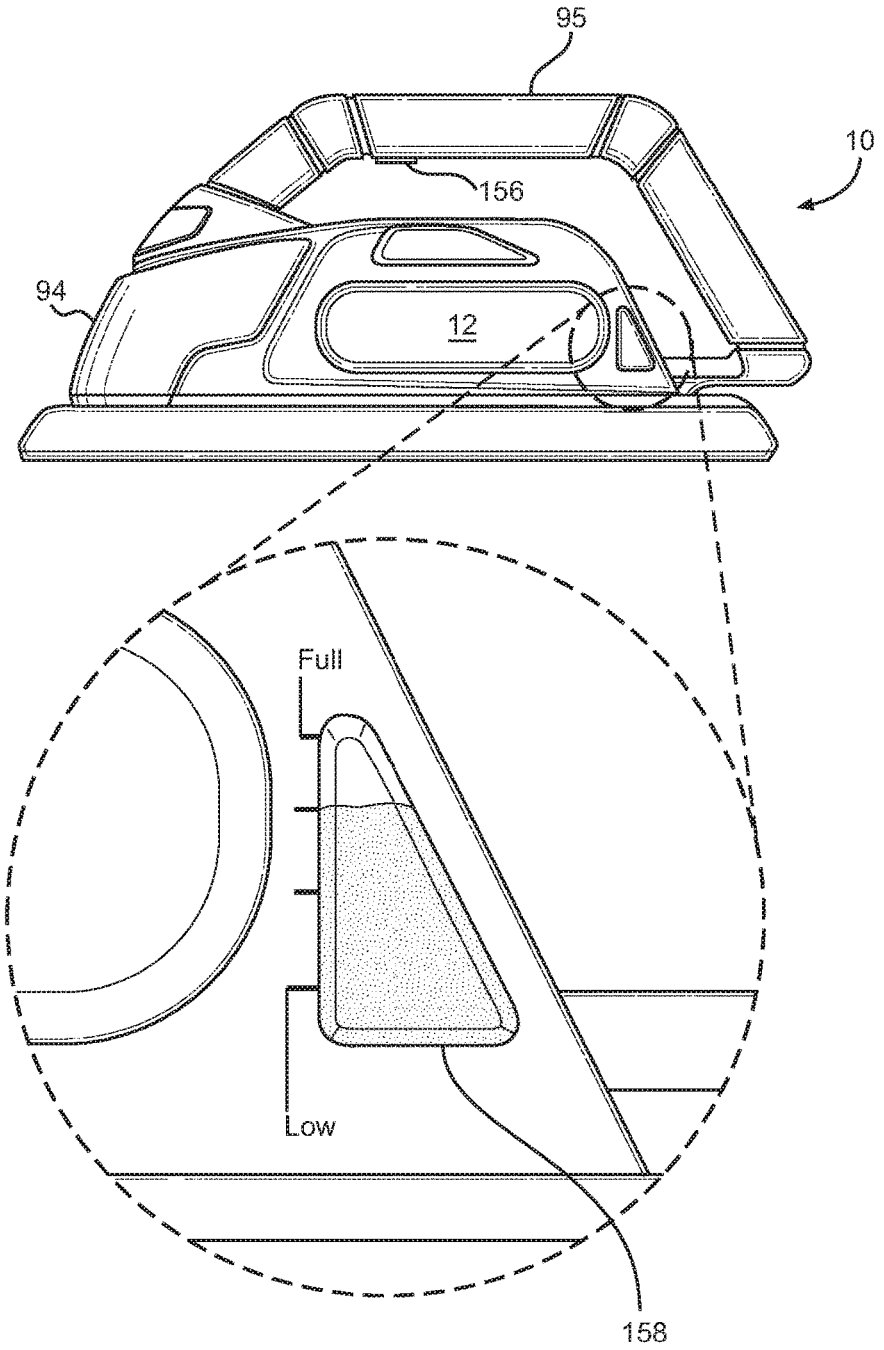
FIG. 21A is a view in side elevation with an inset, amplified view of an embodiment of the motorized tool with integrated cooling and liquid dispensing.
Figure 21B:
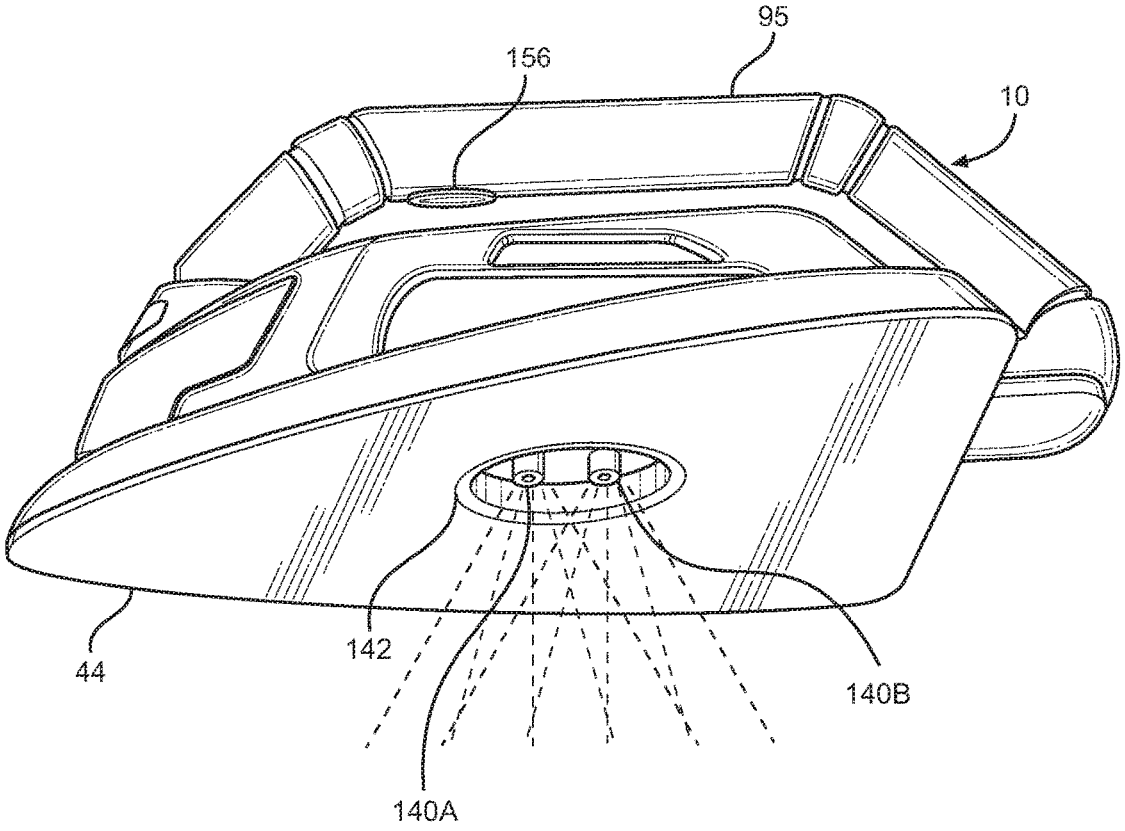
FIG. 21B is a perspective view of the motorized tool of FIG. 21A.

Of course, other manifestations of the liquid dispensing system are possible and within the scope of the invention. For example, looking to FIGS. 21A and 21B, embodiments of the motorized tool 10 are contemplated wherein first and second liquid emitting tips 140A and 140B are provided, each in fluidic communication with an inner volume of liquid. The actuation trigger 156 could be otherwise disposed, such as on a lower surface of the handle 95. Moreover, differently located and configured windows 158 may be provided, such as a window in optical communication with the portion of the liquid disposed within the main housing 12.

In addition to the capacity to dispense liquids from the motorized tool 10, the inclusion of a volume of liquid 132 within the inner volume of the tool 10, such as in the handle 95 and fluidically connected within the main housing 12, is intended to provide a continuous cooling of the housing 12 and the retained motor 28. During operation of the motorized tool 10, for instance, a vibration of the tool 10 will tend to cause liquid 132 retained within the inner volume of the tool to swirl and move within the handle 95 and within the portion of the inner volume contiguous with the motor compartment of the main housing 12. As such, a cooling effect may be achieved. To that end, embodiments of the motorized tool 10 are contemplated wherein, although liquid dispensing may not be required, liquid 132 is nonetheless retained within an open inner volume of the motorized tool 10, such as by traversing at least a portion of the handle 95 and contiguous with the motor compartment of the main housing 12.

Even further, as seen for instance in FIGS. 20A, 20C, 22A, and 22B, the housing 12 of the motorized tool 10 can additionally incorporate passageways 200 and 202 above and below and otherwise adjacent to the motor 28, seen in FIG. 20A, and through the motor compartment of the main housing 12 to permit air flow and to facilitate further cooling of the motor 28. The passageways 200 and 202 can include a plurality of ridges or fins thereby further facilitating heat transfer from the motor 28 and the main housing 12 in general. The passageways 200 and 202, or the volumes of the main housing 12 surrounding the passageways 200 and 202, could be in fluidic connection with the bladder 136 or other volume of liquid retained within the motorized tool 10 whereby liquid in cooling communication with the handle 95 can partially or completely pass around the motor 28.

Figure 22A:
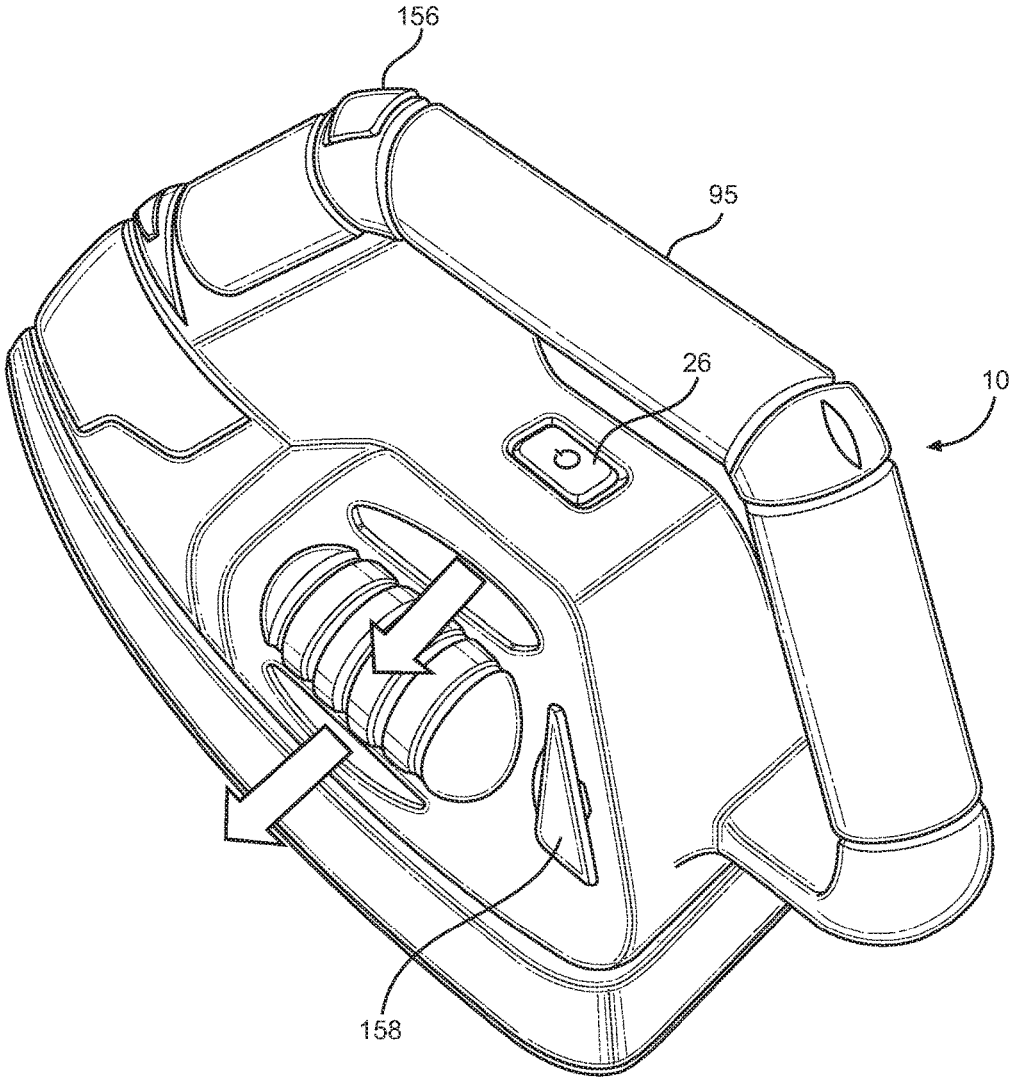
FIG. 22A is a perspective view of another embodiment of the motorized tool with integrated cooling and liquid dispensing.
Figure 22B:
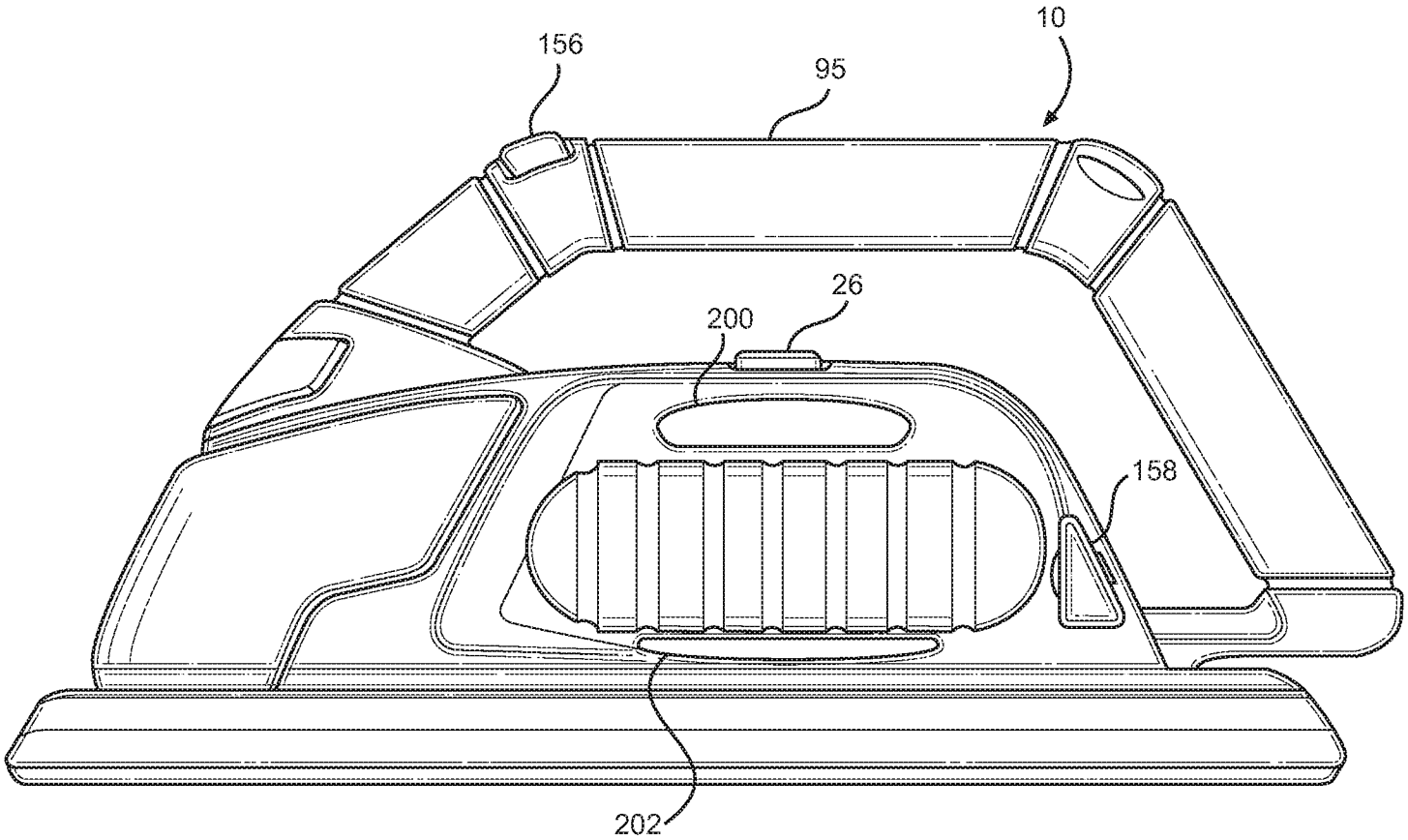
FIG. 22B is a view in side elevation of the motorized tool of FIG. 22A.

With further reference to FIGS. 22A and 22B, for example, it will further be noted that the motorized tool 10 can be substantially symmetrical about a longitudinal centerline. With that, the motorized tool 10 provides ambidextrous accessibility, including in relation to the power button 26 and the liquid dispensing button 156.

With certain details and embodiments of the present invention for a motorized tool 10 disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventors. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof that might be now known or hereafter discovered.

We claim:

1. A motorized tool for scrubbing, buffing, and polishing, wherein the motorized tool comprises:

a housing;

a motor retained within the housing;

an electrical power supply for providing electrical power to the motor;

a switch for selectively permitting electrical power to flow from the power supply to the motor;

a base member retained relative to the housing;

an actuation mechanism that moves the base member in response to an operation of the motor;

a material retention mechanism capable of removably retaining surface treatment material in relation to the base member wherein the material retention mechanism comprises an area of hook or loop material retained by the base member in combination with a base platform that has a first surface that retains an area of loop or hook material and a second surface that retains surface treatment material; and guide marking on the base platform for guiding application of the base platform to the base member wherein the guide marking comprises an outline of a peripheral shape of the base member disposed on the base platform.

2. The motorized tool of claim 1 wherein the material retention mechanism comprises a surface treatment pad that retains surface treatment material in combination with a latching system with a first, latched condition wherein the surface treatment pad is retained by the base member and a second condition wherein the surface treatment pad is removable from the base member.

3. The motorized tool of claim 2 wherein the surface treatment pad comprises a shoe with first and second ends, first and second faces, and surface treatment material retained by the second face of the shoe and wherein the latching system comprises a latching lever and a latch operative to retain the shoe for movement with the base member when in the latched condition.

4. The motorized tool of claim 3 wherein the shoe has a first formation for engaging the base member at a first location and a second formation for being engaged by the latch of the latching system.

5. The motorized tool of claim 4 wherein the first formation comprises a hook formation for hooking over a portion of the base member and wherein the second formation comprises a hook formation for being engaged by the latch of the latching system.

6. The motorized tool of claim 5 wherein the shoe has a dorsal side and a ventral side, wherein the first formation comprises a dorsally facing hook, and wherein the second formation comprises a ventrally facing hook.

7. The motorized tool of claim 3 wherein the latching lever is pivotally coupled to the base member whereby the latching system is retained by the base member.

8. The motorized tool of claim 7 further comprising a handle coupled to the housing wherein the latching lever has a general U-shape about a longitudinal centerline of the motorized tool with a first leg of the U-shape disposed to a first side of the handle, a second leg disposed to a second side of the handle 95, and a base of the U-shape disposed below the handle.

9. The motorized tool of claim 1 wherein the material retention mechanism comprises a sleeved surface treatment system comprising a sleeve with a first panel and a second panel, surface treatment material retained by the first panel, a base platform for being received between the first and second panels, and a mechanism for selectively securing the base platform so received between the first and second panels to the base member.

10. The motorized tool of claim 9 wherein the first and second panels have edges and wherein the first and second panels are joined along at least a portion of the edges.

11. The motorized tool of claim 10 further comprising a mechanical fastening system for selectively joining portions of the first and second panels.

12. The motorized tool of claim 11 wherein the mechanical fastening system comprises a zipper closure.

13. The motorized tool of claim 9 wherein the mechanism for securing the base platform so received between the first and second panels to the base member comprises a plurality of projections from the base member or the base platform in combination with a plurality of apertures in the other of the base platform and the base member.

* * * * *